US010376057B2

(12) United States Patent
Knake

(10) Patent No.: US 10,376,057 B2
(45) Date of Patent: Aug. 13, 2019

(54) RACK AND DRAWER SYSTEMS

(71) Applicant: Drawers In Motion, LLC, Tega Cay, SC (US)

(72) Inventor: Douglas Knake, Tega Cay, SC (US)

(73) Assignee: Drawers In Motion, LLC, Tega Cay, SC (US)

( * ) Notice: Subject to any disclaimer, the term of this patent is extended or adjusted under 35 U.S.C. 154(b) by 0 days.

(21) Appl. No.: 15/683,098

(22) Filed: Aug. 22, 2017

(65) Prior Publication Data

US 2017/0347795 A1 Dec. 7, 2017

Related U.S. Application Data

(63) Continuation-in-part of application No. 14/512,012, filed on Oct. 10, 2014, now Pat. No. 9,737,139, which (Continued)

(51) Int. Cl.
*A47B 96/02* (2006.01)
*B42F 7/12* (2006.01)

(Continued)

(52) U.S. Cl.
CPC ..... *A47B 96/025* (2013.01); *A47B 46/00* (2013.01); *A47B 88/48* (2017.01); *A47B 88/60* (2017.01);

(Continued)

(58) Field of Classification Search
CPC ..... A47B 88/48; A47B 46/005; A47B 77/10; A47B 88/60; A47B 2021/0364; A47B 2210/0059; A47B 17/04; A47B 88/80; A47B 96/025; A47B 83/045; A47B 46/00; A47B 2210/08; A47B 51/00; A47B 21/007; A47B 21/0314; A47B 2021/0321; A47B 2021/0335; A47B 2210/15; A47B 88/969; A47B 77/16; E05B 65/46; E05B 65/44; E05B 65/52; B42F 7/12; E05C 19/022; E05C 19/04; A47F 5/0093; A47F 3/063

(Continued)

(56) References Cited

U.S. PATENT DOCUMENTS 651,739 A 6/1900 Woodruff
721,992 A * 3/1903 Anderson ..... A01G 9/088 211/80

(Continued)

FOREIGN PATENT DOCUMENTS

EP 1820420 A1 8/2007
GB 2480297 A 11/2011

*Primary Examiner* — Hiwot E Tefera
(74) *Attorney, Agent, or Firm* — Reichel Stohry LLP; Mark C. Reichel; Natalie J. Dean

(57) ABSTRACT

Rack and drawer systems. An embodiment of a system of the present disclosure comprises a support box at least partially surrounding a first tray positioned below a second tray; a first glider mechanism and a second glider mechanism each coupled to the first tray and the support box and configured to allow the first tray to be extended outward from the support box in a first direction; and a third glider mechanism coupled to the first tray and the second tray and configured to allow the second tray to be extended sideways perpendicular to the first direction.

18 Claims, 67 Drawing Sheets

Related U.S. Application Data is a continuation-in-part of application No. 14/511,582, filed on Oct. 10, 2014, now Pat. No. 9,833,072, which is a continuation of application No. 13/303,240, filed on Nov. 23, 2011, now abandoned.

(60) Provisional application No. 62/487,239, filed on Apr. 19, 2017, provisional application No. 61/890,598, filed on Oct. 14, 2013, provisional application No. 61/526,637, filed on Aug. 23, 2011, provisional application No. 61/473,637, filed on Apr. 8, 2011, provisional application No. 61/416,612, filed on Nov. 23, 2010.

(51) Int. Cl.

| | |
|---|---|
| ***E05B 65/46*** | (2017.01) |
| ***A47B 46/00*** | (2006.01) |
| ***E05B 65/44*** | (2006.01) |
| ***A47B 88/48*** | (2017.01) |
| ***A47B 88/60*** | (2017.01) |
| *E05B 65/52* | (2006.01) |
| *A47F 5/00* | (2006.01) |
| *A47F 3/06* | (2006.01) |
| *A47B 77/16* | (2006.01) |
| *E05C 19/04* | (2006.01) |
| *E05C 19/02* | (2006.01) |
| *A47B 88/969* | (2017.01) |

(52) U.S. Cl.

CPC ..... *B42F 7/12* (2013.01); *E05B 65/44* (2013.01); *E05B 65/46* (2013.01); *A47B 77/16* (2013.01); *A47B 88/969* (2017.01); *A47F 3/063* (2013.01); *A47F 5/0093* (2013.01); *E05B 65/52* (2013.01); *E05C 19/022* (2013.01); *E05C 19/04* (2013.01)

(58) Field of Classification Search

USPC ... 312/310, 139.1, 139.2, 273, 270.1, 270.2, 312/270.3, 283, 286, 204, 325, 322, 312/223.3, 303, 309, 329, 334.8

See application file for complete search history.

(56) References Cited

U.S. PATENT DOCUMENTS 1,108,082 A * 8/1914 Pennock ..... A47B 67/02 312/226
1,117,338 A * 11/1914 Cox ..... A47B 63/02 312/303
1,213,121 A 1/1917 Mayne
1,345,194 A * 6/1920 Johnson ..... A47B 13/00 312/204
1,845,202 A * 2/1932 Shriver ..... B25H 3/023 312/244
1,949,827 A 3/1934 Conwell
2,590,341 A * 3/1952 Nabholz ..... A47B 21/02 16/307
2,780,926 A * 2/1957 Sharpe ..... F25D 23/10 312/301
2,819,141 A * 1/1958 Myer ..... A47J 47/005 126/333
2,839,349 A * 6/1958 Culver ..... A47G 21/14 312/323
3,801,279 A * 4/1974 Grieco ..... A61L 2/18 134/135
3,814,366 A * 6/1974 Staifer ..... A47B 77/12 248/286.1
3,970,010 A * 7/1976 Cantley ..... A47B 67/04 109/56
3,985,409 A * 10/1976 Kneier ..... A45C 13/02 312/271
4,441,771 A 4/1984 Roesler
4,653,818 A * 3/1987 DeBruyn ..... A47B 77/16 211/113
4,714,305 A * 12/1987 Service ..... A47B 77/16 211/74
5,213,401 A 5/1993 Hatcher
5,404,675 A 4/1995 Schmidhauser
5,407,261 A 4/1995 Mercer
D358,708 S * 5/1995 Ko ..... D3/275
5,560,501 A 10/1996 Rupert
5,586,816 A 12/1996 Geiss, II
5,599,079 A 2/1997 Ranno
5,771,814 A * 6/1998 Clausen ..... A47B 21/0314 108/93
5,957,558 A * 9/1999 Quade ..... A47B 88/48 312/246
5,964,492 A * 10/1999 Lyon ..... B60R 9/00 224/404
6,045,202 A * 4/2000 Simon ..... A45C 11/16 312/107
6,086,176 A * 7/2000 Aoyama ..... A47B 67/04 312/286
6,199,965 B1 3/2001 Kanbe et al.
6,520,610 B1 * 2/2003 Miller ..... A45C 9/00 312/277
6,572,168 B1 6/2003 Radstake
6,590,151 B1 7/2003 Merk et al.
7,063,219 B2 6/2006 Fann et al.
7,140,703 B1 11/2006 Holdgate, III et al.
7,661,777 B2 2/2010 Ceccarelli et al.
7,794,027 B2 9/2010 Calabria et al.
8,776,778 B1 7/2014 Brown
8,926,031 B2 1/2015 Belton
2003/0184192 A1 * 10/2003 Fulop ..... A47F 3/004 312/122
2003/0197451 A1 * 10/2003 Michael ..... A47B 21/0073 312/316
2004/0113530 A1 * 6/2004 Anderson ..... A47B 21/007 312/208.1
2004/0130247 A1 7/2004 Model
2006/0181183 A1 * 8/2006 Galloway ..... A47B 88/00 312/311
2007/0018545 A1 * 1/2007 Calabria ..... A47B 77/10 312/311
2007/0056885 A1 3/2007 Enenkel et al.
2007/0221680 A1 9/2007 Yuyama
2008/0012455 A1 * 1/2008 Zheng ..... A47B 43/00 312/262
2008/0182224 A1 7/2008 Ahern
2009/0284110 A1 11/2009 Mascari
2012/0080901 A1 4/2012 Izydorek
2012/0217858 A1 8/2012 Lai
2013/0146552 A1 6/2013 Grimes
2016/0015170 A1 * 1/2016 Schulman ..... A47B 23/02 108/91

* cited by examiner

RACK AND DRAWER SYSTEMS

PRIORITY

The present application A) is related to, and claims the priority benefit of, U.S. Provisional Patent Application Ser. No. 62/487,239, filed Apr. 19, 2017, and B) is related to, claims the priority benefit of, and is a U.S. continuation-in-part patent application of, U.S. patent application Ser. No. 14/512,012, filed Oct. 10, 2014 and issued as U.S. Pat. No. 9,737,139 on Aug. 22, 2017, which a) is related to, claims the priority benefit of, U.S. Provisional Patent Application Ser. No. 61/890,590, filed Oct. 14, 2013, and b) is related to, claims the priority benefit of, and is a U.S. continuation-in-part patent application of, U.S. patent application Ser. No. 14/511,582, filed Oct. 10, 2014, which is related to, claims the priority benefit of, and is a U.S. continuation patent application of, U.S. patent application Ser. No. 13/303,240, filed Nov. 23, 2011, now abandoned, which is related to, and claims the priority benefit of, U.S. Provisional Patent Application Ser. No. 61/526,637, filed Aug. 23, 2011, U.S. Provisional Patent Application Ser. No. 61/473,637, filed Apr. 8, 2011, and U.S. Provisional Patent Application Ser. No. 61/416,612, filed Nov. 23, 2010. The contents of each of these patent applications and patent are incorporated herein directly and by reference in their entirety.

BACKGROUND

Cabinetry, including kitchen and other cabinets, routinely become filled with various items, at times preventing additional items to be stored therein. When cabinets either have limited shelf space, or have not enough shelves, space may be present within such cabinets and no means to utilize the space. Furthermore, a number of cabinets have external features, such as the recessed portion underneath a kitchen wall cabinet, that is typically only used, if ever, as a base for lighting or a kitchen radio. Accordingly, devices and systems useful to provide additional storage space within or around current cabinetry would be well received, including such devices and systems having features to make their use easy and convenient.

BRIEF SUMMARY

In an exemplary embodiment of a rack system of the present disclosure, the rack system comprises a tray having a bottom, a first side, and an opposing second side, a first glider mechanism coupled to the first side of the tray, a second glider mechanism coupled to the second side of the tray, a first hinge mechanism coupled to a first end of the first glider mechanism, and a second hinge mechanism coupled to a first end of the second glider mechanism, wherein the first glider mechanism and the second glider mechanism are operable to allow the tray to move back and forth along a glider mechanism axis, and wherein the first hinge mechanism and the second hinge mechanism are operable to allow the tray to pivotally move relative to a pivot point. In another embodiment, the first glider mechanism and the second glider mechanism each comprise a side wall bracket and an engagement bracket. In yet another embodiment, the side wall bracket and the engagement bracket of each said glider mechanism slidingly engage one another. In an additional embodiment, the first glider mechanism and the second glider mechanism each further comprise a coupler bracket, wherein the side wall bracket slidingly engages the coupler bracket of each said glider mechanism, and wherein the coupler bracket slidingly engages the engagement bracket of each said glider mechanism. In yet an additional embodiment, the first glider mechanism and the second glider mechanism each further comprise a bracket cover coupled to the engagement bracket.

In an exemplary embodiment of a rack system of the present disclosure, the rack system comprises a tray having a base panel, a first side, and an opposing second side, a first glider mechanism coupled to the first side of the tray, a second glider mechanism coupled to the second side of the tray, a first rotation mechanism coupled to the first side of the tray, and a second rotation mechanism coupled to the second side of the tray, wherein the first glider mechanism and the second glider mechanism are operable to allow the tray to move back and forth along a glider mechanism axis, and wherein the tray is operable to rotate about the first and second rotation mechanisms. In another embodiment, the rack system further comprises a first hinge mechanism coupled to a first end of the first glider mechanism, and a second hinge mechanism coupled to a first end of the second glider mechanism, wherein the first hinge mechanism and the second hinge mechanism are operable to allow the tray to pivotally move relative to a pivot point. In another embodiment, the first hinge mechanism and the second hinge mechanism are counterbalance hinges operable to facilitate the pivotal movement of the tray.

In an exemplary embodiment of a rack system of the present disclosure, the tray has a first access configuration and a second access configuration, the first access configuration corresponding to no rotation of the tray about the first and second rotation mechanisms, and the second access configuration corresponding to rotation of the tray about the first and second rotation mechanisms at or about 180 .degree.

In an exemplary embodiment of a rack system of the present disclosure, the rack system further comprises a first tray cover, the first tray cover coupled to the tray at a relative top of the tray. In another embodiment, the rack system further comprises a second tray cover, the second tray cover coupled to the tray at a relative bottom of the tray. In an additional embodiment, the first tray cover is hingedly coupled to the first tray so that the first tray cover may open and close about the first tray. In another embodiment of a rack system of the present disclosure, the rack system further comprises a first closure mechanism operable to secure the first tray cover in a closed position about the tray. In an additional embodiment, the first closure mechanism comprises a hook coupled to the tray and a receiver coupled to the first tray cover. In yet an additional embodiment, the first closure mechanism comprises a hook coupled to the first tray cover and a receiver coupled to the tray. In another embodiment, the rack system further comprises a second closure mechanism operable to secure the first tray cover in a closed position about the tray.

In an exemplary embodiment of a rack system of the present disclosure, the first glider mechanism and the second glider mechanism each comprise a side wall bracket and an engagement bracket. In another embodiment, the side wall bracket and the engagement bracket of each said glider mechanism slidingly engage one another. In yet another embodiment, the first glider mechanism and the second glider mechanism each further comprise a coupler bracket, wherein the side wall bracket slidingly engages the coupler bracket of each said glider mechanism, and wherein the coupler bracket slidingly engages the engagement bracket of each said glider mechanism. In an additional embodiment, the first glider mechanism and the second glider mechanism each further comprise a bracket cover coupled to the engagement bracket.

In an exemplary embodiment of a rack system of the present disclosure, the first hinge mechanism and the second hinge mechanism each comprise a first arm and a second arm hingedly coupled to one another. In an additional embodiment, the first hinge mechanism and the second hinge mechanism are counterbalance hinges operable to facilitate the pivotal movement of the tray. In an additional embodiment, the first glider mechanism, the second glider mechanism, the first hinge mechanism, and the second hinge mechanism are each configured to engage an external structure when the rack system is positioned relative to the external structure. In yet an additional embodiment, the first glider mechanism and the second glider mechanism each comprise a side wall bracket and an engagement bracket, wherein each engagement bracket engages the external structure at a pivot point, wherein the first hinge mechanism and the second hinge mechanism each comprise a first arm and a second arm hingedly coupled to one another, and wherein each second arm engages the external structure at a connection point.

In an exemplary embodiment of a rack system of the present disclosure, the rack system further comprises at least one glider spacer coupled to either the first glider mechanism or the second glider mechanism. In another embodiment, the first rotation mechanism is further coupled to the first glider mechanism. In yet another embodiment, the first rotation mechanism is further coupled to the at least one glider spacer. In an additional embodiment, the tray further comprises a cover plate positioned adjacent to the front side of the tray.

In an exemplary embodiment of a rack system of the present disclosure, the rack system further comprises a latch mechanism, the latch mechanism configured to engage a latch member positioned external to the tray. In another embodiment, the latch mechanism is further configured to engage the latch member to support the tray and its contents. In yet another embodiment, the latch mechanism is coupled to the tray. In an additional embodiment, the latch mechanism is coupled to cover plate positioned adjacent to the front side of the tray. In yet an additional embodiment, the latch mechanism is positioned within a tray pocket of the cover plate.

In an exemplary embodiment of a rack system of the present disclosure, the rack system further comprises one or more tray stops coupled to the tray, the one or more tray stops capable of stopping rotation of the tray about the first rotation mechanism. In an additional embodiment, the one or more tray stops each comprise a stop body and a stop fastener. In another embodiment, the rack system further comprises at least one glider actuator coupled to the tray, the at least one glider actuator capable of automatically facilitating back and forth movement of the tray. In yet another embodiment, the rack system further comprises at least one glider actuator coupled to one or more of the first glider mechanism and/or the second glider mechanism, the at least one glider actuator capable of automatically facilitating back and forth movement of the tray.

In an exemplary embodiment of a rack system of the present disclosure, the rack system further comprises at least one hinge actuator coupled to the tray, the at least one hinge actuator capable of automatically facilitating pivotal movement of the tray. In another embodiment, the rack system further comprises at least one hinge actuator coupled to one or more of the first glider mechanism and/or the second glider mechanism, the at least one hinge actuator capable of automatically facilitating pivotal movement of the tray. In yet another embodiment, the rack system further comprises at least one rotation actuator coupled to the tray, the at least one rotation actuator capable of facilitating rotational movement of the tray.

In an exemplary embodiment of a rack system of the present disclosure, the rack system further comprises a lock mechanism coupled to the tray, the lock mechanism capable of locking the tray in place before or after rotation of the tray. In an additional embodiment, the lock mechanism comprises a spring-loaded ball configured to engage a lock receiver coupled to an adjacent component of the rack system. In another embodiment, the lock receiver is selected from the group consisting of a receiver plate having an aperture defined therethrough and a pocket.

In an exemplary embodiment of a rack system of the present disclosure, the rack system is configured as a drawer. In an exemplary embodiment of a rack system of the present disclosure, the rack system comprises a tray having a base panel, a first side, and an opposing second side, a first glider mechanism coupled to the first side of the tray, a second glider mechanism coupled to the second side of the tray, a first rotation mechanism coupled to the first side of the tray, a second rotation mechanism coupled to the second side of the tray, a first hinge mechanism coupled to a first end of the first glider mechanism, a second hinge mechanism coupled to a first end of the second glider mechanism, a first tray cover, the first tray cover coupled to the tray at a relative top of the tray, a second tray cover, the second tray cover coupled to the tray at a relative bottom of the tray, a first closure mechanism operable to secure the first tray cover in a closed position about the tray, and a second closure mechanism operable to secure the first tray cover in a closed position about the tray, wherein the first glider mechanism and the second glider mechanism are operable to allow the tray to move back and forth along a glider mechanism axis, wherein the tray is operable to rotate about the first and second rotation mechanisms, and wherein the first hinge mechanism and the second hinge mechanism are operable to allow the tray to pivotally move relative to a pivot point.

In an exemplary embodiment of a rack system of the present disclosure, the rack system comprises a first tray having a base panel, a first side, and an opposing second side, a second tray having a base panel, a first side, and an opposing second side, a first glider mechanism coupled to the first side of the second tray, a second glider mechanism coupled to the second side of the second tray, and at least one pivot mechanism coupled to the first tray and the second tray, wherein the first glider mechanism and the second glider mechanism are operable to allow the second tray to move back and forth along a glider mechanism axis, and wherein the first tray and the second tray are operable to pivot relative to one another by way of the first pivot mechanism. In yet another embodiment, the at least one pivot mechanism comprises at least one lift actuator capable of pivoting the first tray relative to the second tray. In an additional embodiment, the rack system further comprises a first tray cover, the first tray cover coupled to the first tray at a relative top of the tray.

In an exemplary embodiment of a rack system of the present disclosure, the rack system comprises at least one cam mechanism configured to engage at least one guide channel, the at least one guide channel configured to enable the second tray to tilt as the first and second glider mechanisms extend. In yet another embodiment, the rack system comprises a tilt actuator coupled to the second tray and configured to automatically facilitate tilting motion of the second tray.

In an exemplary embodiment of a system of the present disclosure, the system comprises a first tray; a second tray positioned relatively above the first tray; a support box positioned around at least part of the first tray and the second tray; a first glider mechanism coupled to the first tray on a first side of the first tray and further coupled to the support box; a second glider mechanism coupled to the first tray on a second side of the first tray opposite the first side and further coupled to the support box; and a third glider mechanism coupled to the first tray and the second tray; wherein the system is configured so that the first tray and the second tray can be extended outward from the support box in a first direction by extending the first glider mechanism and the second glider mechanism; and wherein the system is further configured so that the second tray can be moved sideways perpendicular to the first direction by extending the third glider mechanism.

In an exemplary embodiment of a system of the present disclosure, the system further comprises a fourth glider mechanism coupled to the first tray and the third tray.

In an exemplary embodiment of a system of the present disclosure, the system further comprises a first cam mechanism coupled to the first tray on a first side of the first tray, the first cam mechanism configured to fit within a first guide channel defined within the support box.

In an exemplary embodiment of a system of the present disclosure, the first guide channel is configured to allow a rear portion of the first tray to move upwards simultaneously as a front portion of the first tray is extended from the support box in a horizontal direction by the first glider mechanism and the second glider mechanism, such that the first tray is configured to have a gradually increasing tilt relative to the first glider mechanism and the second glider mechanism as the first tray is extended from the support box.

In an exemplary embodiment of a system of the present disclosure, the system further comprises a third tray positioned relatively above the first tray and positioned next to the second tray; and an additional glider mechanism coupled to the first tray and the third tray.

In an exemplary embodiment of a system of the present disclosure, the system is further configured so that the third tray can be moved sideways perpendicular to the first direction by extending the additional glider mechanism.

In an exemplary embodiment of a system of the present disclosure, the system further comprises a first finger guard coupled to the first tray on a first side of the first tray. In an exemplary embodiment of a system of the present disclosure, the system further comprises a second finger guard coupled to the first tray on a second side of the first tray.

In an exemplary embodiment of a system of the present disclosure, the system further comprises a first tilt actuator coupled to the first tray and the support box.

In an exemplary embodiment of a system of the present disclosure, the system further comprises an external structure at least partially surrounding the support box; and a first cover plate hingedly coupled to an external structure at or near a relative top of the external structure.

In an exemplary embodiment of a system of the present disclosure, the system further comprises a second cover plate hingedly coupled to the external structure at or near a relative bottom of the external structure.

In an exemplary embodiment of a system of the present disclosure, the support box is configured to tilt downward at an angle relative to the external structure, and wherein the first tray is configured to extend outward from the support box while the support box is tilted downward at the angle relative to the external structure.

In an exemplary embodiment of a system of the present disclosure, the system further comprises a first bracket coupled to the external structure; and a second bracket coupled to the support box; wherein the first bracket is configured to contact the second bracket when the support box is tilted downward relative to the external structure.

In an exemplary embodiment of a system of the present disclosure, the third tray is configured to move in the first direction.

In an exemplary embodiment of a system of the present disclosure, the system further comprises a tilt mechanism coupled to the first tray and the second tray, the tilt mechanism configured to allow the second tray to pivot upward relative to the first tray.

In an exemplary embodiment of a system of the present disclosure, the system comprises a first tray; a second tray positioned relatively above the first tray; a third tray positioned relatively above the first tray and next to the second tray; a support box positioned around at least part of the first tray, the second tray, and the third tray; a first glider mechanism coupled to the first tray on a first side of the first tray and further coupled to the support box; a second glider mechanism coupled to the first tray on a second side of the first tray opposite the first side and further coupled to the support box; a third glider mechanism coupled to the first tray and the second tray; and an additional glider mechanism coupled to the first tray and the third tray; wherein the system is configured so that the first tray, the second tray, and the third tray can be extended outward from the support box in a first direction by extending the first glider mechanism and the second glider mechanism; wherein the system is further configured so that the second tray can be moved sideways perpendicular to the first direction by extending the third glider mechanism; and wherein the system is further configured so that the third tray can be moved sideways perpendicular to the first direction by extending the additional glider mechanism.

In an exemplary embodiment of a system of the present disclosure, the system further comprises a first cam mechanism coupled to the first tray on a first side of the first tray, the first cam mechanism configured to fit within a first guide channel defined within the support box.

In an exemplary embodiment of a system of the present disclosure, the system further comprises a first finger guard coupled to the first tray on a first side of the first tray; and a second finger guard coupled to the first tray on a second side of the first tray.

In an exemplary embodiment of a system of the present disclosure, the system comprises a support box at least partially surrounding a first tray positioned below a second tray; a first glider mechanism and a second glider mechanism each coupled to the first tray and the support box and configured to allow the first tray to be extended outward from the support box in a first direction; and a third glider mechanism coupled to the first tray and the second tray and configured to allow the second tray to be extended sideways perpendicular to the first direction.

In an exemplary embodiment of a system of the present disclosure, the system further comprises a third tray positioned next to the second tray; and an additional glider mechanism coupled to the first tray and the third tray and configured to allow the third tray to be extended sideways perpendicular to the first direction.

DETAILED DESCRIPTION

Figure 1:
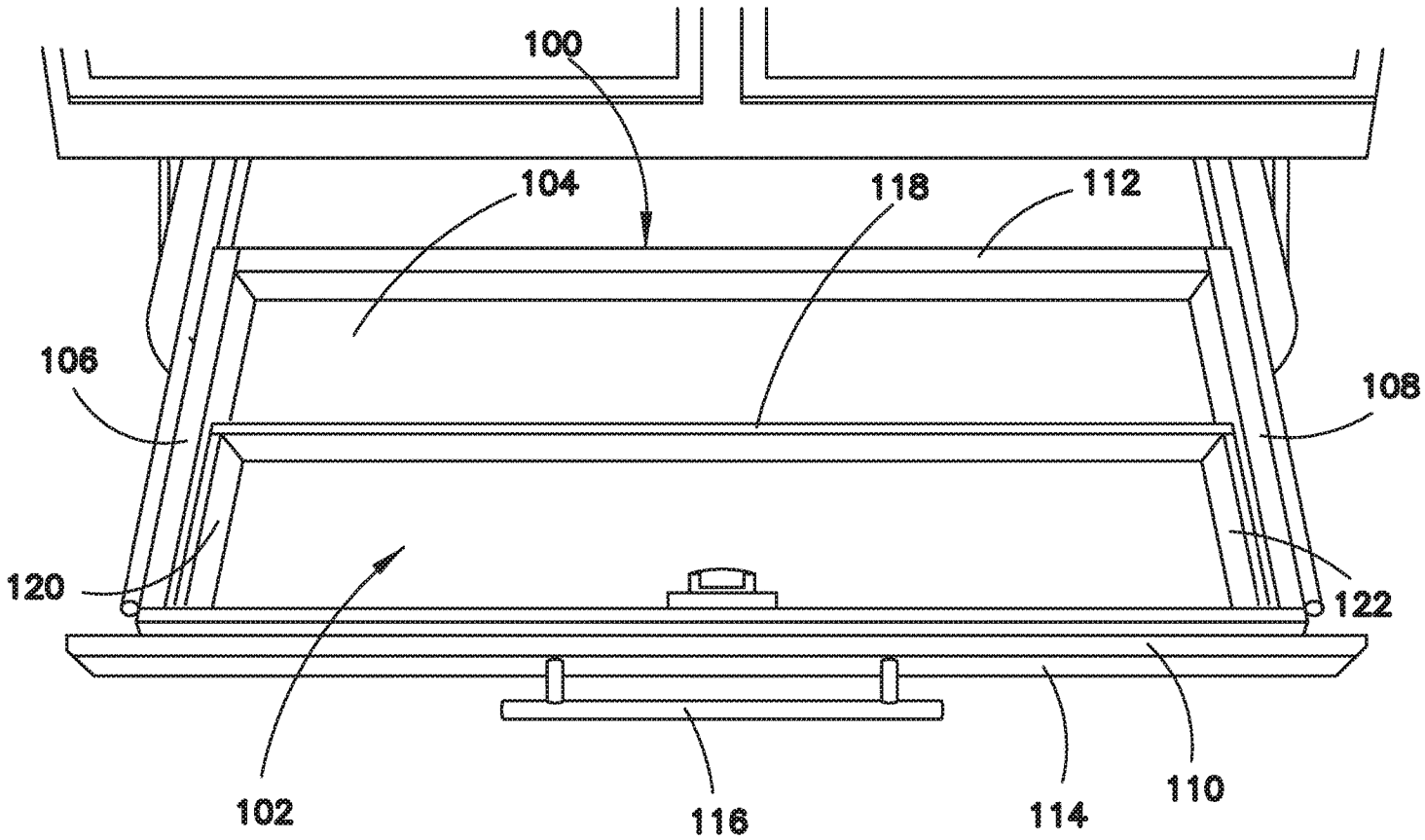
FIG. 1 shows a top view of a tray of a rack system in a relatively open configuration, according to an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

An exemplary rack system of the present disclosure is shown in FIG. 1. As shown in FIG. 1, an exemplary rack system 100 comprises a tray 102 having a bottom 104, a first side 106, and an opposing second side 108. In various embodiments, and as shown in FIG. 1, rack system 100 may further comprise an optional front side 110, an optional opposing back side 112, and/or an optional cover plate 114 coupled to optional front side 110.

In addition, and as shown in FIG. 1, rack system 100 may further comprise hardware 116, such as, for example, one or more knobs, handles, pulls, pockets, etc. In various embodiments, rack systems 100 may also comprise one or more optional dividers 118 which may be positioned within tray 102, for example, using one or more divider braces 120, 122.

In at least one exemplary embodiment of a rack system 100 of the present disclosure, and as shown in FIG. 1, rack system 100 is a spice rack useful to store one or more spice containers. Various other embodiments of rack systems 100 of the present disclosure may be used to store any number of other items, including, but not limited to, paperwork, books, food, clothing, etc.

As shown in FIG. 1, an exemplary rack system 100 may comprise one divider 118, positioned in the relative middle of tray 102, to create two sections of tray 102. Divider 118, as shown in FIG. 1, is positioned using divider braces 120, 122. Each section of tray 102 can then be used to store various spices, in an embodiment of a rack system 100 used as a spice rack, for example.

Figure 2:
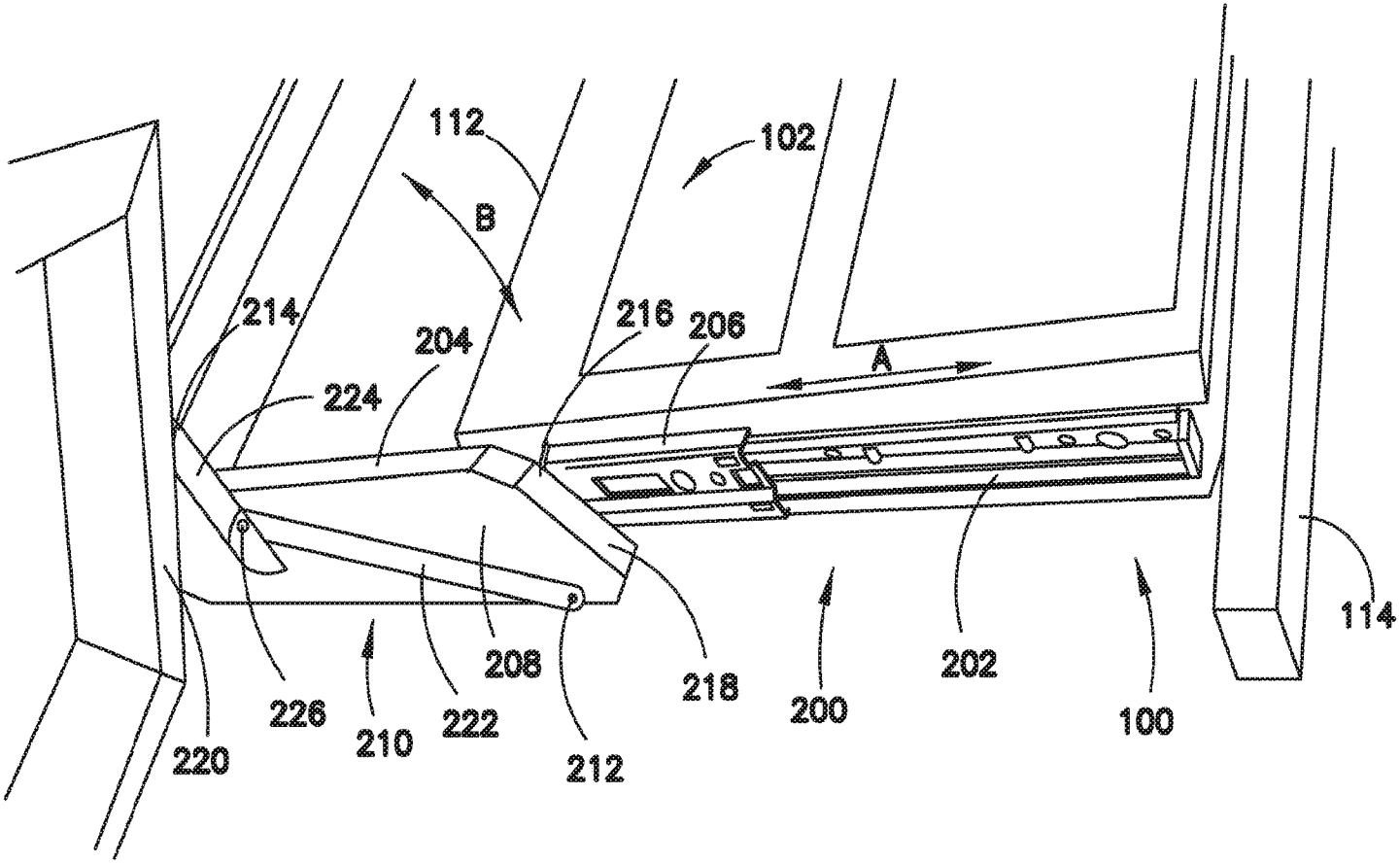
FIG. 2 shows a perspective view of an outer portion of a first side of a rack system in a relatively open configuration, according to an embodiment of the present disclosure.

An exemplary glider mechanism useful with a tray 102 of the present disclosure is shown in FIG. 2. As shown in FIG. 2, glider mechanism 200 (of rack system 100) comprises a side wall bracket 202 and an engagement bracket 204, whereby side wall bracket 202 and engagement bracket 204 can either directly slidingly engage one another or indirectly engage one another by way of a coupler bracket 206 positioned therebetween. As referenced herein, a glider mechanism 200 of the present may refer to the mechanism positioned on a side of a tray 102, and in an embodiment having two glider mechanisms 200, said mechanisms may be referred to as a first glider mechanism and a second glider mechanism. Portions of glider mechanism 200, in at least one embodiment, may move back and forth in a direction shown by the bi-directional arrow A in FIG. 2.

As shown in FIG. 2, engagement bracket 204 may further comprise an optional bracket cover 208 coupled to side wall bracket 202 or engagement bracket 204. Bracket cover 208, in at least one embodiment, may comprise the same or similar material (wood, plastic, metal, etc.) as tray 102, front side 110, and/or cover plate 114, in order to improve the overall aesthetic appearance of rack system 100 and/or to match components of rack system 100 to surrounding cabinetry and/or furniture. For example, cover plate 114 may be made of mahogany, and bracket cover 208 may also be made of mahogany with the same or similar finish.

In various embodiments, cover plate 114 and/or various other components of exemplary rack systems 100, may comprise various types of wood, including but not limited to oak, cherry, maple, pine, teak, etc., and may have any number of types of stains and/or finishes, such as lacquer, polyurethane, etc., applied thereto. In addition, cover plate 114, and potentially additional components of rack systems 100 of the present disclosure, may comprise any number of "standard finishes," such as stained natural oak to match or compliment standard off-the-rack cabinetry available at various home improvement centers for immediate purchase, or it/they may comprise any number of "custom finishes" that are available at home improvement centers or custom cabinet shops for special ordering.

Various glider mechanisms 200 of the present disclosure may further comprise a hinge mechanism 210, such as shown in FIG. 2. Hinge mechanism 210, in at least one embodiment, is coupled to engagement bracket 204 (or bracket cover 208), whereby a first end 212 of hinge mechanism 210 engages engagement bracket 204 or bracket cover 208 at a first end 216 of engagement bracket 204 or a first end 218 of bracket cover 208. A second end 214 of hinge mechanism 210 may then be coupled to an external structure 220, such as a kitchen cabinet or another type of cabinet, as shown in FIG. 2. As such, and in at least one embodiment, the first end 212 of hinge mechanism 210 is coupled to the first end 216 of engagement bracket 204 (or a first end 218 of bracket cover 208), and the second end 214 of hinge mechanism 210 is coupled to external structure 220.

Hinge mechanism 210, as shown in FIG. 2, can comprise a first arm 222 and a second arm 224, whereby first arm 222 and second arm 224 are hingedly coupled to one another at hinge 226. Various embodiments of hinge mechanism 210, as shown in FIG. 2, can pivot away from and toward an external structure 220, such as the underside of a wall kitchen cabinet, in a direction shown by the bi-directional arrow B in FIG. 2. The various glider mechanisms 200 and hinge mechanisms 210 disclosed herein are not intended to be exhaustive in nature, as other gliders and/or hinges suitable to permit tray 102 to glide back and forth along a glider axis and suitable to permit tray 102 to pivot up and down about a pivot point, respectively, may be useful in one or more embodiments of rack systems 100 of the present disclosure.

Figure 3:
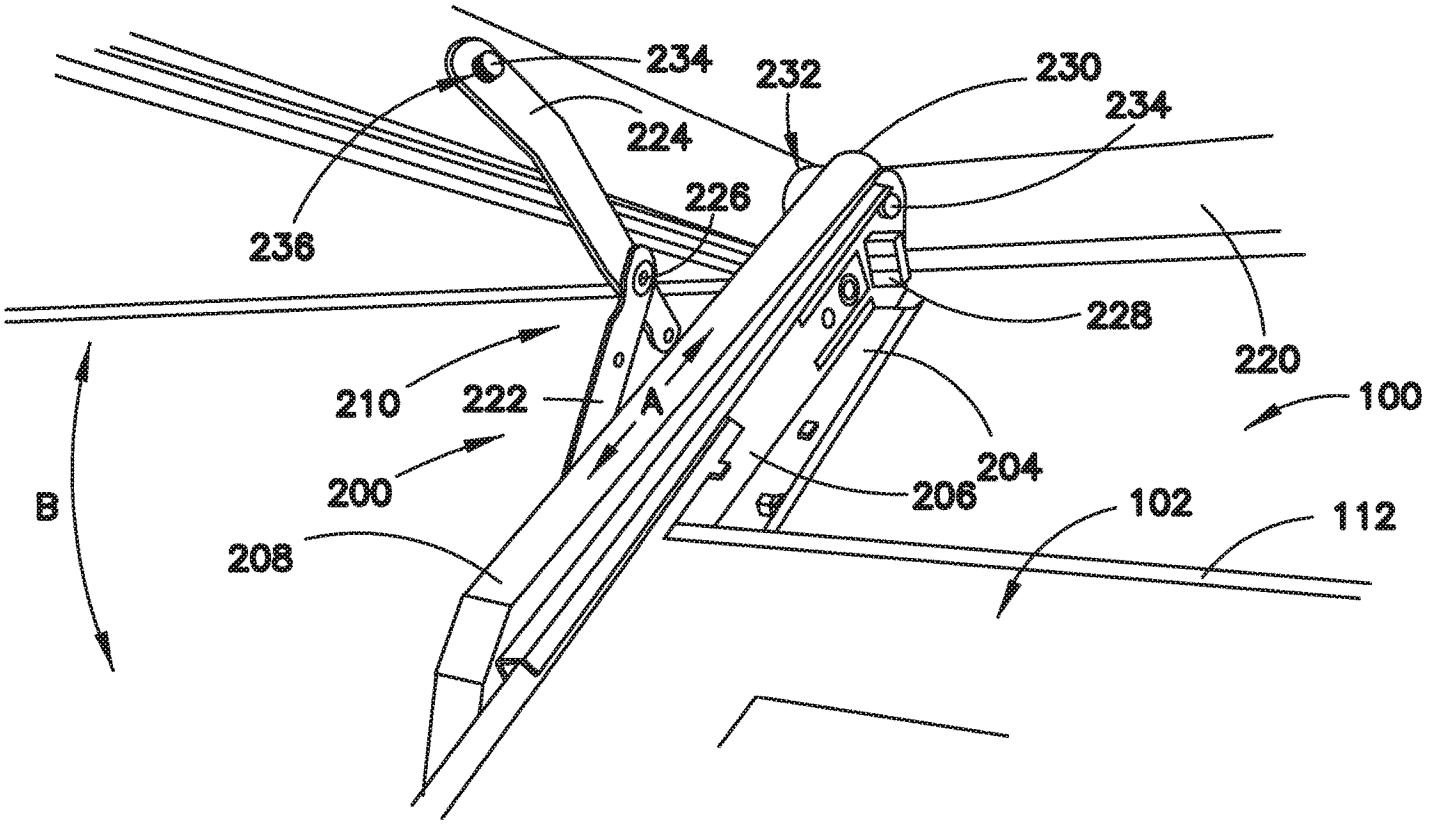
FIG. 3 shows a perspective view of an inner portion of a first side of a rack system in a relatively open configuration, according to an embodiment of the present disclosure.

Another view of portions of a rack system 100 of the present disclosure is shown in FIG. 3. In the perspective view shown in FIG. 3, a relative inside of engagement bracket 204 is visible, whereby coupler bracket 206 slidingly engages engagement bracket 204. Such a sliding engagement allows tray 102 to move back and forth in a direction shown by the bi-directional arrow A in FIG. 3. Furthermore, hinge mechanism 210, as shown in FIG. 3, would allow tray 102 to pivot away from and toward an external structure 220 in a direction shown by the bi-directional arrow B. An overall pivot movement of tray 102 is further facilitated by way of coupling a second end 228 of engagement bracket 204 or a second end 230 of bracket cover 208 to external structure 220 at pivot point 232, as shown in FIG. 3. Such a coupling may be made using one or more fasteners 234, which may include, but are not limited to, screws, nails, and/or bolts. In addition, pivot movement may be facilitated by way the coupling of portions of hinge mechanism 210, such as second arm 224, to external structure 220 at connection point 236, using one or more fasteners.

Figure 4:
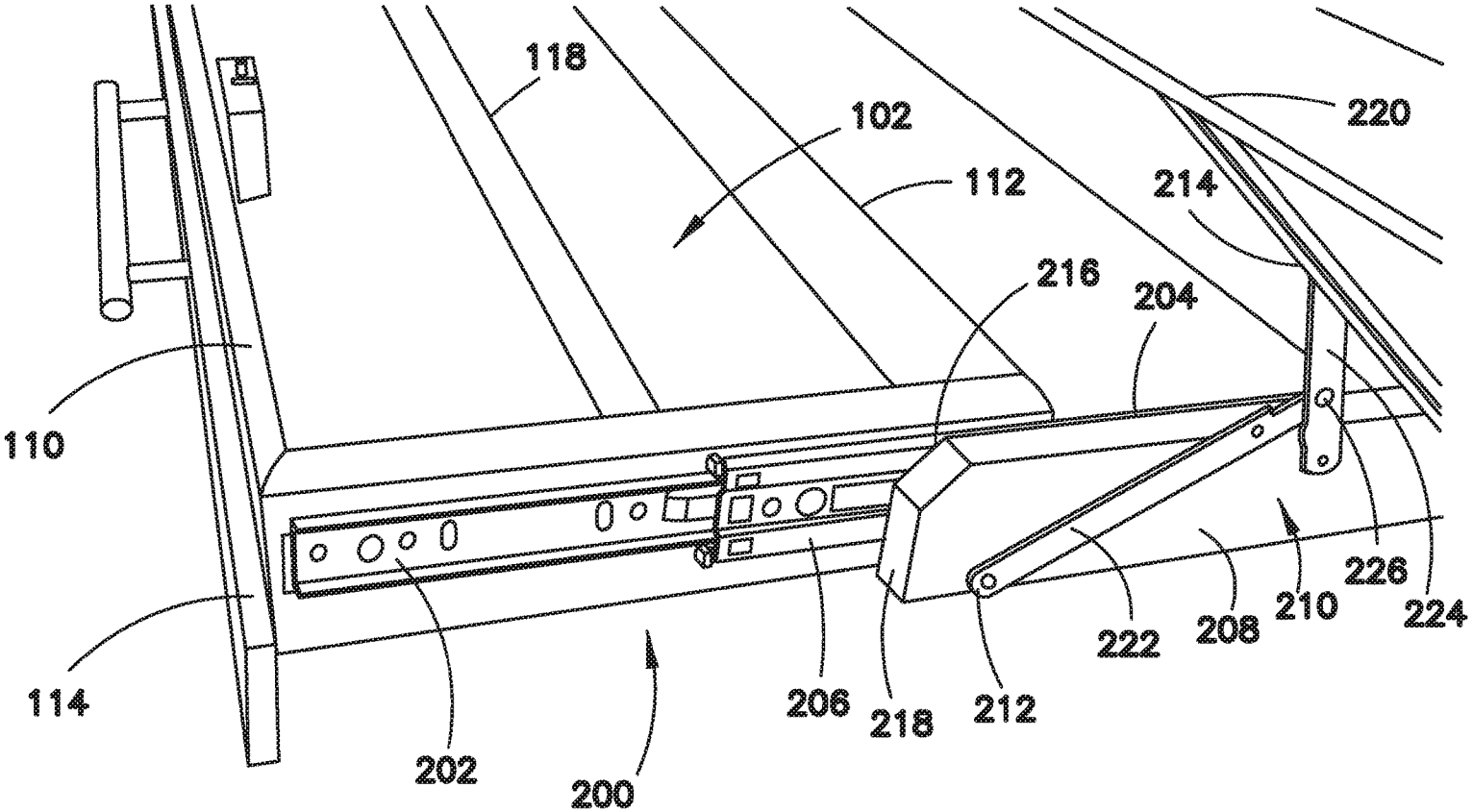
FIG. 4 shows a perspective view of an outer portion of a second side of a rack system in a relatively open configuration, according to an embodiment of the present disclosure.
Figure 5:
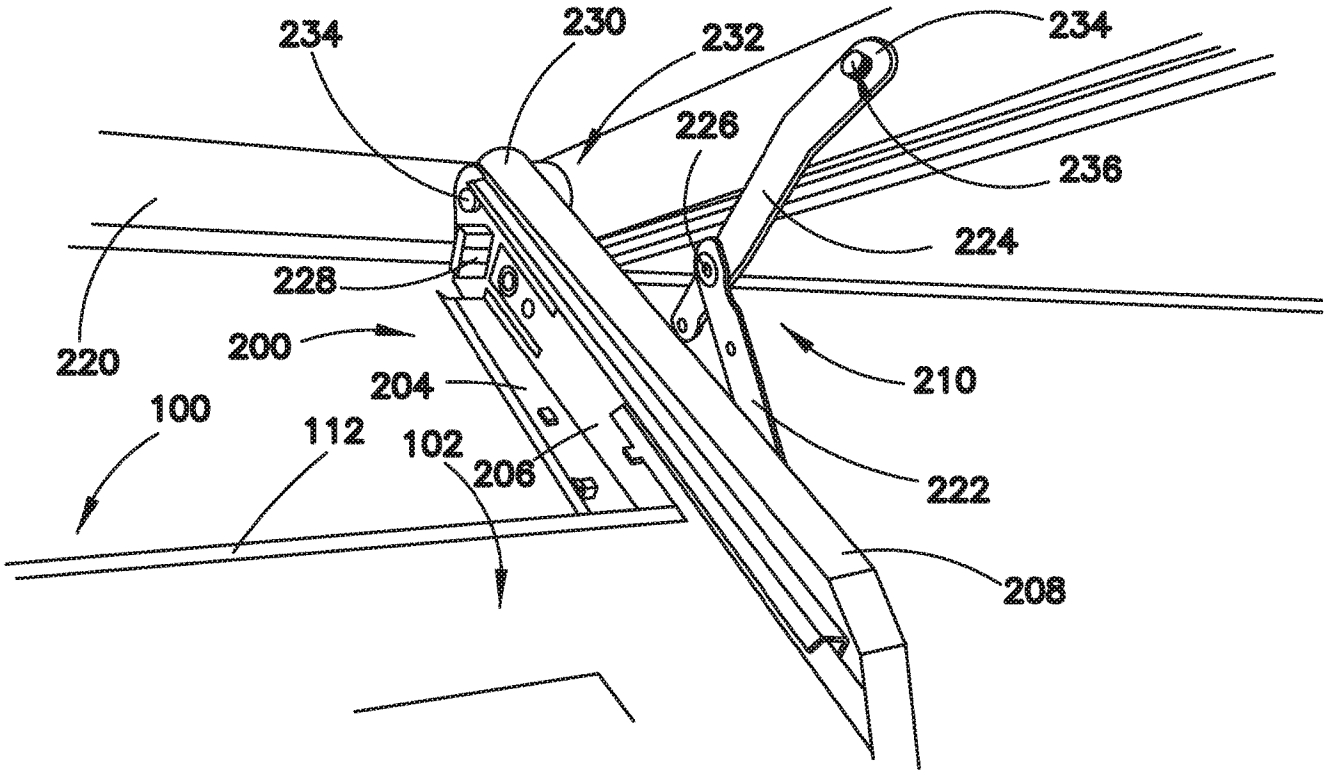
FIG. 5 shows a perspective view of an inner portion of a second side of a rack system in a relatively open configuration, according to an embodiment of the present disclosure.

FIG. 4 shows an embodiment of a glider mechanism 200 comprising a hinge mechanism 210 coupled to opposing second side 108 of tray 102. Glider mechanism 200, as shown in FIG. 4, may contain the same or similar components as the glider mechanism 200 coupled to the first side 106 of tray 102 shown in FIGS. 2 and 3. Similarly, FIG. 5 shows an inside perspective view of portions of a rack system 100 of the present disclosure, which may contain the same or similar components as shown in FIG. 3. FIGS. 1-5, as described herein, show exemplary embodiments of rack systems of the present disclosure in relatively open configurations.

Figure 6:
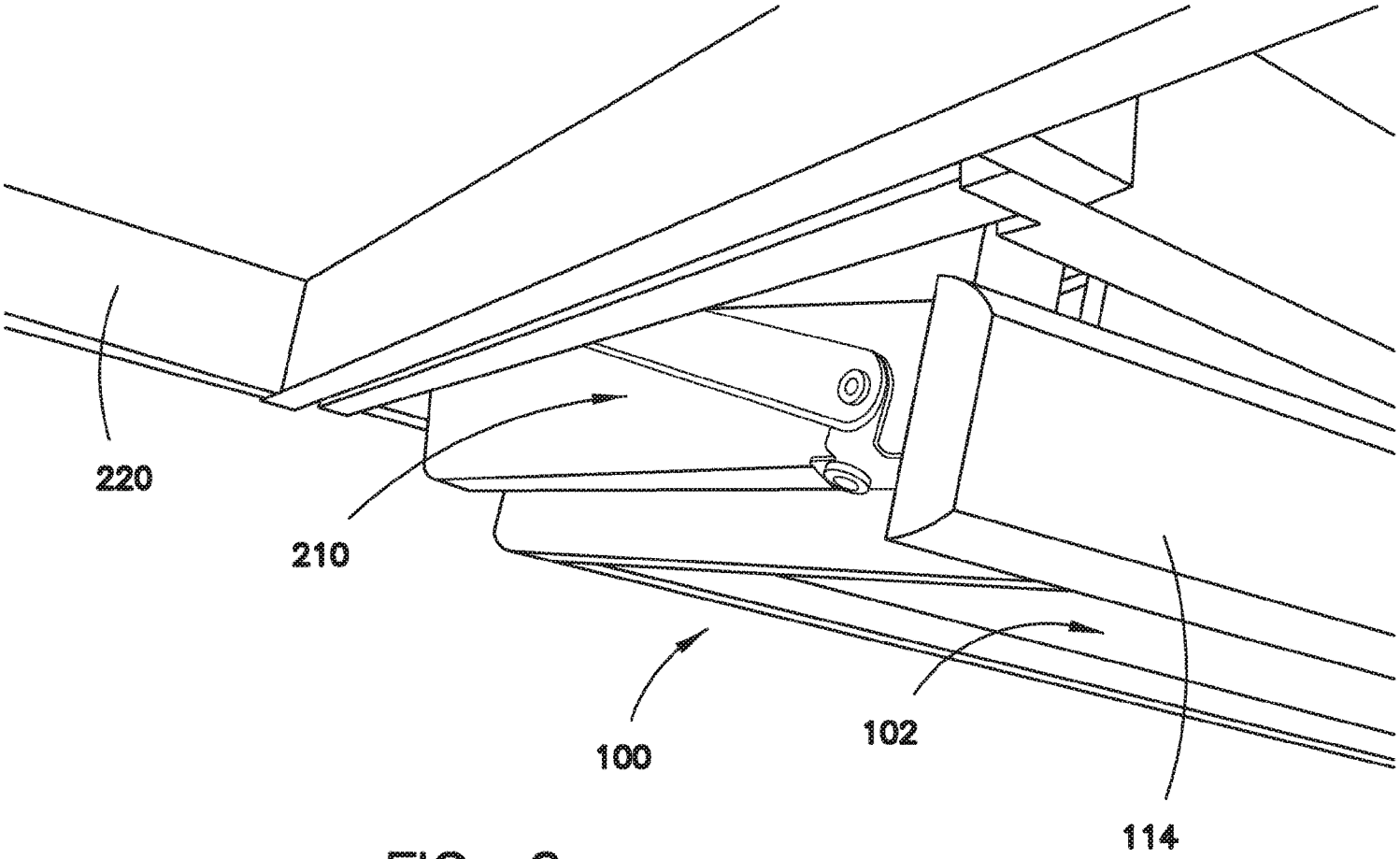
FIG. 6 shows a perspective view of an outer portion of a first side of a rack system in a relatively closed configuration, according to an embodiment of the present disclosure.
Figure 7:
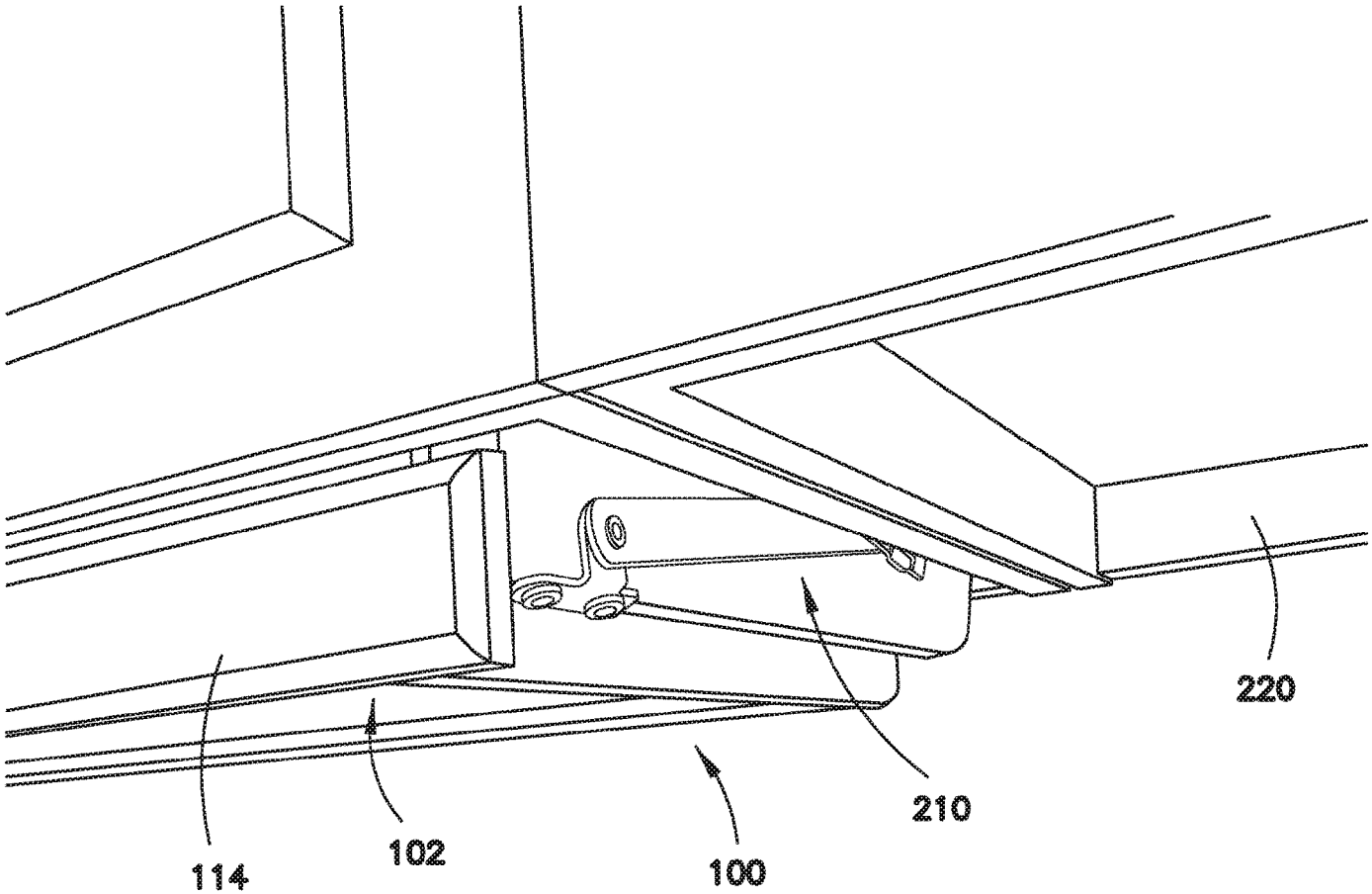
FIG. 7 shows a perspective view of an outer portion of a second side of a rack system in a relatively closed configuration, according to an embodiment of the present disclosure.
Figure 8:
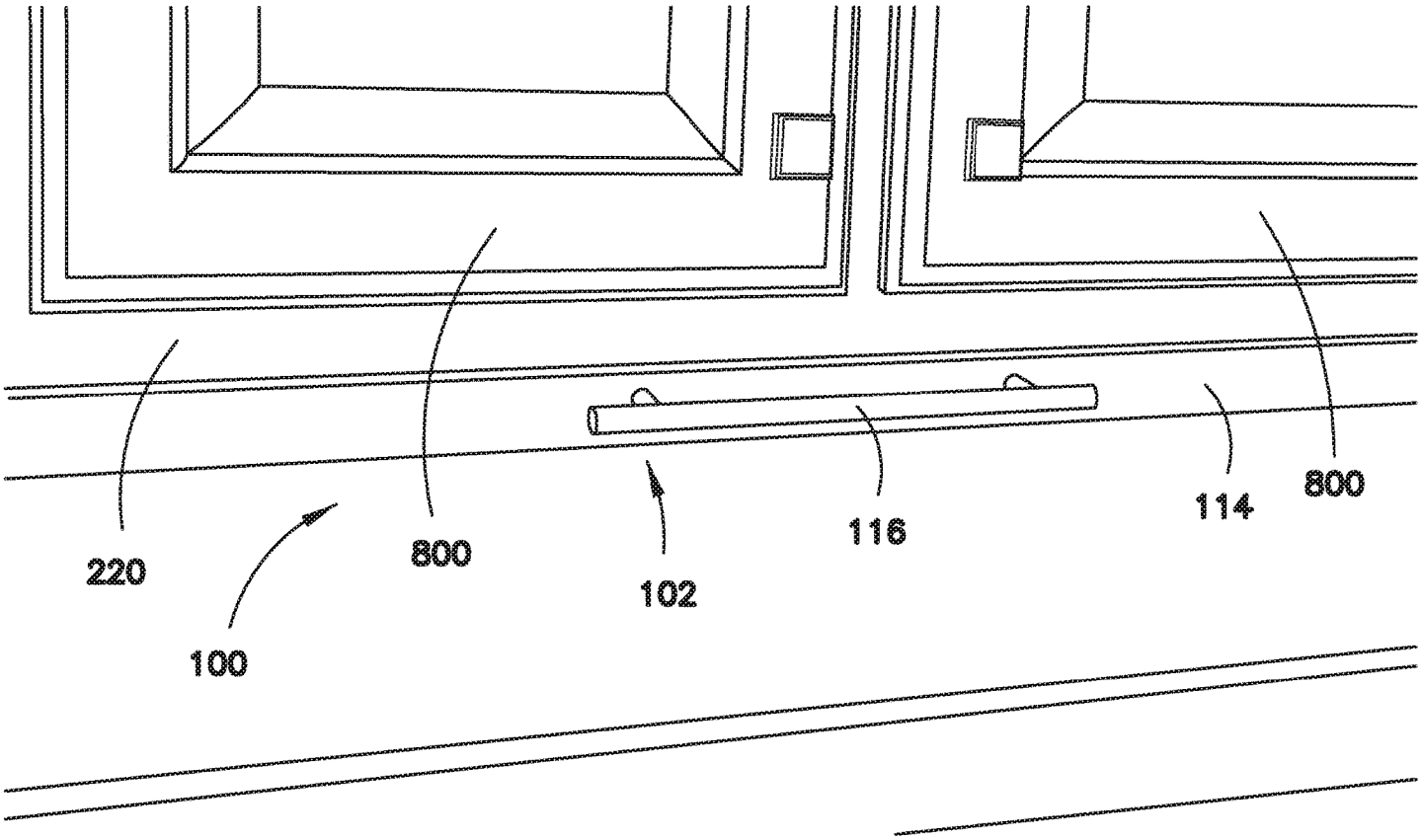
FIG. 8 shows a front perspective view of an outer portion of the front of a rack system in a relatively closed configuration, according to an embodiment of the present disclosure.

FIGS. 6 and 7 show opposing side views of a rack system 100 of the present disclosure in a relatively closed configuration. As shown in FIGS. 6 and 7, tray 102 is substantially or completely housed within a portion of an external structure 220, namely the bottom portion of a kitchen cabinet. FIG. 8 shows a front view of an exemplary rack system 100 of the present disclosure in a relatively closed configuration, whereby tray 102 is positioned underneath a kitchen wall cabinet (external structure 220). As shown in various figures herein, external structure 220 may comprise a kitchen wall cabinet having a recessed portion, so that spices, for example, positioned within tray 102 may be positioned underneath external structure 220 at least partially within the recessed portion of said cabinet. External structure 220, in at least one embodiment, may further comprise one or more doors 800 coupled thereto.

Figure 9:
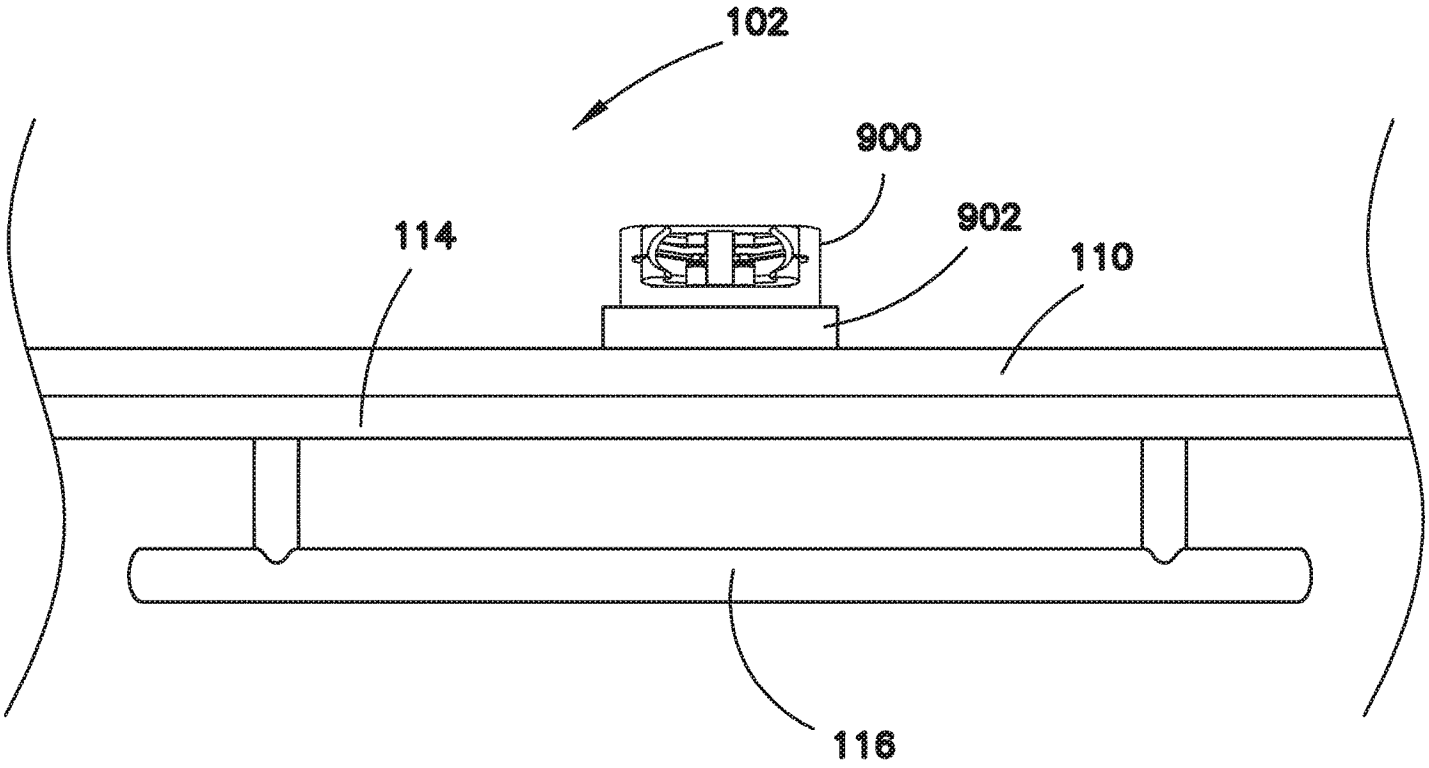
FIG. 9 shows a top view of the inside of a tray of a rack portion, according to an embodiment of the present disclosure.
Figure 10A:
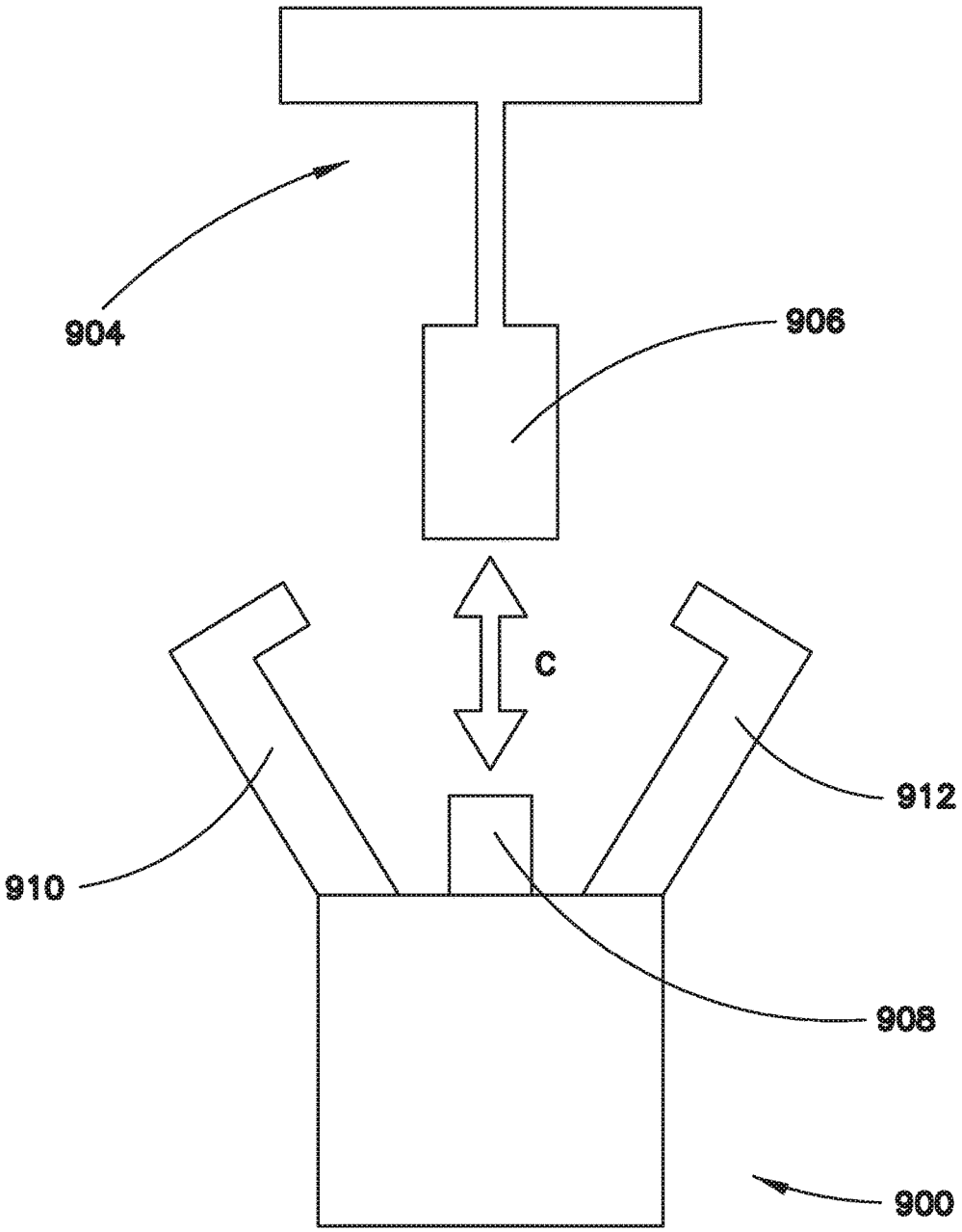
FIGS. 10A and 10B show side views of a latch mechanism and a latch member, according to an embodiment of the present disclosure.
Figure 10B:
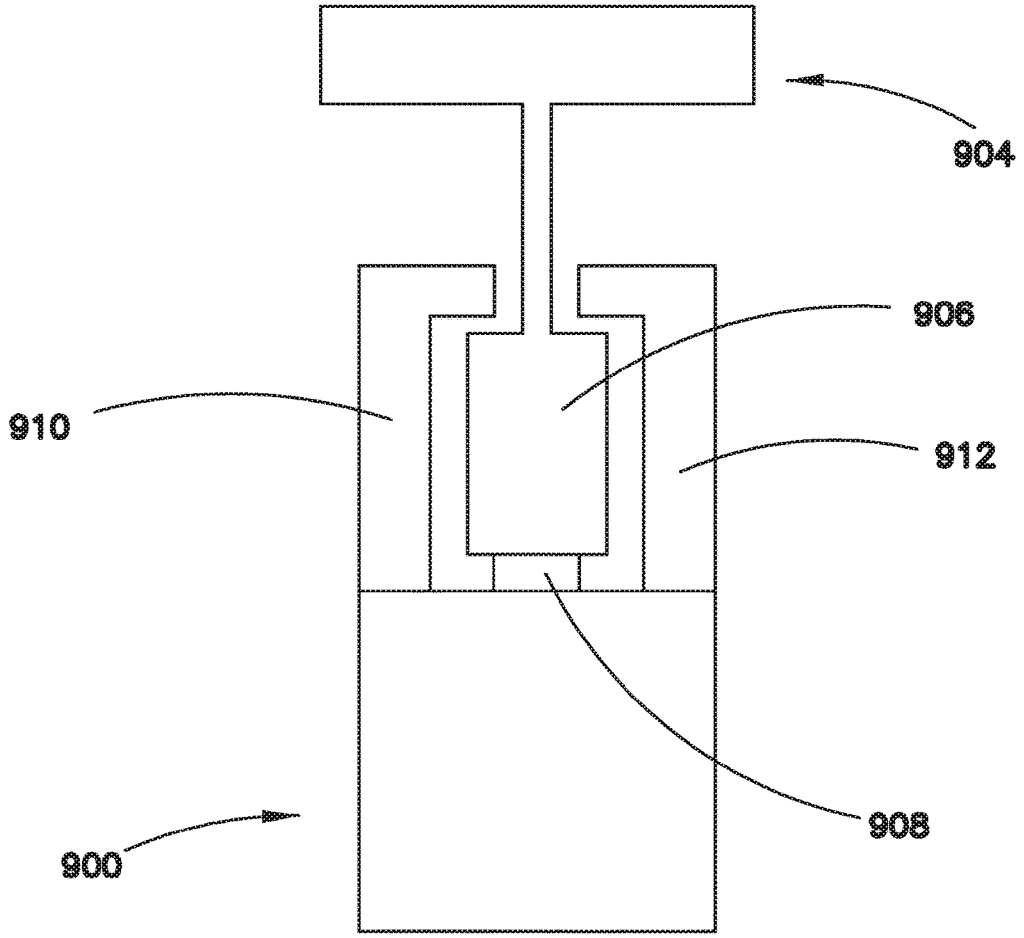

FIG. 9 shows an exemplary embodiment of a portion of a tray 102 of the present disclosure having an latch mechanism 900 coupled thereto. As shown in FIG. 9, latch mechanism 900 may be either directly coupled to tray 102, such as at the inside of front side 110, or may be indirectly coupled thereto by way of a spacer 902. Latch mechanism 900, as shown in FIG. 9, may be configured to engage a latch member 904 (as shown in FIGS. 10A and 10B) coupled to structure 220, so that when rack system 100 is in a relatively closed position, tray 102 is held in place by way of the engagement of latch mechanism 900 and latch member 904. Alternatively, latch mechanism 900 may be coupled to structure 220, and latch member 904 may be coupled to tray 102, in various embodiments.

As shown in FIG. 10A, an exemplary latch mechanism 900 can engage a latch member 904 by moving said components toward one another in a direction shown by bi-directional arrow C. In at least one embodiment, protrusion 906 of latch member 904 engages button 908 of latch mechanism 900, whereby engagement of button 908 causes arms 910, 912 of latch mechanism 900 to close about protrusion 906. Button 908 may click in place, similar to the engagement portion of a writing pen, whereby button 908 is pressed using protrusion 906 to an initial distance and releases back slightly in order to close latch mechanism 900 about latch member 904, as shown in FIG. 10B. To open latch mechanism 900, button 908 could be pressed again (using protrusion 906) to the initial distance, but then button 908 would release back to its original distance to open arms 910, 912 of latch mechanism 900 and release latch member 904 from latch mechanism 900.

The exemplary latch mechanism 900 shown in FIGS. 9, 10A, and 10B is but one exemplary latch mechanism 900 of the present disclosure, as any number of other latch mechanisms 900, utilizing magnets, snaps, and or other componentry sufficiently strong to hold a relatively heavy and filled tray 102 in place without tray 102 disengaging from structure 220 at or near latch mechanism 900, could be used with various embodiments of rack systems 100 of the present disclosure. In addition, and for example, latch mechanism 900 could comprise a spring-loaded indexing plunger, whereby engagement of the plunger could lock and/or release the same so that tray 102 (or another component of rack system 100) can move relative to an external structure 220, for example.

Various embodiments of rack systems 100 of the present disclosure are operable as follows. First, and when a rack system 100 is in a relatively closed position, a user can press the bottom of tray 102 upward to release tray from external structure 220, such as, for example, pressing the bottom of tray 102 upward so that protrusion 906 of latch member 904 engages button 908 so that arms 910, 912 of latch mechanism 900 open to release latch member 904 from latch mechanism 900. After such disengagement, tray 102 can then pivot downward to a relatively open configuration, such as shown in FIGS. 1-5. Tray 102 can then be pulled out (toward a user, for example), whereby glider mechanism 200 permits tray 102 to move toward the user (out and down), providing the user with ready access to the inside of tray 102 when glider mechanism is in a relatively open position. To close said tray 102, a user would then push tray 102 up and back (so that glider mechanism 200 is in a relatively closed position), and then the user would pivot tray 102 upward so that engagement of latch mechanism 900 can occur to effectively close rack system 100 and prevent tray 102 from pivoting downward.

Figure 11:
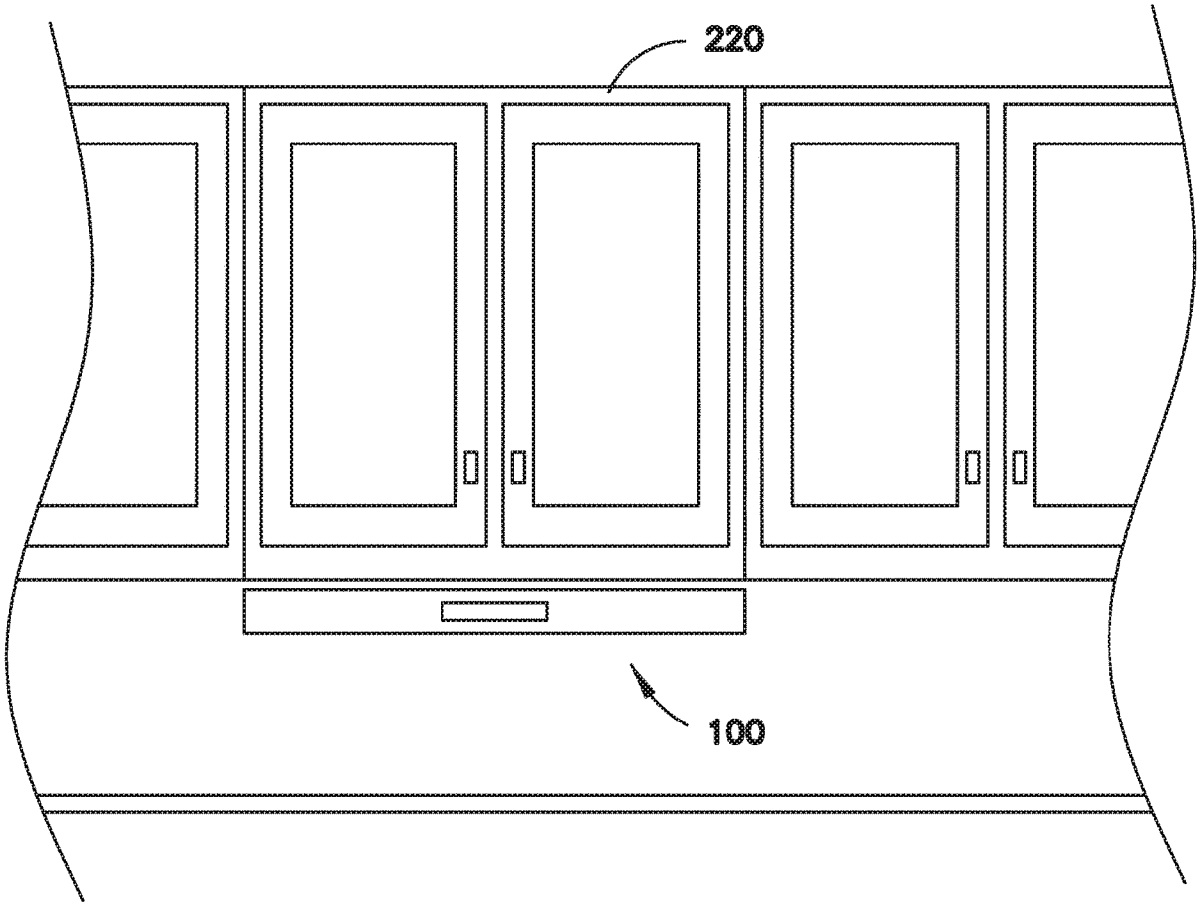
FIG. 11 shows a front view of a rack system coupled to a kitchen wall cabinet, according to an embodiment of the present disclosure.
Figure 12:
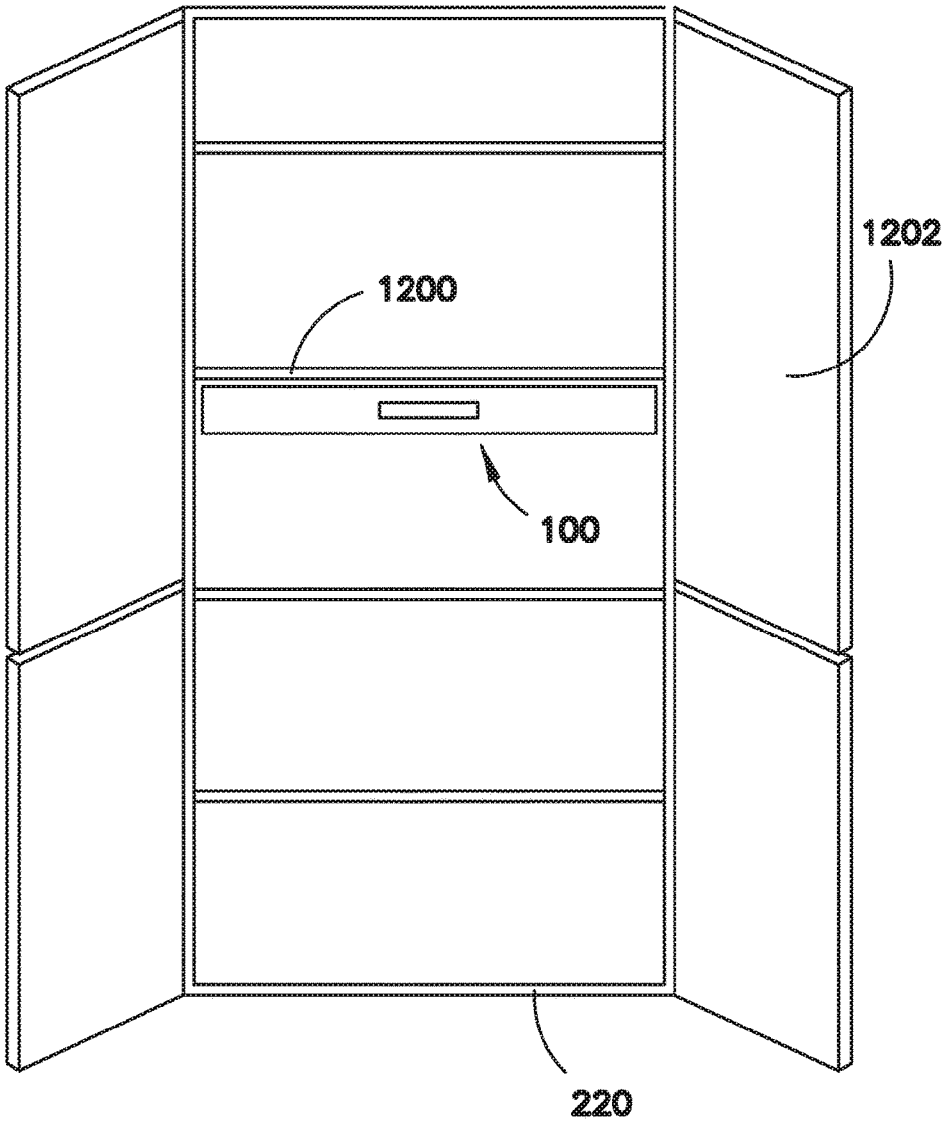
FIG. 12 shows a front view of a rack system coupled to a free-standing cabinet having doors, according to an embodiment of the present disclosure.

Furthermore, various rack systems 100 of the present disclosure can be used in connection with any number of structures 220, including, but not limited to, kitchen cabinets, office cabinets, walls, doors, countertops, and other structures suitable to support various rack systems 100 of the present disclosure. For example, and as shown in FIG. 11, an exemplary rack system 100 may be placed under a wall kitchen cabinet (an exemplary external structure 220). In another embodiment, and as shown in FIG. 12, an exemplary rack system 100 may be placed within a free-standing cabinet (another exemplary external structure 220) underneath a shelf 1200 of said cabinet, whereby rack system 100 can also be enclosed within said external structure 220 using one or more doors 1202.

Figure 13:
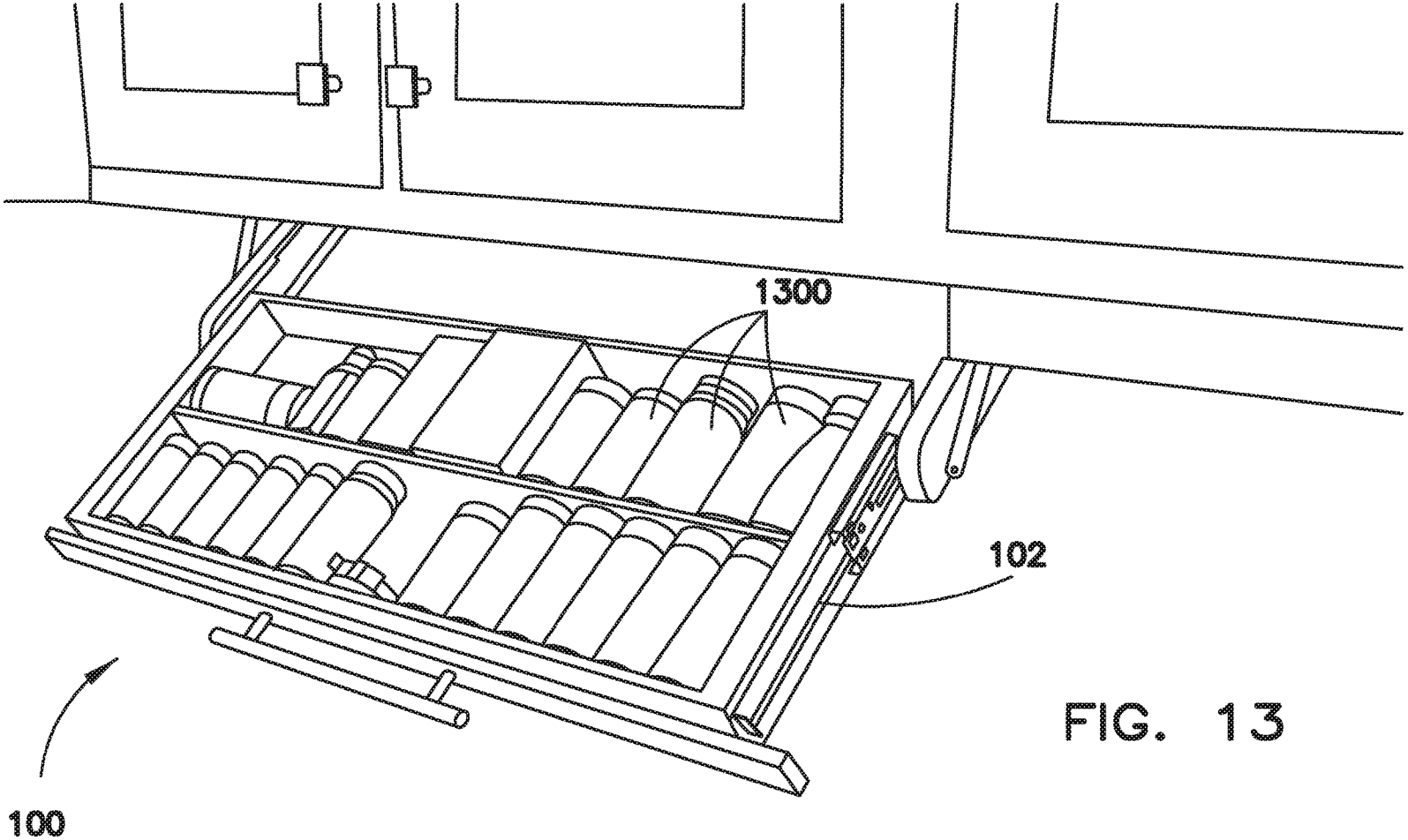
FIG. 13 shows a perspective view of a tray of a rack system in a relatively open configuration retaining a plurality of spices, according to an embodiment of the present disclosure.

FIG. 13 shows an exemplary embodiment of a rack system 100 of the present disclosure used as a spice rack. As shown in FIG. 13, rack system 100 comprises a tray 102 sized and shaped to retain a plurality of spice containers 1300.

In addition to the foregoing, and in various embodiments of rack systems 100 of the present disclosure, said rack systems 100 may comprise one or more automated components. For example, and as shown in the block diagram of FIG. 14, an exemplary tray 102 of a rack system 100 may have one or more glider actuators directly or indirectly coupled thereto, such as a first glider actuator 1400 and a second glider actuator 1402, whereby said actuator(s) facilitate automatic glide movement of tray 102.

Figure 14:
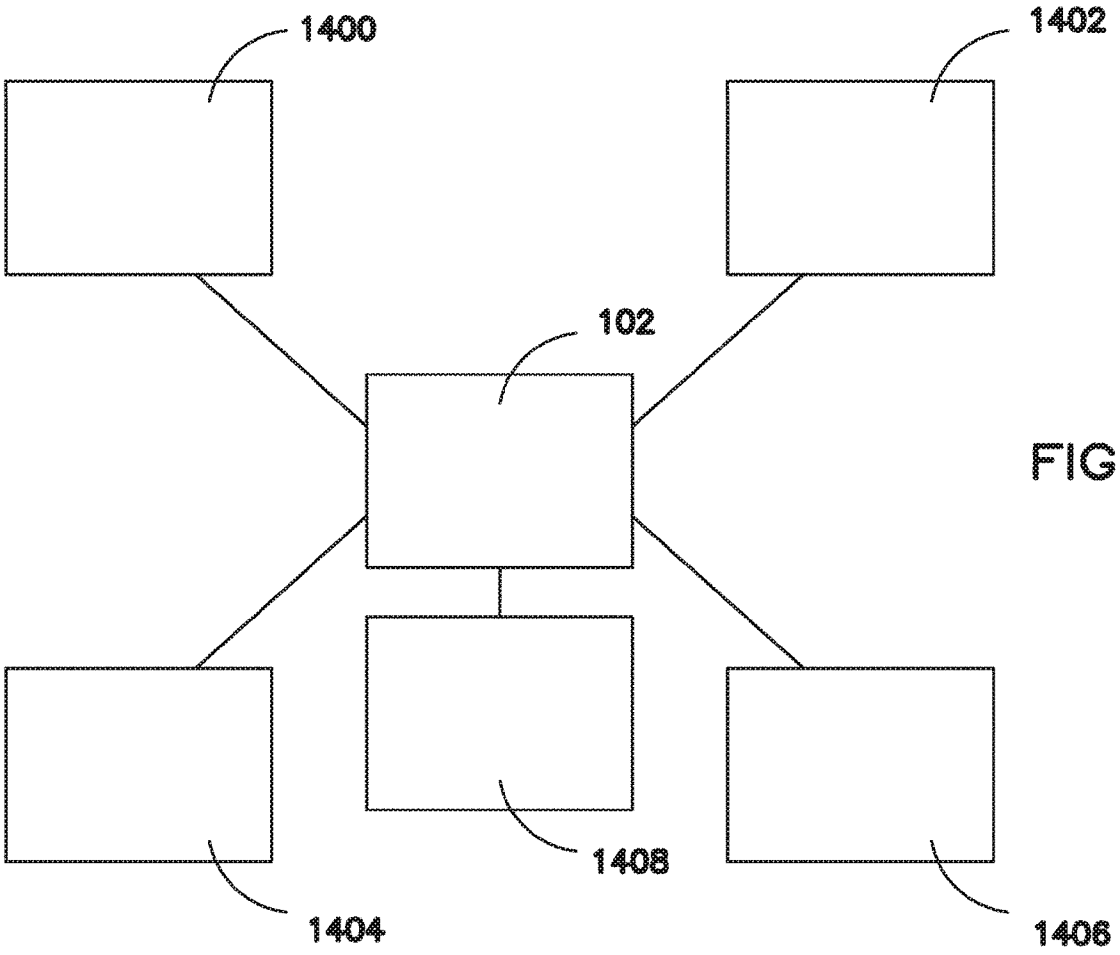
FIG. 14 shows a block diagram of various components of a rack system, according to an embodiment of the present disclosure.

In at least one embodiment, rack system 100 comprises a first glider actuator 1400 coupled either directly or indirectly to tray 102, whereby first glider actuator 1400 is operable to move tray 102 back and forth as described herein. In addition, and as shown in FIG. 14, an exemplar rack system 100 of the present disclosure may have one or more hinge actuators directly or indirectly coupled thereto, such as a first hinge actuator 1404 and/or a second hinge actuator 1406, whereby said actuator(s) facilitate automatic hinge movement of tray 102. In at least one embodiment, rack system 100 comprises a first hinge actuator 1404 coupled either directly or indirectly to tray 102, whereby first hinge actuator 1404 is operable to hingedly move tray 102 up and down as described herein. In various embodiments, first glider actuator 1400, second glider actuator 1402, first hinge actuator 1404, and/or second hinge actuator 1406 are coupled to one or more power sources (such as an electrical outlet and/or a battery, not shown) to facilitate operation thereof. Glider actuators 1400, 1402 and hinge actuators 1404, 1406 may be any means of enabling the applicable automated movement of tray 102, including, but not limited to, stepper motors, servo motors, spring-loaded gas springs, or the like.

Figure 15:
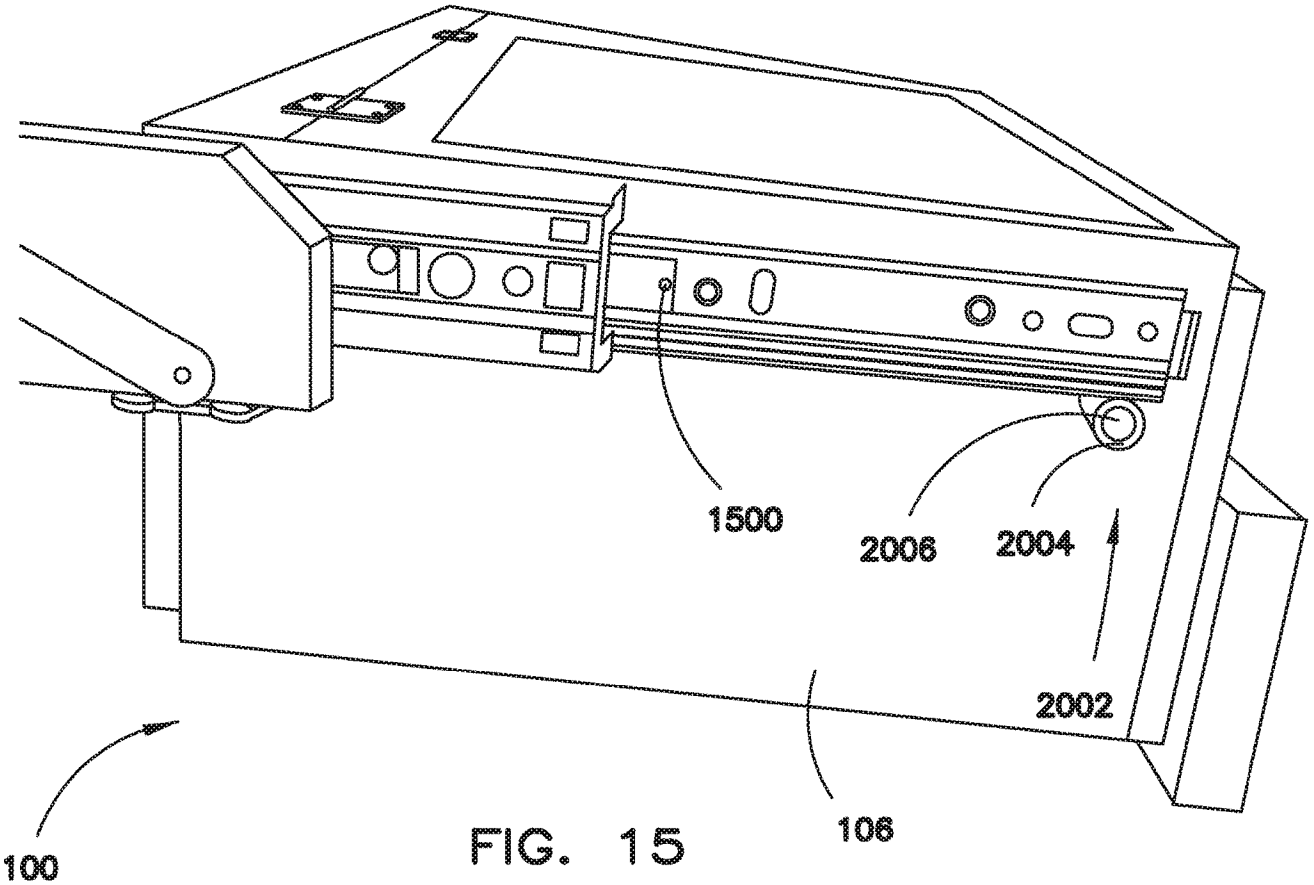
FIGS. 15 and 16 show opposing side views of a rack system, according to at least one embodiment of the present disclosure.

An exemplary side view of at least a portion of an exemplary embodiment of a rack system 100 of the present disclosure is shown in FIG. 15. As shown in FIG. 15, rack system 100 comprises a tray 102 (with first side 106 shown in the figure) having a rotation mechanism 1500 coupled thereto. Rotation mechanisms 1500, in various embodiments, are capable of being coupled to tray 102 and one or more other components of rack system 100 (such as portions of a glider mechanism 200, for example, or a glider spacer 2000 as referenced in further detail herein), so that tray 102 is operable to rotate or capable of rotation about rotation mechanism 1500. Rotation mechanisms 1500 may include, but are not limited to, lazy-Susan bearings, swivel bearings, wheel bearings, simple axles, or the like.

Figure 16:
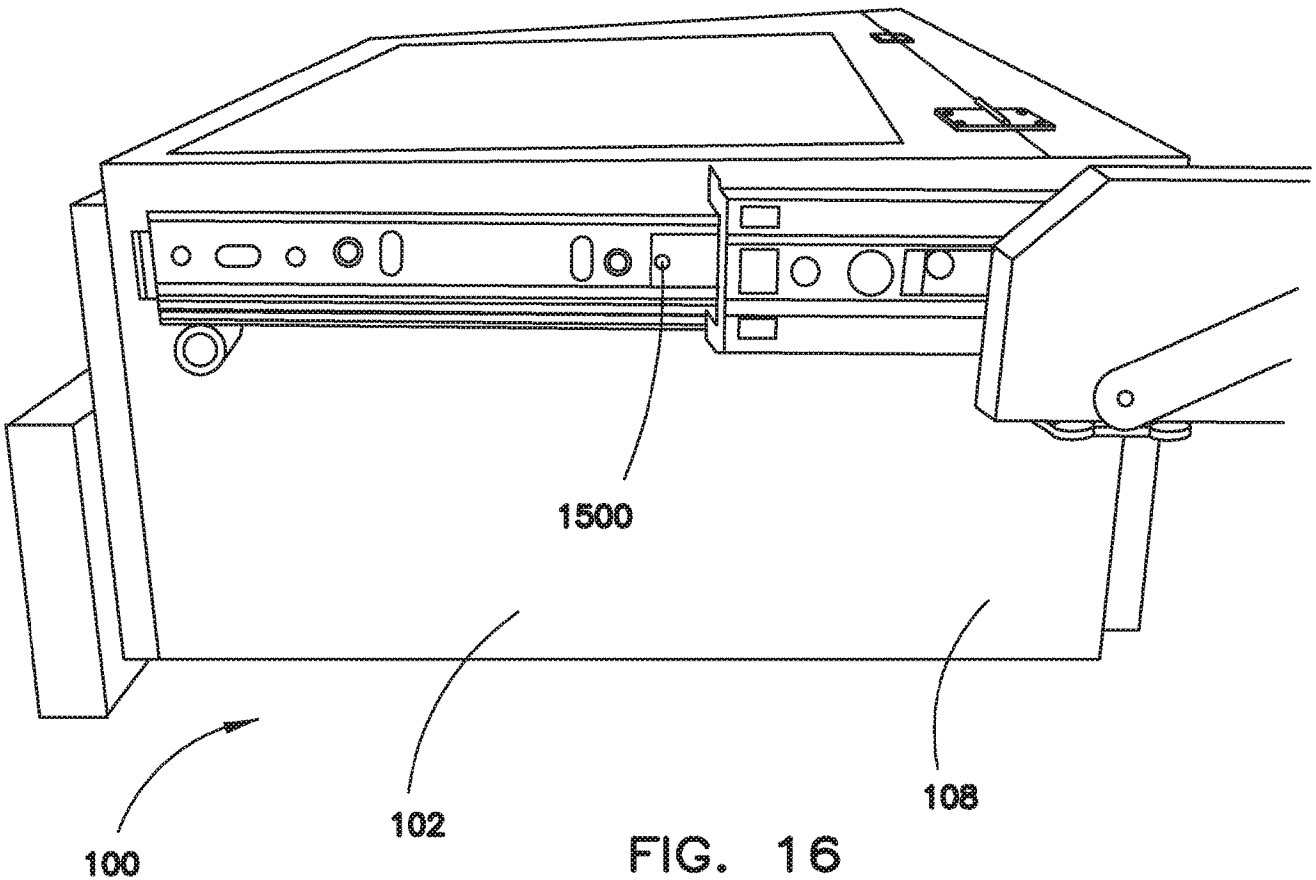

FIG. 16 shows an exemplary side view of at least another portion of a rack system 100 of the present disclosure. As shown in FIG. 16, tray 102 (with second side 108 shown in the figure) has a rotation mechanism 1500 coupled thereto. As referenced herein, such an embodiment of a rack system 100 may comprise a "first rotation mechanism" and a "second rotation mechanism," each referring to a rotation mechanism 1500. As shown in FIGS. 15 and 16, rotation mechanisms 1500 may be positioned at or near relative middles of first side 106 or second side 108, as applicable, to facilitate rotation of tray 102 as described in further detail herein.

Figure 17:
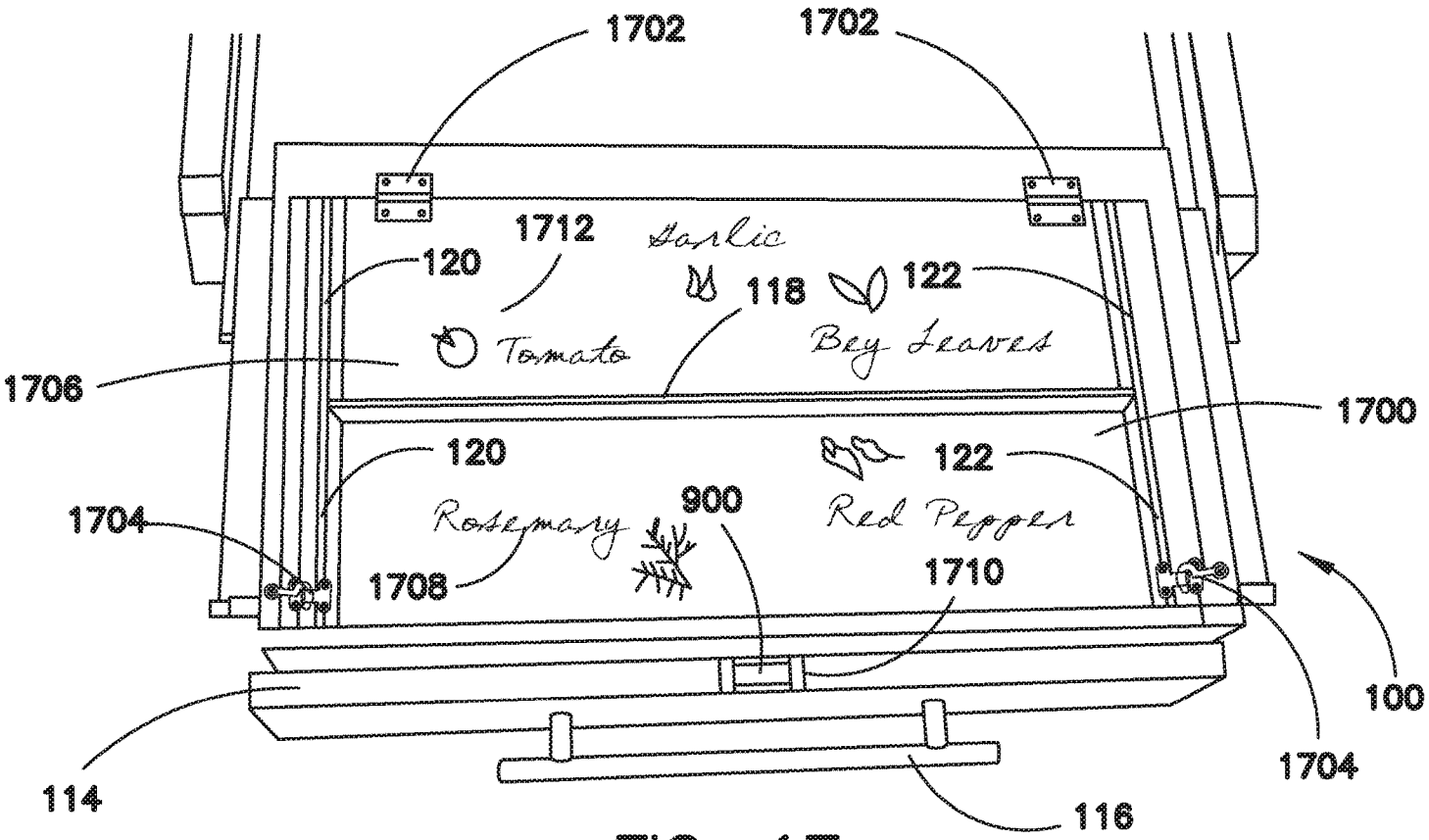
FIG. 17 shows a top perspective view of a rack system in a first access configuration, according to an embodiment of the present disclosure.

FIG. 17 shows a top perspective view of an exemplary embodiment of a rack system 100 of the present disclosure. As shown in FIG. 17, rack system 100 has a first access configuration, which corresponds to a native or a non-rotated configuration of tray 102. In operation, tray 102 could be engaged by a user and pressed so that a latch mechanism 900 disengages a latch member 904, for example, so that tray 100 is allowed to pivot downward by way of a hinge mechanism 210. Tray 102 can then be pulled toward a user by way of a glider mechanism 200, resulting in a positioning of tray 102 as shown in FIG. 17. Such a procedure does not involve rotation of tray 102 about a rotation mechanism 1500, and such positioning may be referred to herein as a first access configuration, whereby the relative top of tray 102 is revealed.

As shown in FIG. 17, an exemplary rack system 100 of the present disclosure may comprise a first tray cover 1700 coupled to tray 102. Tray cover 1700, as shown in FIG. 17, may be made of Plexiglass, but in various other embodiments, tray cover 1700 may comprise a number of other materials, including, but not limited to, wood, metal, plastic, and glass.

Tray cover 1700, as shown in FIG. 17, may be hingedly coupled to tray 102 by way of one or more cover hinges 1702. In other embodiments, tray cover 1700 may be coupled to (or otherwise engage) tray 1700 by other means, including, but not limited to, various hooks, clasps, and/or pockets in various components of rack system 100.

Figure 18:
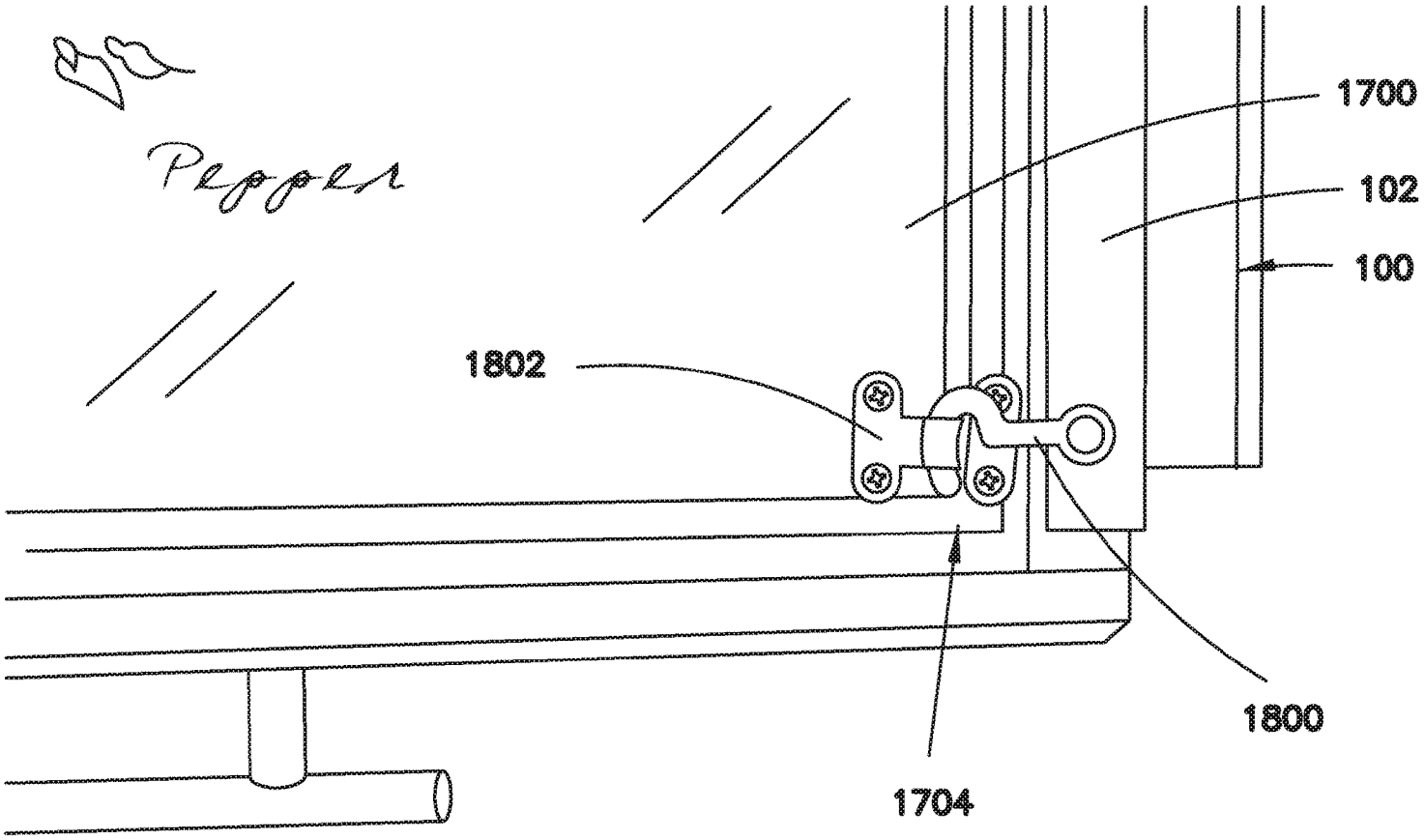
FIG. 18 shows an exemplary latch mechanism of a rack system, according to an embodiment of the present disclosure.

Tray cover 1700 may be held in a closed position about tray 102 by way of one or more closure mechanisms 1704, as shown in FIGS. 17 and 18. As shown in FIG. 18, closure mechanism 1704 may comprise a hook 1800 and a receiver 1802 configured to receive at least part of hook 1800. Hook 1800, in various embodiments, may be coupled to tray 102, and receiver 1802 may be coupled to tray cover 1700, and in various other embodiments, said hook 1800 and receiver 1802 may be coupled tray cover 1700 and tray 102, respectively. Closure mechanisms 1704 of the present disclosure are not intended to be limited only to hook 1800 and receiver 1802 embodiments, as various other closure mechanisms 1704 capable of securing a cover/lid (such as a tray cover 1700) to a receptacle (such as a tray 102) may be within the scope of closure mechanisms 1704 as referenced herein. As referenced above, hinges 1702 may facilitate the opening and closing of tray cover 1700, and closure mechanisms 1704 may be used to secure tray cover 1700 in a closed position.

Figure 19:
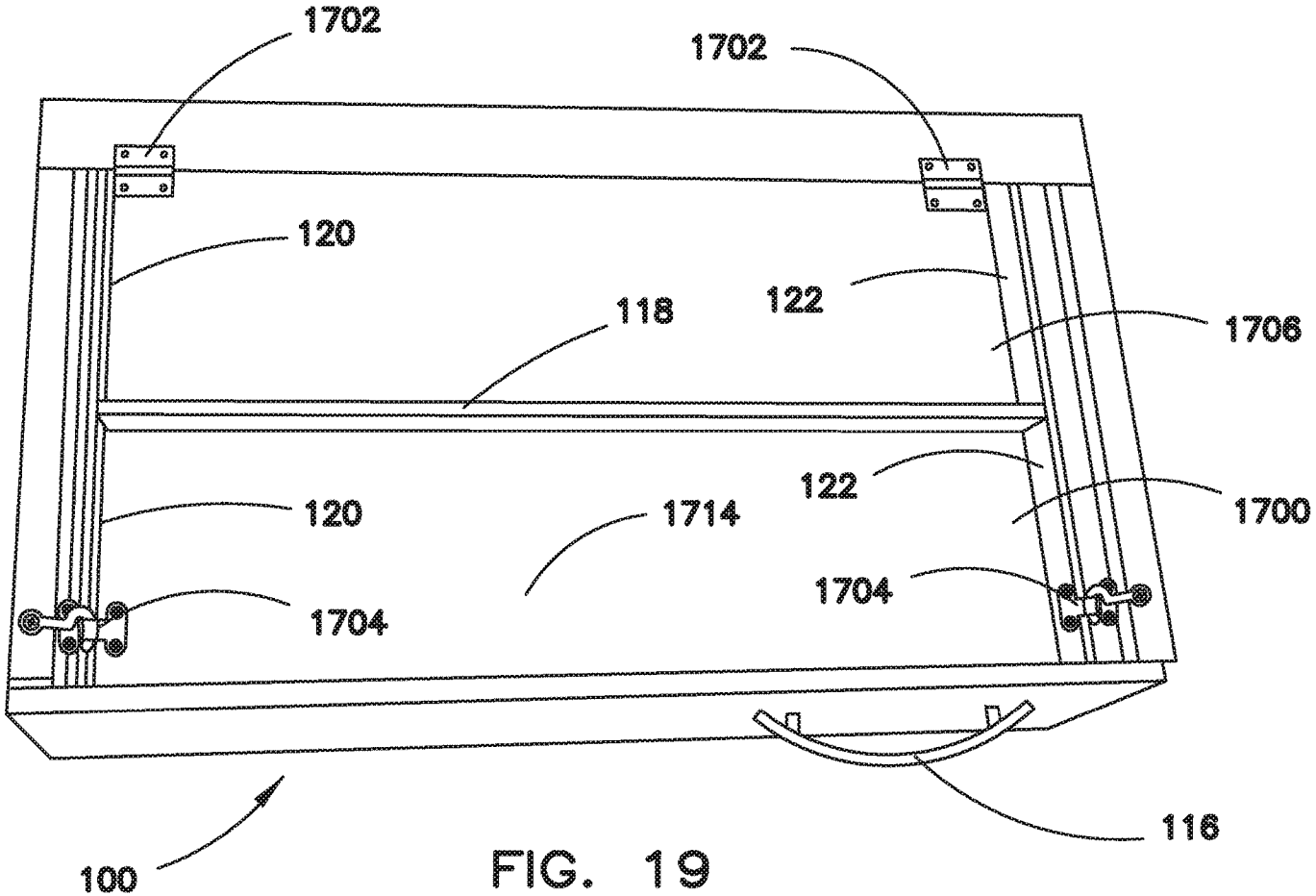
FIG. 19 shows a top perspective view of a rack system in a second access configuration; according to an embodiment of the present disclosure.

FIG. 19 shows a top perspective view of an exemplary embodiment of a rack system 100 of the present disclosure.

As shown in FIG. 19, rack system 100 has a second access configuration, which corresponds to a rotated configuration of tray 102. For example, and in various embodiments of rack systems 100 of the present disclosure, a tray 102 of a rack system 100 could be extended to a first access configuration (as shown in FIG. 17 and described herein), and then subsequently rotated by way of rotation mechanism(s) 1500 to reveal the relative bottom of tray 102, effectively positioning rack system 100 in a second access configuration.

The relative bottom of tray 102, similar to the relative top of tray 102, may comprise a tray cover 1700 coupled to tray 102 by way of hinges 1702 and a closure mechanism 1704, as shown in FIG. 19 and described herein with respect to other embodiments and/or views of rack systems 100 of the present disclosure. Closure mechanisms 1704, in various embodiments, are used to keep tray covers 1700 closed such that any contents of tray 102 (such as spice containers 1300 if used as a spice rack, documents if used for document storage, books if used to store books or provide a platform to hold one or more books, etc.) will not fall out of tray 102 when tray is rotated about rotation mechanism(s) 1500.

In at least one embodiment of a rack system 100 of the present disclosure, rack system 100 can be used to contain two rows of spice containers 1300 on both the relative top 1712 and bottom 1714 of tray 102. For example, and as shown in FIGS. 17 and 19, rack system 100 comprises a base panel 1706 (somewhat similar to a bottom 104 of a tray 102 as otherwise described herein), which can serve as a base to receive one or more items. Tray 102 may then include one or more optional dividers 118, which, in various embodiments, could be held in place with optional divider braces 120, 122. Divider(s) 118, in various embodiments, could separate tray 102 into two or more rows, each of which could be used to hold a variety of items, such as spices (spice containers) or other items as may fit within said tray 102. Divider(s) 118 may be positioned relative to base panel 1706 at a first side 1712 of base panel 1706, as shown in FIG. 17, and/or relative to base panel 1706 at a second side 1714 of base panel 1706, as shown in FIG. 19.

Tray cover(s) 1700, in various embodiments, could comprise various indicia. As shown in FIG. 17, tray cover 1700 comprises indicia 1708 in the form of hand-painted words and images. In various other embodiments, indicia 1708 may comprise other words, other images, numbers, various labels/stickers, carvings, drawings, indentions/depressions, openings, etc., which may be used to indicate contents of tray 102, potential contents of tray 102, or merely as decoration, for example.

In at least one embodiment according to the present disclosure, rotation of tray 102 performed to move tray 102 from a first access configuration (as shown in FIG. 17) to a second access configuration (as shown in FIG. 19), may be performed by engaging various parts of rack system 100, including, but not limited to, the top edge of the front side 110 or other areas of tray 102, hardware 116 present upon (or engaging) the front side 110 of tray 102 (as shown in FIG. 17), hardware 116 present upon (or engaging) the back side 112 of tray 102 (as shown in FIG. 19), hardware 116 present upon (or engaging) other areas of tray 102 (or other components of rack system 100), pockets/apertures formed in various portions of rack system 100, or by merely engaging, pushing, or pulling portions of rack system 100 in various directions. For example, and as shown in the perspective view of various components of an exemplary rack system 100 as shown in FIG. 20, a user may engage hardware 116 present upon (or engaging) the back side 112 of tray 102 and push or pull hardware 116 to facilitate rotation of tray 102.

In addition to hardware 116, or as an alternative to hardware 116, rotation of tray may be facilitated by a rotation actuator 1408 coupled to tray 102 as shown in FIG. 14. Rotation actuator 1408, in various embodiments, may be coupled to tray 102 or other components of rack system 100, and may facilitate automated rotation of tray 102 in addition to, or in lieu of, manual rotation. Rotation actuator 1408 may be any means of enabling automated rotation of tray 102, including, but not limited to, stepper motors, servo motors, or the like.

Figure 20:
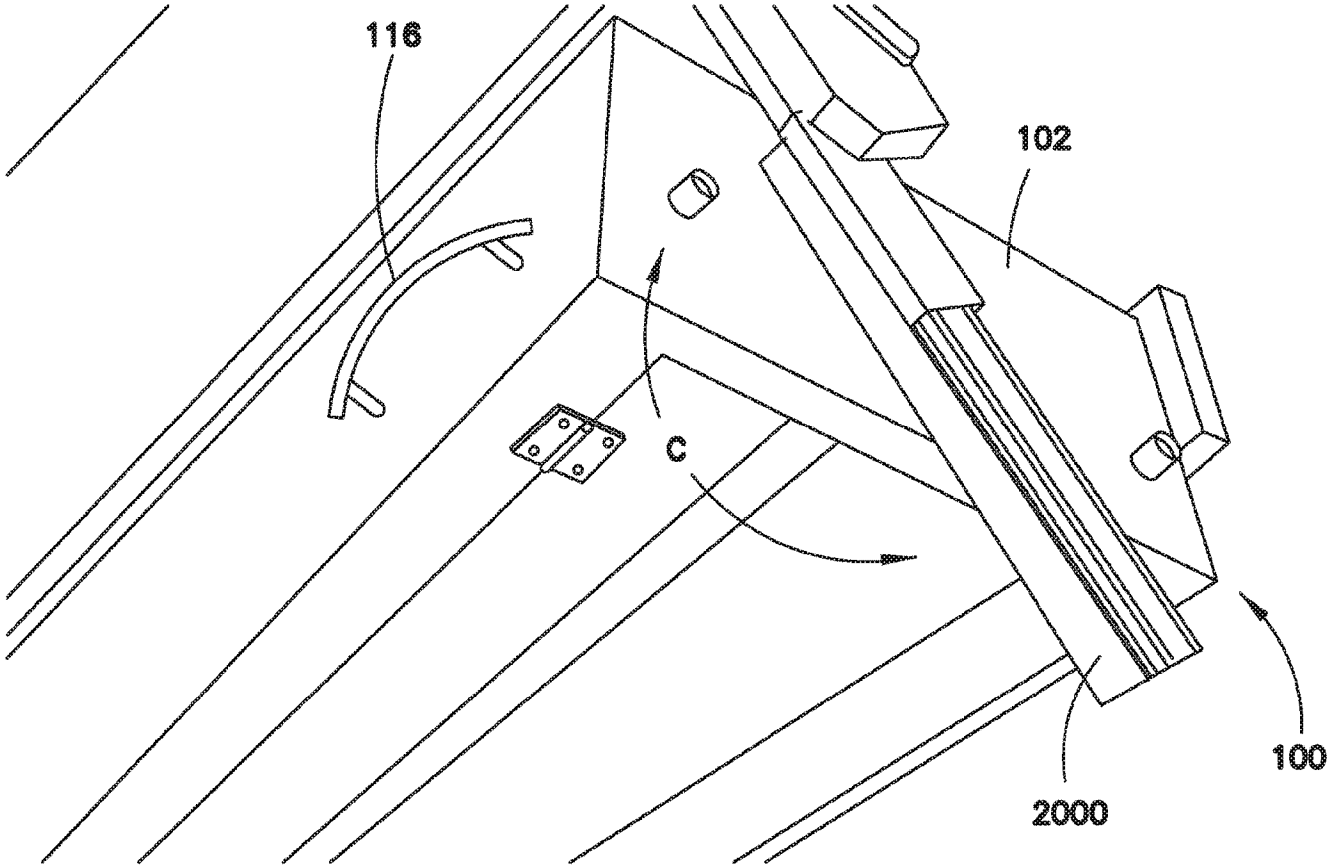
FIG. 20 shows a perspective view of a tray being rotated about a rotation mechanism, according to an embodiment of the present disclosure.

In the view of rack system 100 shown in FIG. 20, rotation mechanism 1500 is not visible because it is positioned beneath a glider spacer 2000. Glider spacer 2000, as shown in FIG. 20, may be used to facilitate operative connection of tray 102 to glider mechanism 200, and in such an embodiment, rotation mechanism 1500 would directly engage glider spacer 2000, be positioned within an aperture defined within glider spacer 2000, or otherwise engage glider mechanism 200 by way of (or through) glider spacer 2000. Glider spacer 2000, in various embodiments, would be sized and shaped so that various portions of rack system 100 would couple to and/or engage one another as intended so that tray 102 may rotate in embodiments of rack systems 100 comprising a rotatable tray 102.

Various embodiments of rack systems 100 of the present disclosure may comprise a latch mechanism 900 coupled to tray 102, as described herein and as shown in FIG. 9, for example. However, in at least one additional embodiment and as shown in FIG. 17, latch mechanism 900 may be coupled to tray 102 within a tray pocket 1710. Tray pocket 1710 may itself be a recessed portion defined within the front side 110 of tray 102, or, as shown in FIG. 17, defined within a cover plate 114 coupled to the front side 110 of tray 102. Positioning latch mechanism 900 (or a corresponding latch member 904, in various embodiments) within tray pocket 1710, or within at least a part of tray pocket 1710, could not only improve the overall aesthetics of rack system 100, but could itself not get in the way of, or hinder placement of, any contents within tray 102.

In addition, and as shown in FIGS. 15, 16, and 20, for example, exemplary rack systems 100 of the present disclosure could comprise one or more tray stops 2002 coupled thereto. Tray stops 2002, as shown in FIG. 15 for example, may comprise a stop body 2004 secured to tray 102 by way of a stop fastener 2006, such as a screw or other securing device. Stops 2002, in various embodiments of rack systems 100 of the present disclosure, would be positioned about tray 102 (or other portions of rack system 100) so that rotation of tray 102 would eventually stop to provide a user with a more stable platform to hold various items, and so that tray 102 would not unintentionally or undesirably rotate.

Figure 21A:
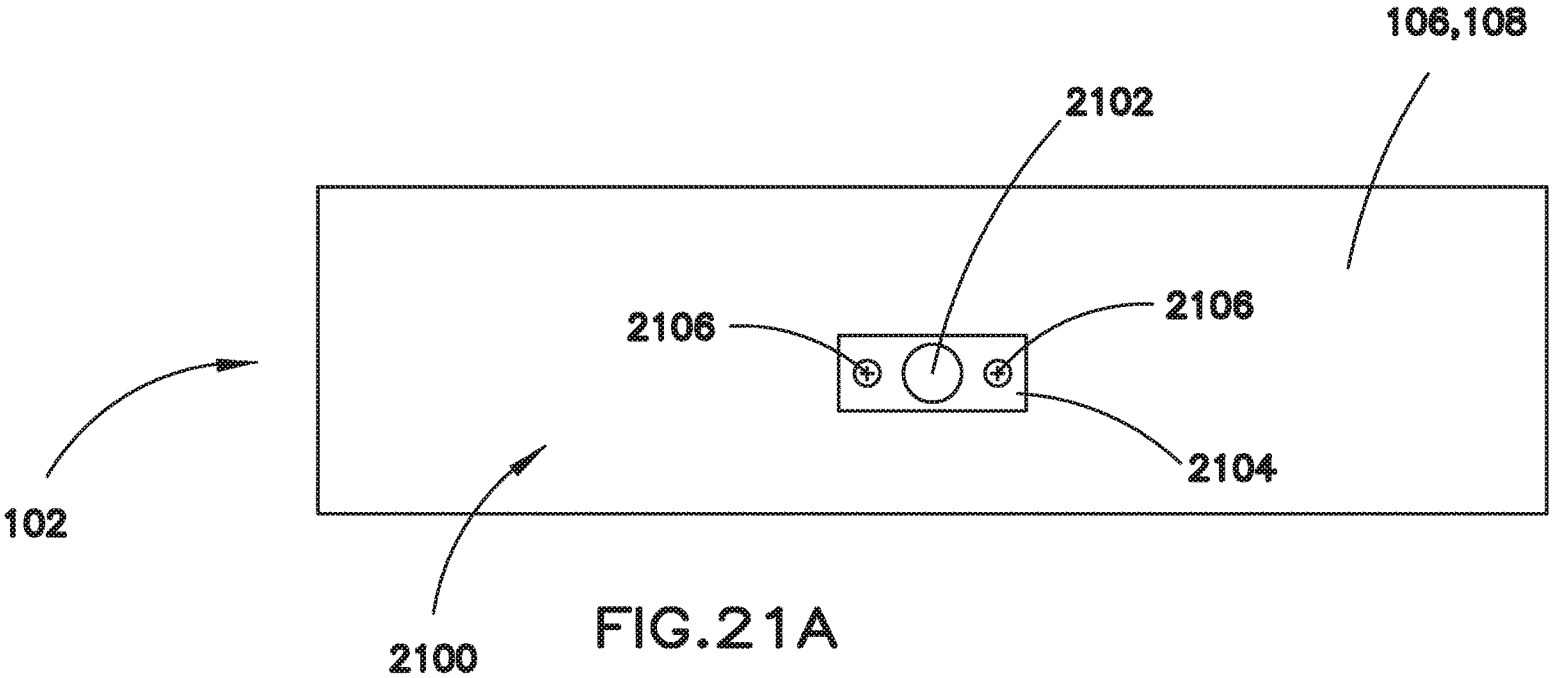
FIG. 21A shows a side view of a portion of a tray having a lock mechanism coupled thereto, according to an embodiment of the present disclosure.
Figure 21B:
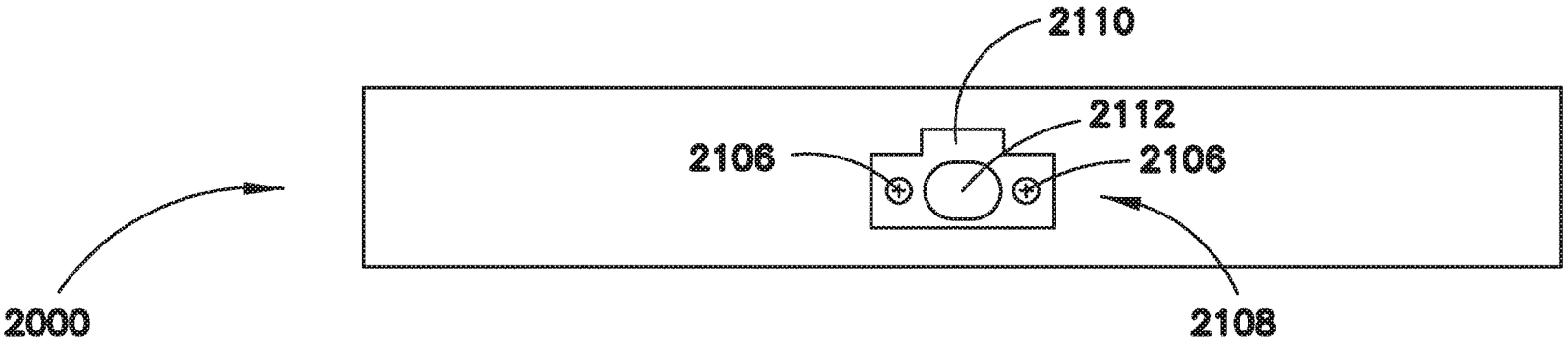
FIGS. 21B and 21C show side views of a component of a rack system having various lock receivers coupled thereto or defined therein, according to an embodiment of the present disclosure.
Figure 21C:
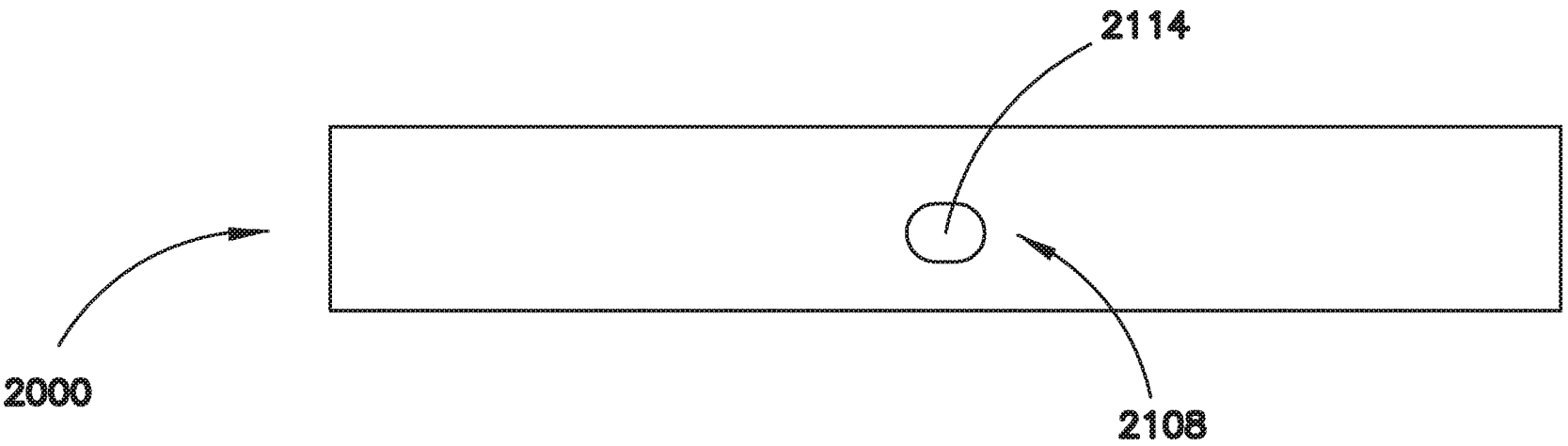

Various embodiments of rack systems 100 may further comprise a lock mechanism as shown in FIG. 21A-21C. As shown in FIG. 21, a first side 106 and/or second side 108 of tray 102 may comprise a lock mechanism 2100 operable to lock or secure tray 102 in place upon rotation so that tray 102 does not move when a user of rack system 100 does not desire tray to rotate. Lock mechanism 2100, in at least one embodiment and as shown in FIG. 21A, may comprise a spring-loaded ball 2102 held in place by mechanism faceplate 2104. In various embodiments, mechanism faceplate 2104 may be secured to tray 102 using fasteners 2106, such as screws or nails. In such an embodiment, spring-loaded ball 2102 would be at least partially recessed in tray 102, and could engage a lock receiver 2108, which in at least one embodiment would comprise receiver plate 2110 having an aperture 2112 defined therein configured to receive at least part of spring-loaded ball 2102, as shown in the side view of a glider spacer 2000 as shown in FIG. 21B. In at least another embodiment, spring-loaded ball 2102 could engage another embodiment of a lock receiver 2108, comprising a pocket 2114 defined within glider spacer 2000 as shown in FIG. 21C. Fasteners 2106 could also be used to secure a receiver plate 2110 to glider spacer 2000 or another component of rack system 100.

The aforementioned embodiments of lock mechanisms 2100 of the present disclosure are not intended to define the comprehensive scope of potential lock mechanisms 2100 useful in the present disclosure. For example, other embodiments of lock mechanisms, such as various protrusions, hardware components, etc., could be used of said embodiments are operable to or capable of temporarily locking tray 102 in place before or after rotation. In addition, and in at least one embodiment, lock mechanism 2100 may be placed within or upon glider spacer 2000, and lock receiver 2108 could be positioned upon or defined within tray 102, for example.

For overall clarity within the present disclosure, at least one embodiment of a rack system 100 of the present disclosure would comprise an effective one-sided tray 102, and at least one embodiment of a rack system 100 of the present disclosure would comprise an effective two-sided tray 102. An exemplary one-sided tray 102 may be as shown in one or more of FIGS. 1-8, and an exemplary two-sided tray may be as shown in one or more of FIGS. 15-20.

Figure 22:
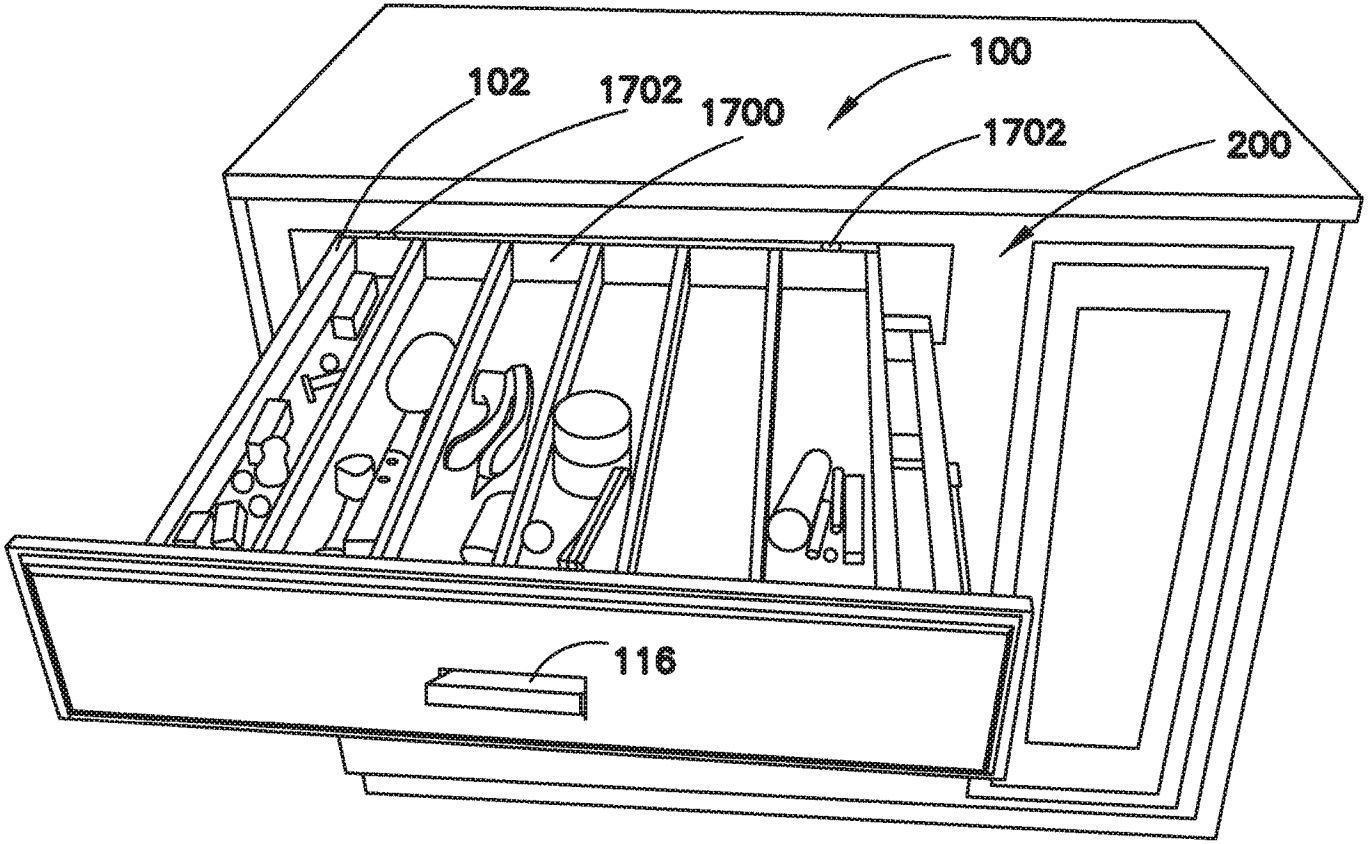
FIG. 22 shows a top perspective view of a rack system in a first access configuration, according to an embodiment of the present disclosure.

FIG. 22 shows a top perspective view of another exemplary embodiment of a rack system 100 of the present disclosure. As shown in FIG. 22, rack system 100 comprises a tray 102 configured so that tray 102 can then be pulled toward a user by way of a glider mechanism 200, resulting in a positioning of tray 102 as shown in FIG. 22. In such a configuration, rack system 100 has the appearance of a traditional drawer; however, the functionality of rack system 100 as compared to a traditional drawer is quite different.

As shown in FIG. 22, an exemplary rack system 100 of the present disclosure may comprise a first tray cover 1700 coupled to tray 102. Tray cover 1700, as shown in FIG. 22, may be made of Plexiglass, but in various other embodiments, tray cover 1700 may comprise a number of other materials, including, but not limited to, wood, metal, plastic, and glass.

Tray cover 1700, as shown in FIG. 22, may be hingedly coupled to tray 102 by way of one or more cover hinges 1702. In other embodiments, tray cover 1700 may be coupled to (or otherwise engage) tray 1700 by other means, including, but not limited to, various hooks, clasps, and/or pockets in various components of rack system 100.

Figure 23:
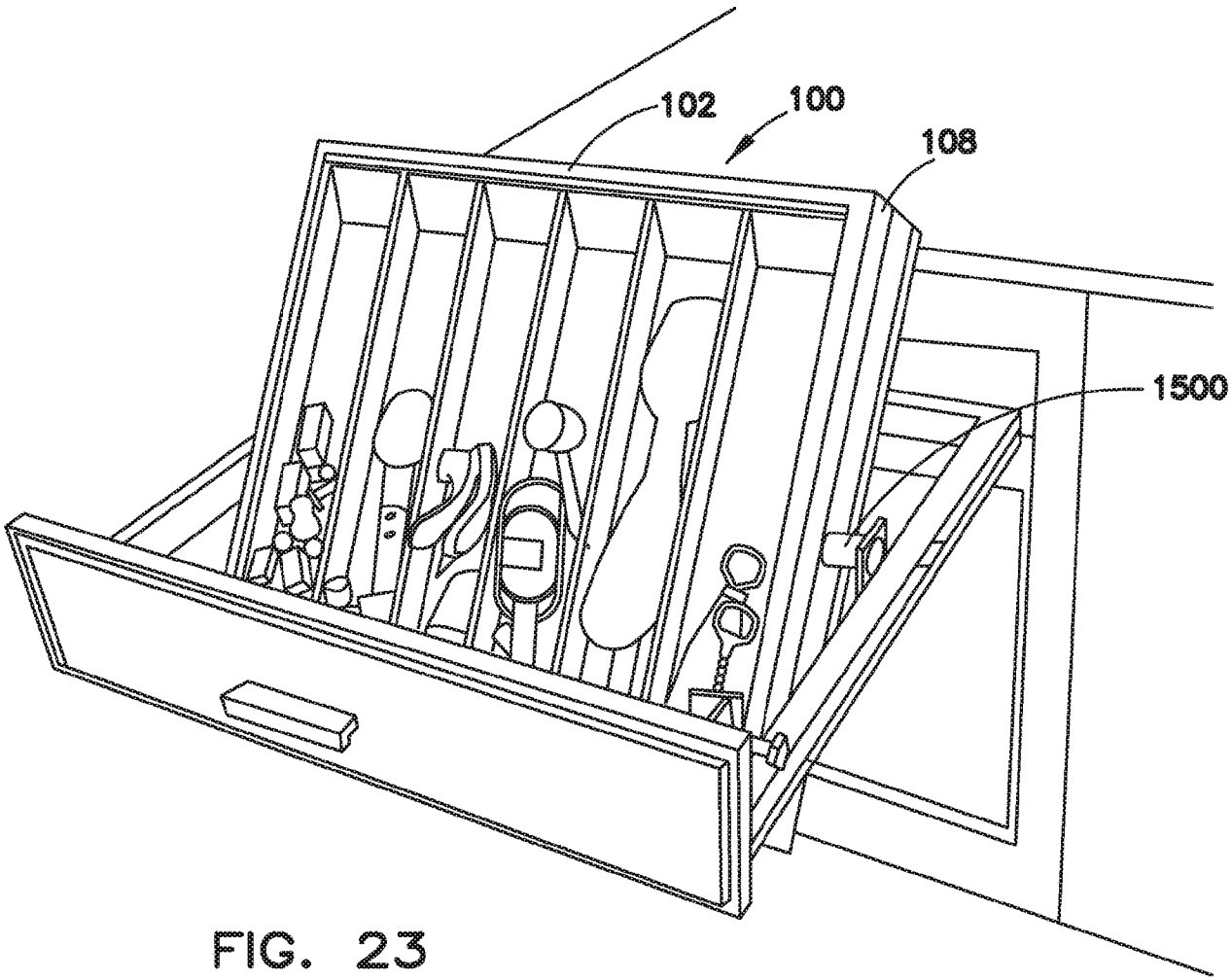
FIGS. 23 and 24 show a perspective view of a tray being rotated about a rotation mechanism, according to an embodiment of the present disclosure.
Figure 24:
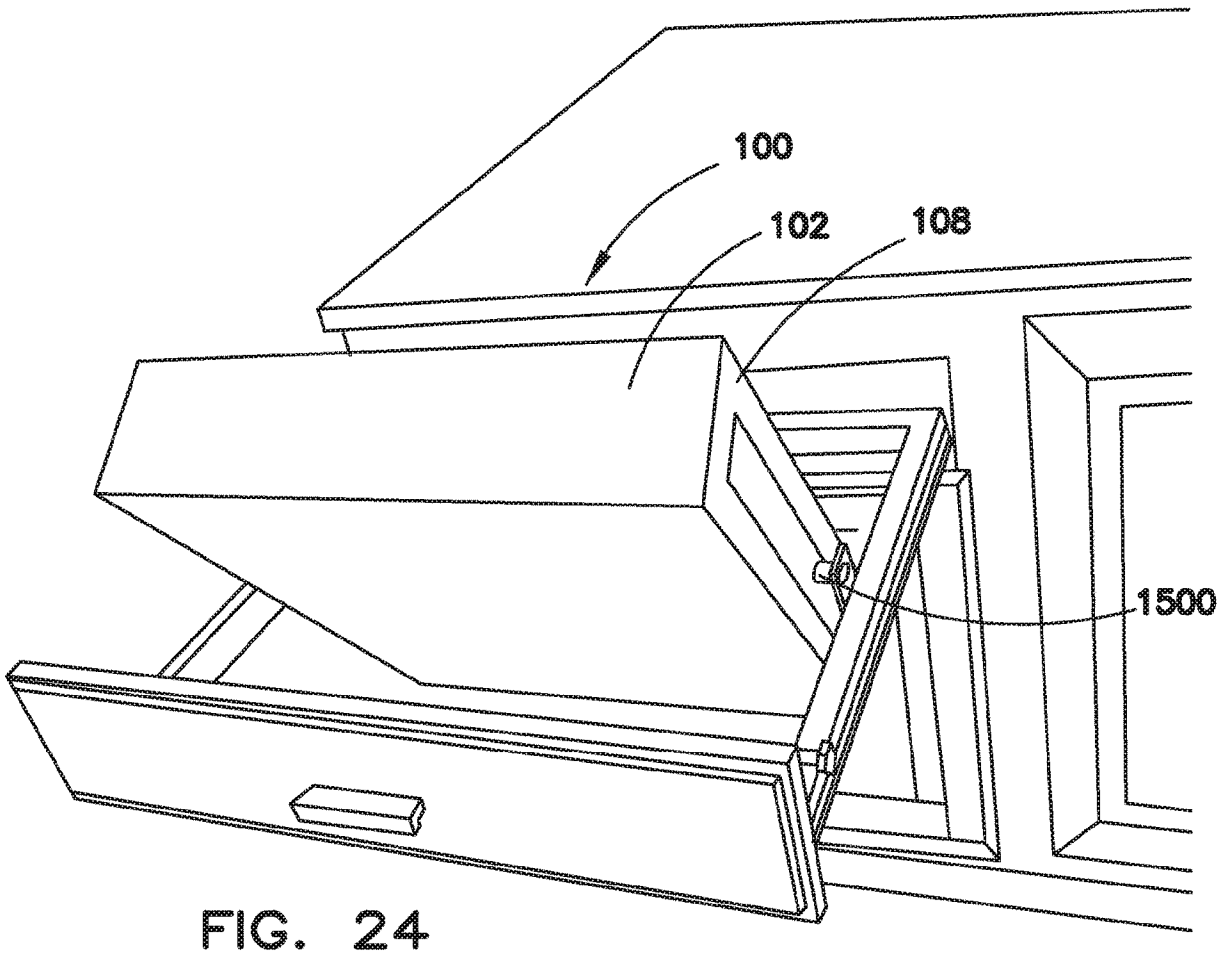

Rotation of tray 102, in such an exemplary embodiment, is shown in FIGS. 23 and 24. Rotation of tray 102 may be performed to move tray 102 from a first access configuration (as shown in FIG. 22) to a second access configuration (as shown in FIG. 24, whereby a relative second side of tray 102 is facing relatively upward).

As shown in FIGS. 23 and 24, tray 102 (with second side 108) has a rotation mechanism 1500 coupled thereto. As referenced herein, such an embodiment of a rack system 100 may comprise a "first rotation mechanism" and a "second rotation mechanism," each referring to a rotation mechanism 1500. As shown in FIGS. 23 and 24, rotation mechanisms 1500 may be positioned at or near relative middles of first side 106 and/or second side 108, as applicable, to facilitate rotation of tray 102 as described herein. Tray 102, as shown in the sequence of figures from FIGS. 22 through 24, may be rotated using rotation mechanisms 1500 so that a user of rack system 100 can access both relative sides of tray 102 and the contents of each relative side of tray 102.

Figure 25:
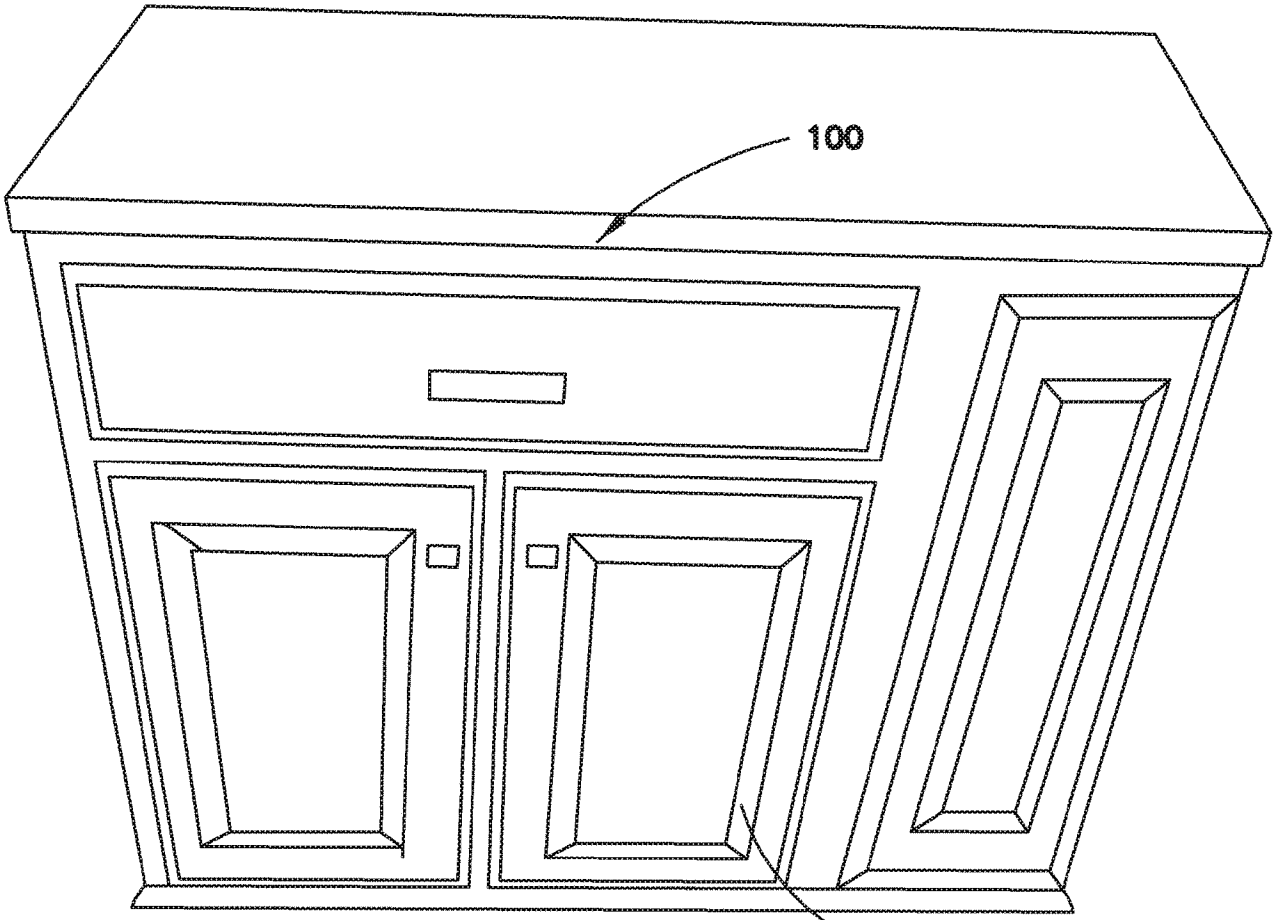
FIG. 25 shows a front view of a rack system as part of a kitchen base cabinet, according to an embodiment of the present disclosure.

As referenced above, various rack systems 100 of the present disclosure can be used in connection with any number of structures 220, including, but not limited to, kitchen cabinets, office cabinets, walls, doors, countertops, and other structures suitable to support various rack systems 100 of the present disclosure. For example, and as shown in FIG. 25, an exemplary rack system 100 may comprise part of a kitchen cabinet (such as a base cabinet, for example), which is generally referred to herein as an exemplary external structure 220. Various embodiments may also be used with, for example, a kitchen wall cabinet, a bathroom cabinet, a garage cabinet, a closet cabinet, and/or any number of other cabinet, shelving, or storage structures.

In use, the embodiments of rack systems 100 shown in FIGS. 22 through 25 may be used as follows. First, a user may engage the drawer handle (hardware 116) to pull the drawer (rack system 100) away from the rest of the cabinet so that rack system 100 is open as shown in FIG. 22, for example. This may be accomplished using a glider mechanism 200 as referenced in further detail herein. After the drawer is opened, the user may access the contents of the first side of tray 102 by opening tray cover 1700. Should the user decide to access the contents of the second side of tray 102, the user would then rotate tray 102 (using rotation mechanism 1500, for example), as shown in FIGS. 23 and 24, to access the second side of tray 102. The second side of tray 102 would also have a tray cover 1700 to prevent any contents of tray 102 from falling out. When the user is done, the user can push rack system 100 back into the cabinet so that rack system 100 is closed as shown in FIG. 25, for example.

Figure 26:
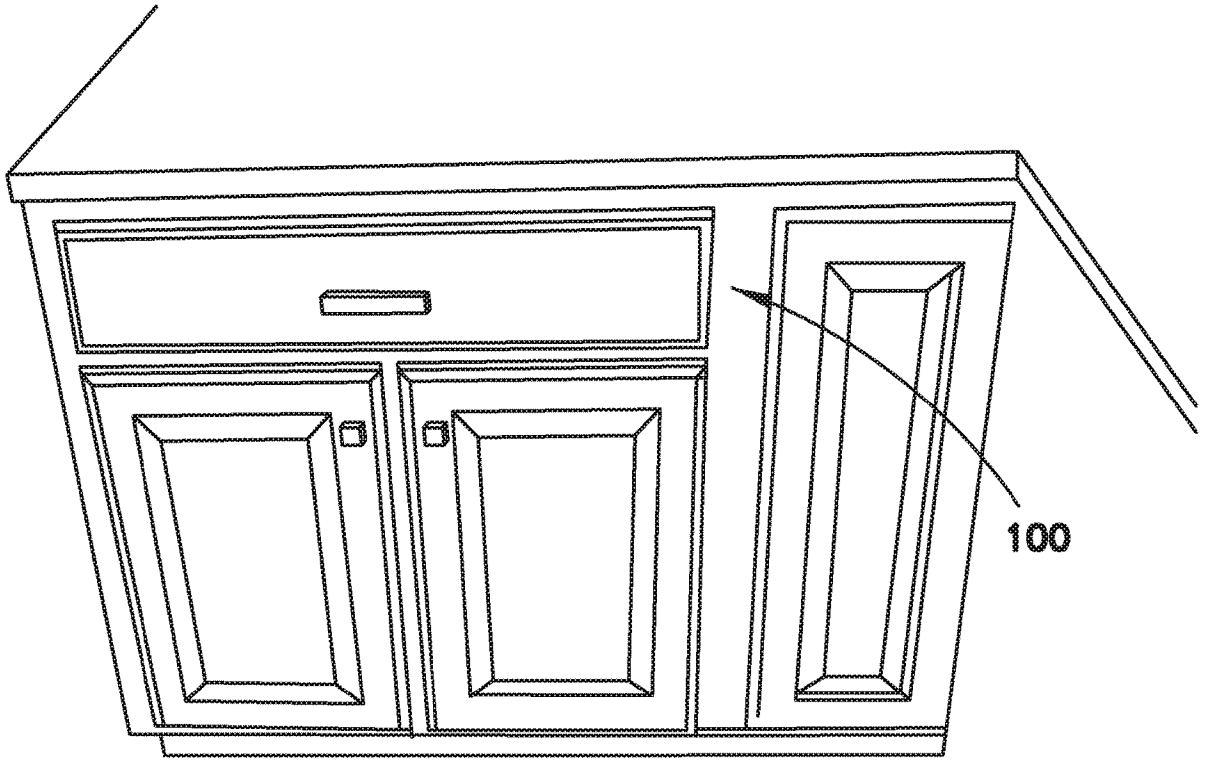
FIG. 26 shows a view of a rack system in a closed configuration, according to an embodiment of the present disclosure.
Figure 27:
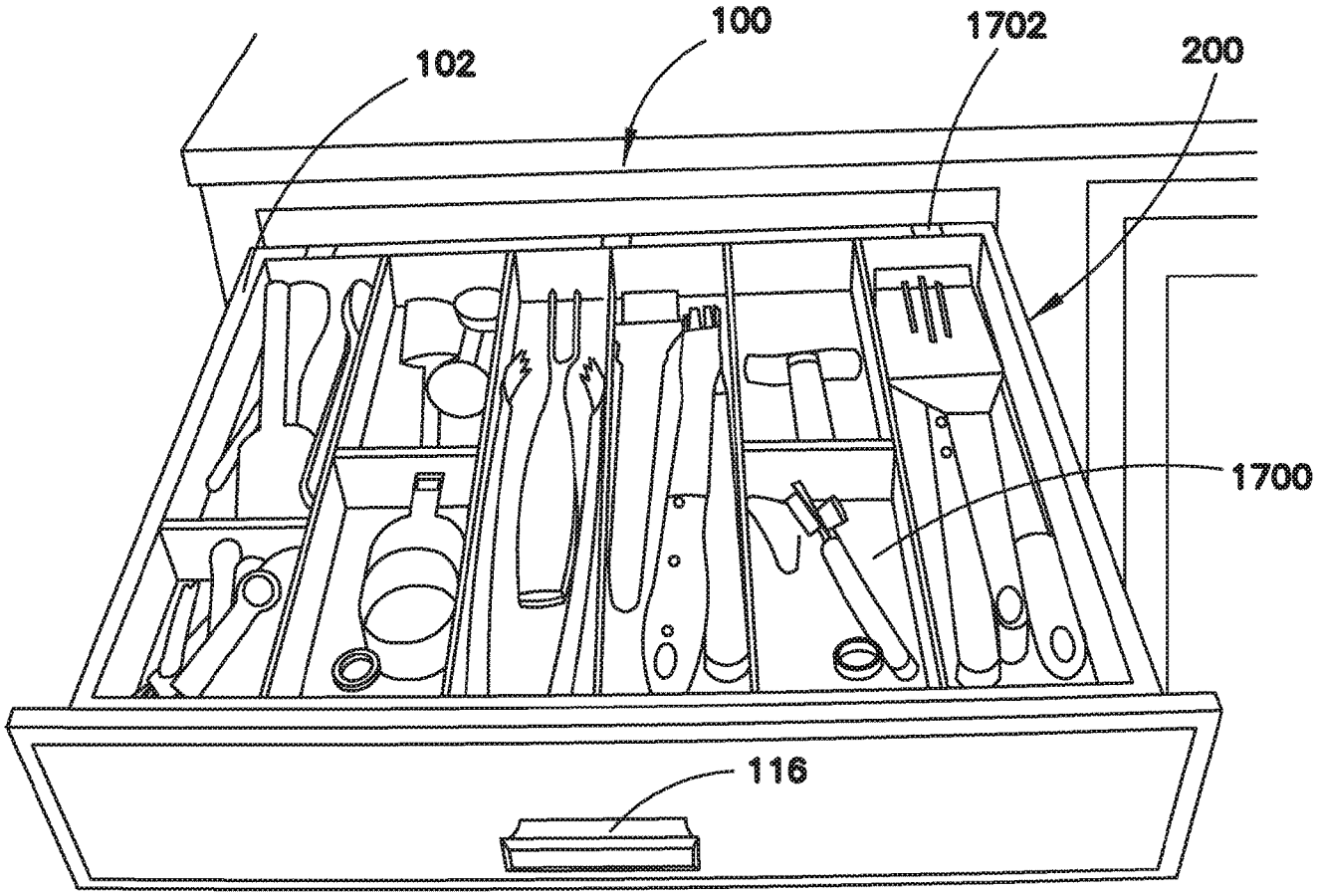
FIG. 27 shows a view of a rack system in an open configuration, according to an embodiment of the present disclosure.

FIGS. 26 and 27 show front and perspective views, respectively, of an additional exemplary embodiment of a rack system 100 of the present disclosure. FIG. 26 shows a closed embodiment, and FIG. 27 shows a relatively open embodiment. In such embodiments, rack system 100 is configured as a drawer shown within a base cabinet, but in other embodiments, for example and as referenced generally herein, rack systems 100 may be within, or under, upper cabinetry as well.

As shown in FIG. 27, an exemplary rack system 100 of the present disclosure comprises a tray 102 configured so that tray 102 can then be pulled toward a user by way of a glider mechanism 200, resulting in a positioning of tray 102 as shown in FIG. 27. In such a configuration, rack system 100 has the appearance of a traditional drawer; however, the functionality of rack system 100 as compared to a traditional drawer is quite different.

As shown in FIG. 27, an exemplary rack system 100 of the present disclosure may comprise a first tray cover 1700 coupled to tray 102. Tray cover 1700, as shown in FIG. 22, may be made of Plexiglass, but in various other embodiments, tray cover 1700 may comprise a number of other materials, including, but not limited to, wood, metal, plastic, and glass.

Figure 28:
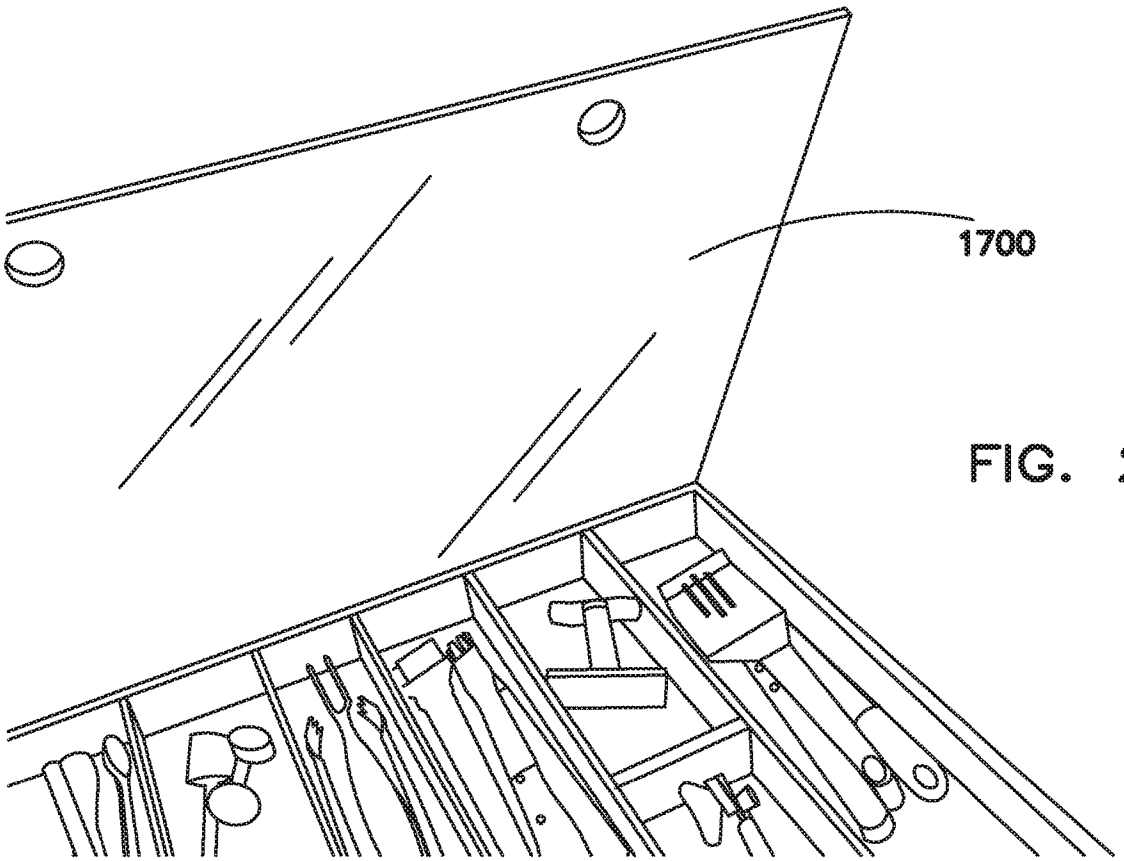
FIG. 28 shows a view of a rack system in an open configuration and with an open cover, according to an embodiment of the present disclosure.

Tray cover 1700, as shown in FIG. 27, may be hingedly coupled to tray 102 by way of one or more cover hinges 1702. In other embodiments, tray cover 1700 may be coupled to (or otherwise engage) tray 1700 by other means, including, but not limited to, various hooks, clasps, and/or pockets in various components of rack system 100. FIG. 28 shows a perspective view of an exemplary rack system 100 of the present disclosure whereby tray cover 1700 is open so that contents of tray 102 can be accessed.

Figure 29:
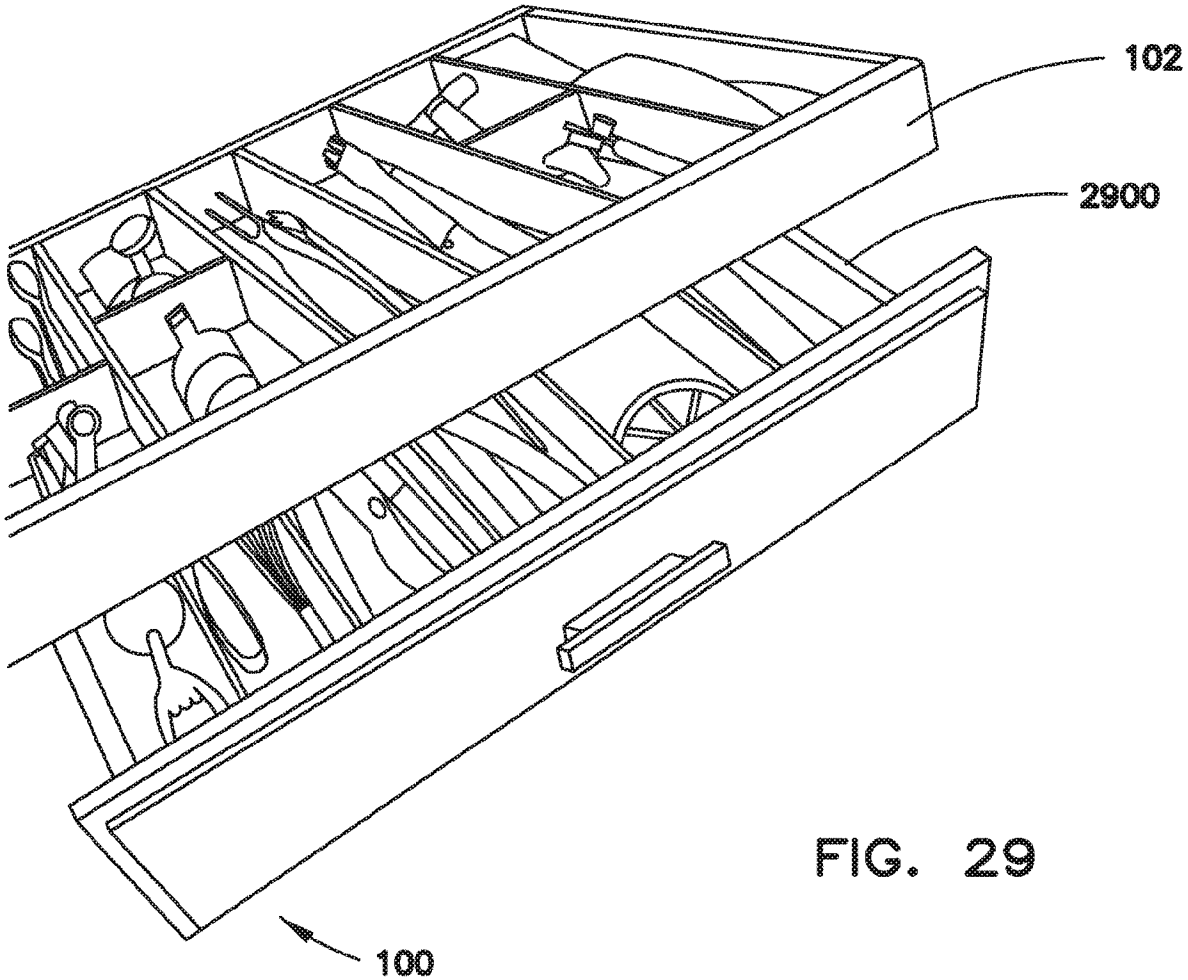
FIGS. 29 and 30 show perspective views of a rack system having a first tray and a second tray, according to embodiments of the present disclosure.
Figure 30:
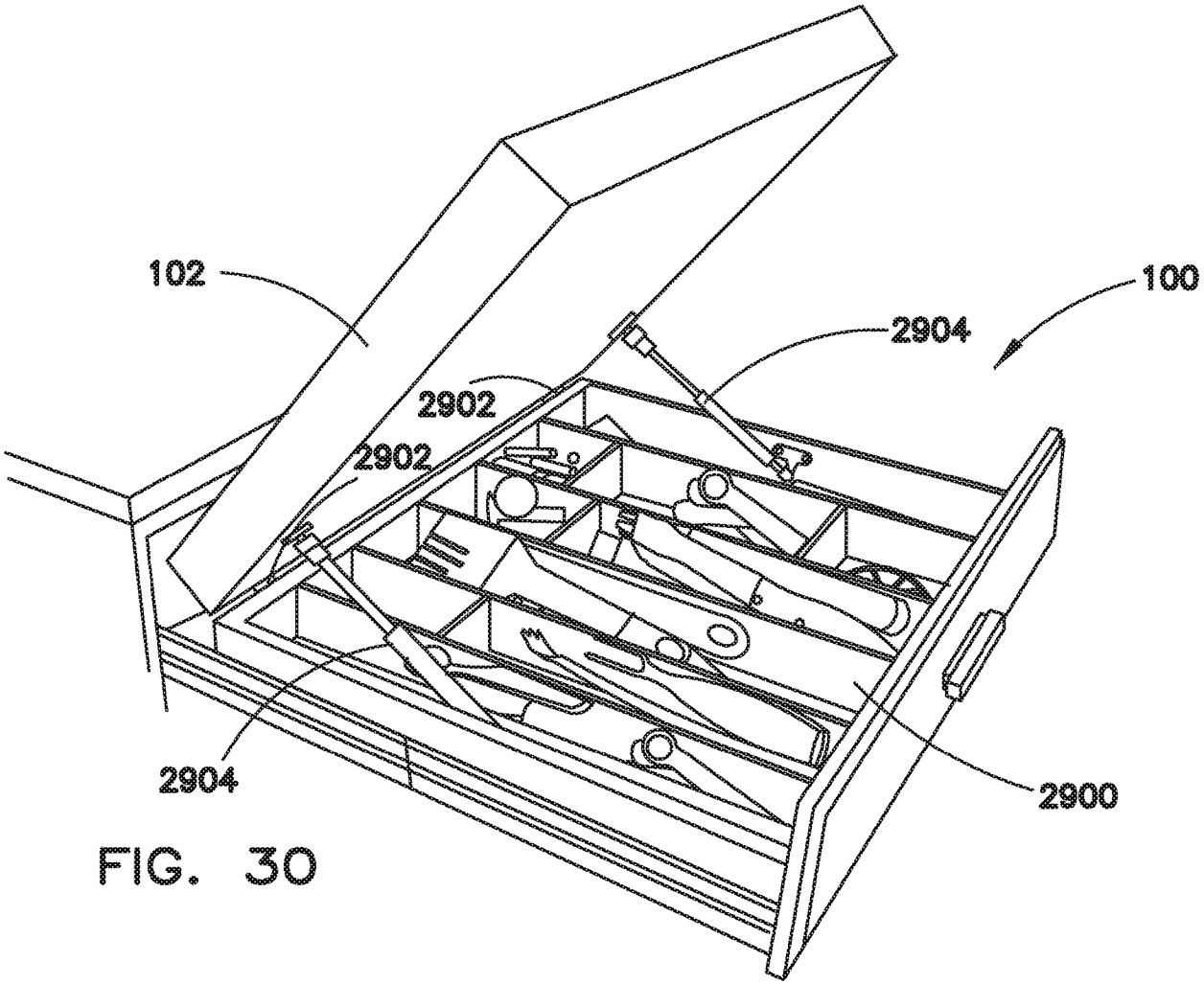
Figure 31:
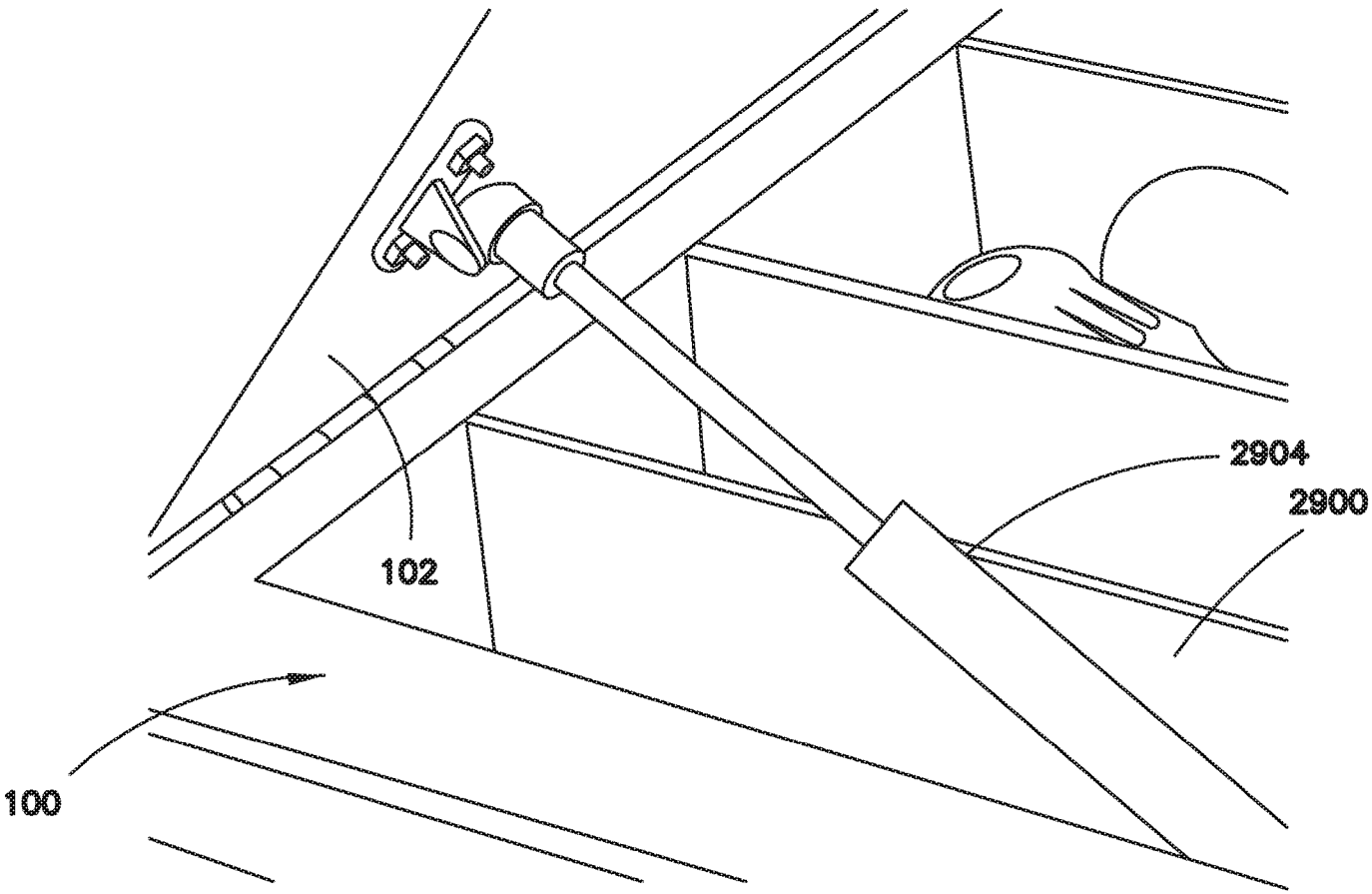
FIGS. 31 and 32 show perspective views of portions of a first tray and a second tray of an exemplary rack system with an actuator positioned therein, according to embodiments of the present disclosure.
Figure 32:
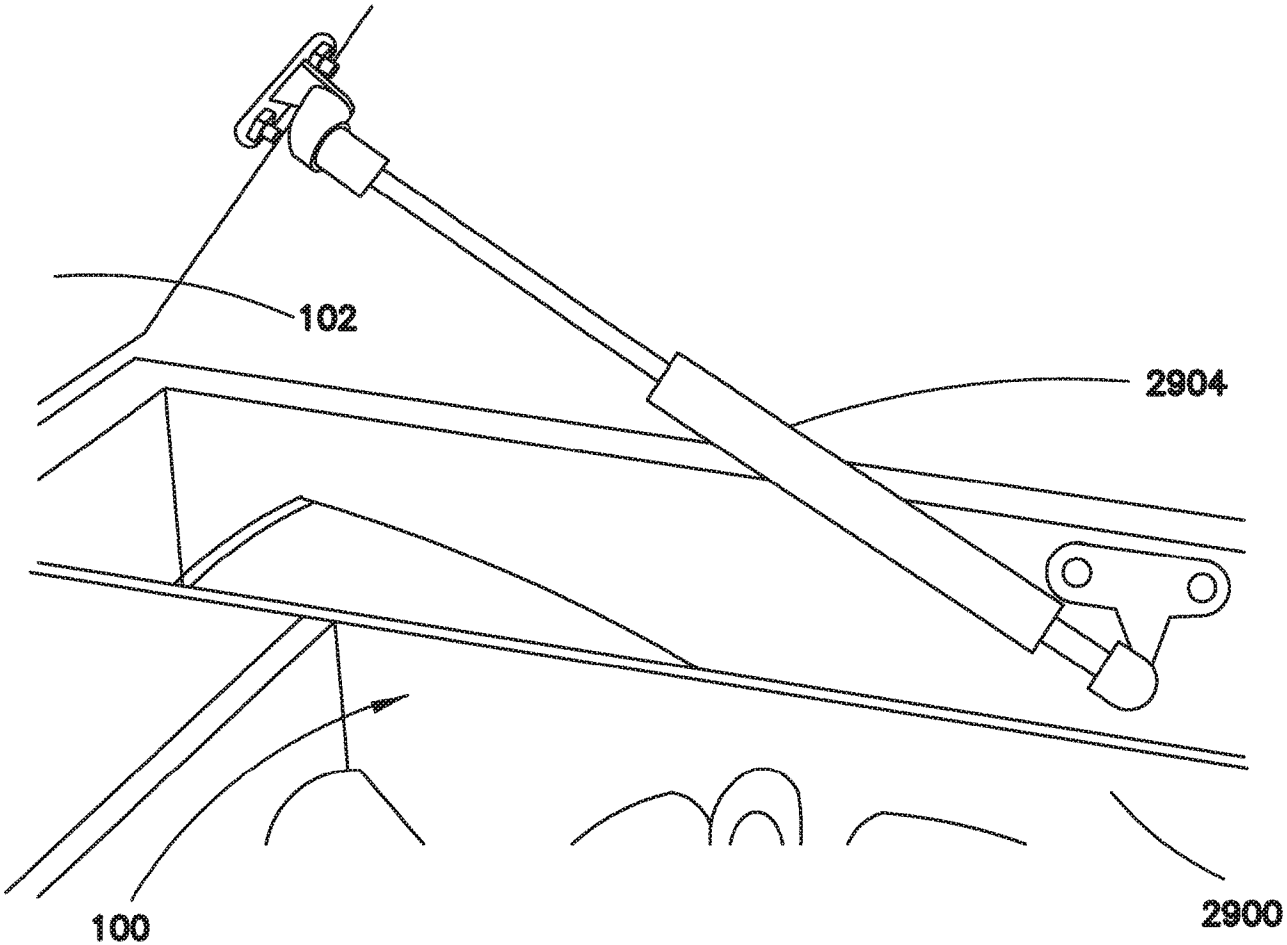

FIGS. 29 and 30 show perspective view of an exemplary embodiment of a rack system 100 of the present disclosure having two trays. As shown in FIGS. 29 and 30, rack system 100 comprises a first tray 102 and a second tray 2900, whereby first tray 102 is positioned above second tray 2900. First tray 102 and second tray 2900 may be hingedly coupled to one another by way of one or more tray coupler hinges 2902 as shown in FIG. 30 and/or one or more lift actuators 2904 as shown in FIGS. 31 and 32. Tray coupler hinges 2902, as shown in FIG. 30, may be positioned at the relative back of rack system 100 so to couple the first tray 102 at the bottom of first tray 102 to the second tray 2900 at the top of second tray 2900. Furthermore, one or more lift actuators 2904 could be coupled to the underside of first tray 102 and to the inside of second tray 2900, so that when first tray 102 and second tray 2900 are closed (completely or substantially resting/stacked upon one another), lift actuators 2904 are within second tray 2900 so that rack system 100 can open and close as desired. In such an embodiment, contents of first tray 102 and second tray 2900 can be readily accessed with minimal movement or shifting of items contained therein.

As referenced above, first tray 102 is described as being above second tray 2900. In other embodiments, said trays may be reversed, and in various embodiments, components referenced herein in connection with various rack systems 100 of the present disclosure, such as various glider mechanisms, pulls, hinges, covers, face plates, etc., may be used in connection with either tray 102, 2900. Furthermore, tray coupler hinges 2902 and lift actuators 2904 (which may be generally referred to herein as "pivot mechanisms") are not intended to be the sole mechanisms used to couple and allow pivoting movement of one tray relative to another, as other mechanisms, such as other hardware useful to pivot one item relative to another, may be used with, or in lieu of, tray coupler hinges 2902 and lift actuators 2904.

Embodiments of rack systems 100 shown in FIGS. 26 through 31 may be used as follows. First, a user may engage the drawer handle (hardware 116) to pull the drawer (rack system 100) away from the rest of the cabinet so that rack system 100 is open as shown in FIG. 27, for example. This may be accomplished using a glider mechanism 200 as referenced in further detail herein. After the drawer is opened, the user may access the contents of the first tray 102 first by opening tray cover 1700. Should the user decide to access the contents of the second tray 2900, the user would then pivot first tray 102 upwards to access second tray 2900. When the user is done, the user can close first tray 102 relative to second tray 2900, push rack system 100 back into the cabinet so that rack system 100 is closed as shown in FIG. 26, for example.

Figure 33:
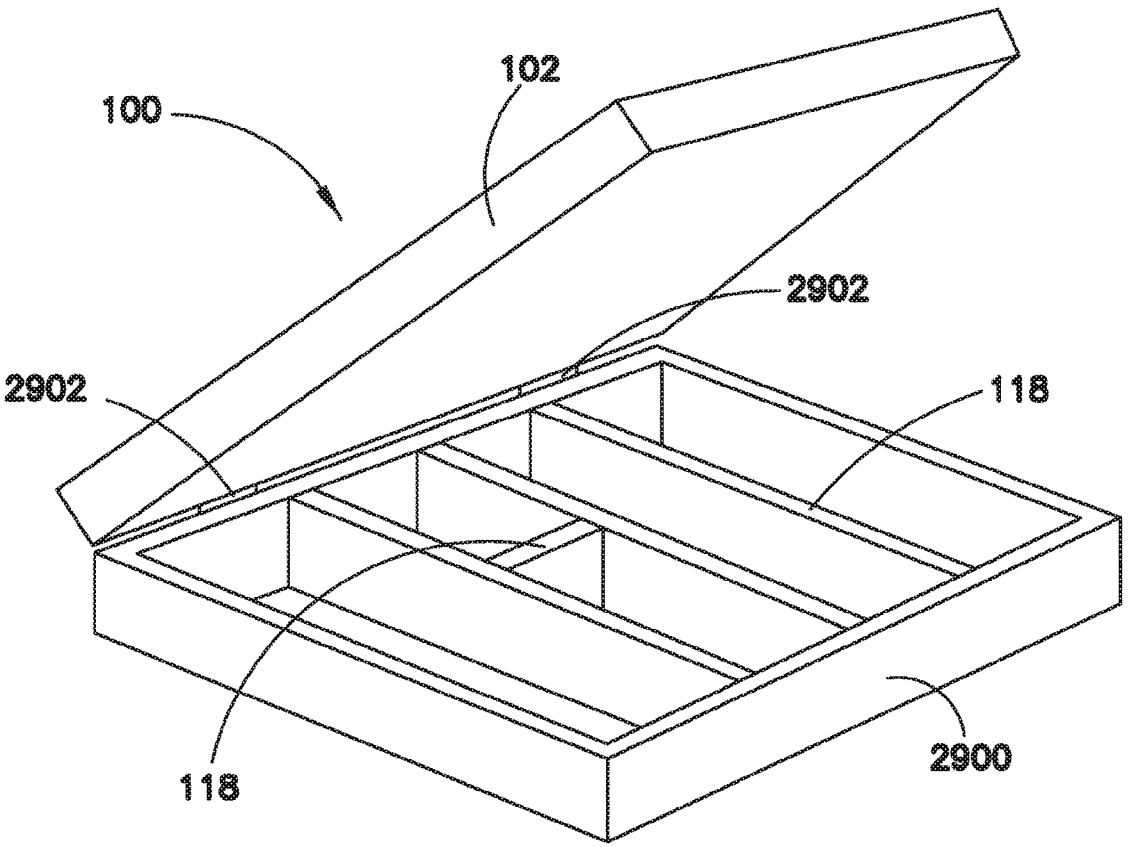
FIG. 33 shows a perspective view of a rack system configured as an insert, according to an embodiment of the present disclosure.

At least another embodiment of a rack system 100 of the present disclosure is shown in FIG. 33. As shown in FIG. 33, an exemplary rack system 100 (also referred to herein as an "insert") comprises a first tray 102, a second tray 2900, and one or more tray coupler hinges 2902 to couple and/or allow pivoting movement of first tray 102 relative to second tray 2900. As shown in FIG. 33, and as applicable to various other embodiments of rack systems 100 of the present disclosure, rack system 100 comprises one or more optional dividers 118 which may be positioned within first tray 102, for example, to separate contents of first tray 102.

In such an embodiment, rack system 100 would be configured to fit within a drawer or other cabinetry, and would allow a user to access first tray 102 and second tray 2900 as referenced herein. So to take advantage of as large of a rack system 100 as desired, the drawer may utilize one or more glider mechanisms 200 of a sufficient length to allow for the drawer to be pulled forward as far as desired so to allow a desired sized rack system 100 to be placed therein.

Figure 34B:
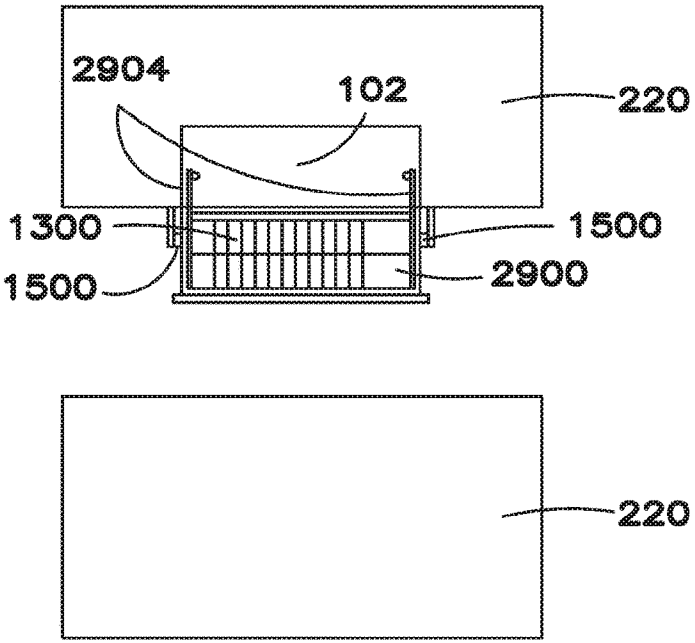
FIGS. 34A and 34B show front views of a rack system positioned under a wall cabinet, according to embodiments of the present disclosure.
Figure 34A:
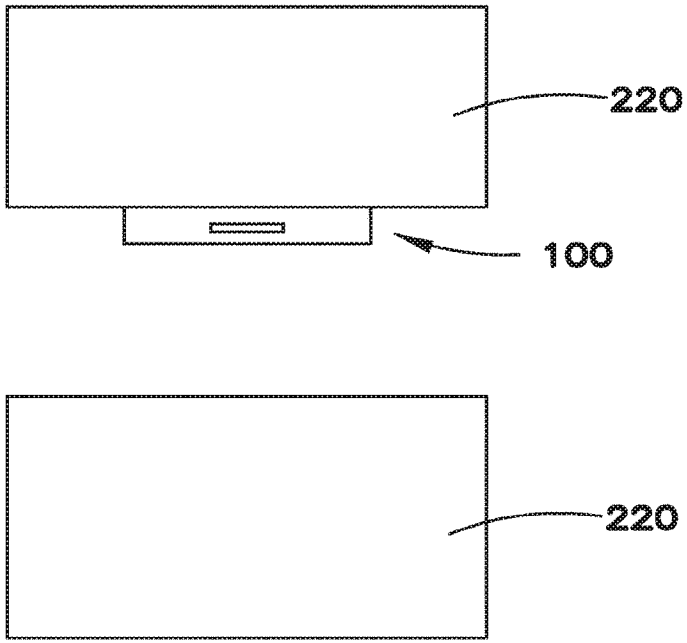
Figure 35:
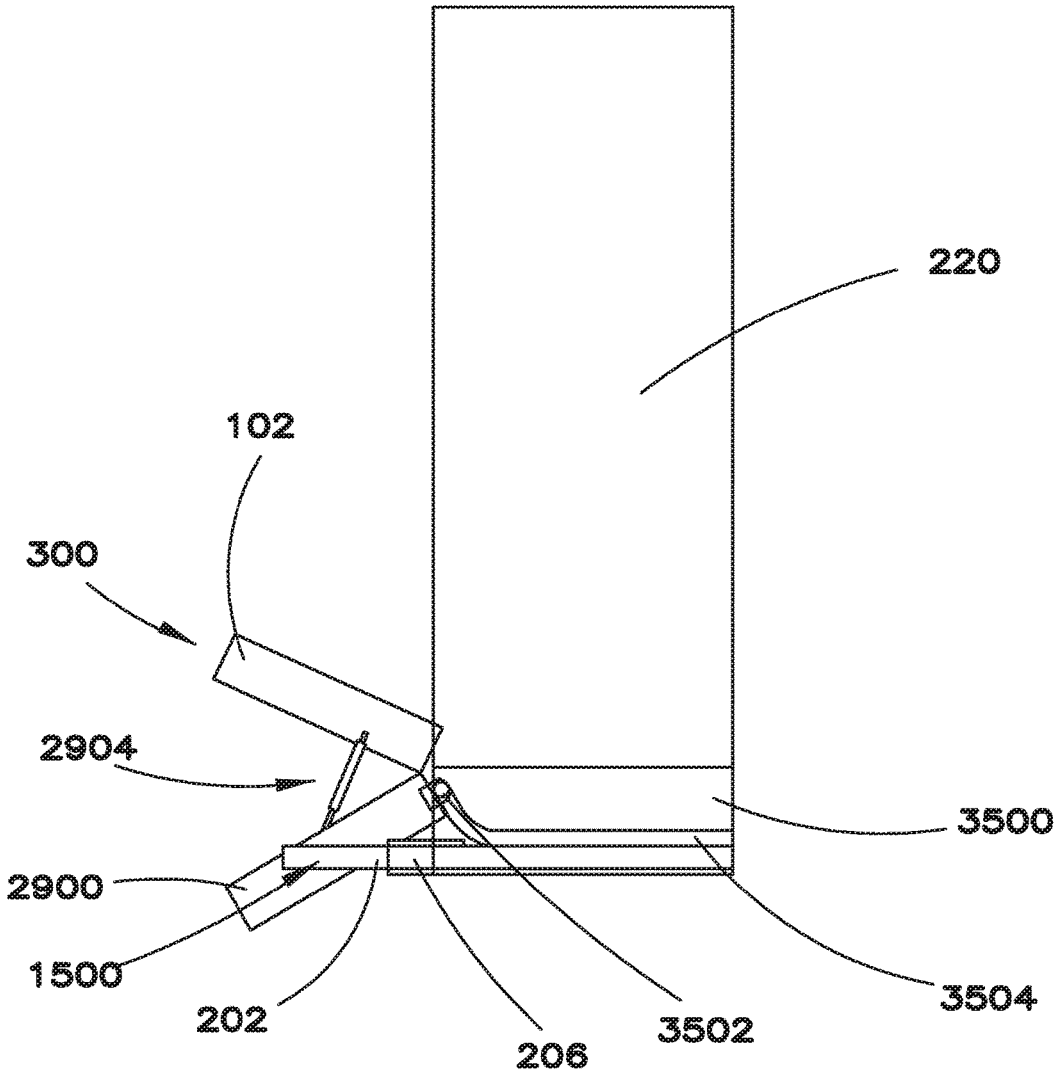
FIG. 35 shows a side view of a rack system positioned under a wall cabinet, according to embodiments of the present disclosure.

Additional schematics of exemplary rack systems 100 of the present disclosure in various types of cabinetry are shown in FIGS. 34A, 34B, and 35. FIGS. 34A and 34B show front views of an exemplary embodiment of a rack system 300 of the present disclosure positioned underneath an upper cabinet in a closed configuration (FIG. 34A) and in an open configuration (FIG. 34B). FIG. 35 shows a side view of an exemplary embodiment of a rack system 300 of the present disclosure in a full open configuration. In various embodiments, and as shown in FIG. 35, rack system 300 may comprise a first tray 102 and a second tray 2900, whereby first tray 102 is positioned above second tray 2900. First tray 102 and second tray 2900 may be hingedly coupled to one another by way of one or more tray coupler hinges 2902 as shown in FIG. 30 and/or one or more lift actuators 2904 as shown in FIGS. 31 and 32. Tray coupler hinges 2902, as shown in FIG. 30, may be positioned at the relative back of rack system 300 so to couple to first tray 102 at the bottom of first tray 102 and to couple to second tray 2900 at the top of second tray 2900. Furthermore, one or more lift actuators 2904 could be coupled to the underside of first tray 102 and to the inside of second tray 2900, so that when first tray 102 and second tray 2900 are closed (completely or substantially resting/stacked upon one another), lift actuators 2904 are within second tray 2900 so that rack system 300 can open and close as desired.

In various embodiments, and as shown in FIG. 35, rack system 300 may further comprise at least one cam mechanism 3502, at least one guide channel 3504, a support box 3500, and at least one tilt actuator 3604. The cam mechanism 3502 may be positioned at the relative back of the second tray 2900 and positioned such that cam mechanism 3502 moves within, along, or through the guide channel 3504. The guide channel 3504 may be formed in the side wall of the support box 3500 or the external structure 220, either of which may support the glide mechanism hardware for the second tray 2900, including the side wall bracket 202, the coupler bracket 206, and the tilt actuator 3604. Moreover, the guide channel 3504 may be formed to engage the cam mechanism 3502 and enable tilting of the rack system 300. Furthermore, the guide channel 3504 may be formed to enable the rack system 300 to move parallel to ground initially but to tilt the relative front edge of second tray 2900 downward as the second tray 2900 reaches the end of its travel, thereby positioning the rack system 300 in an open access configuration as shown in FIG. 35.

Figure 36:
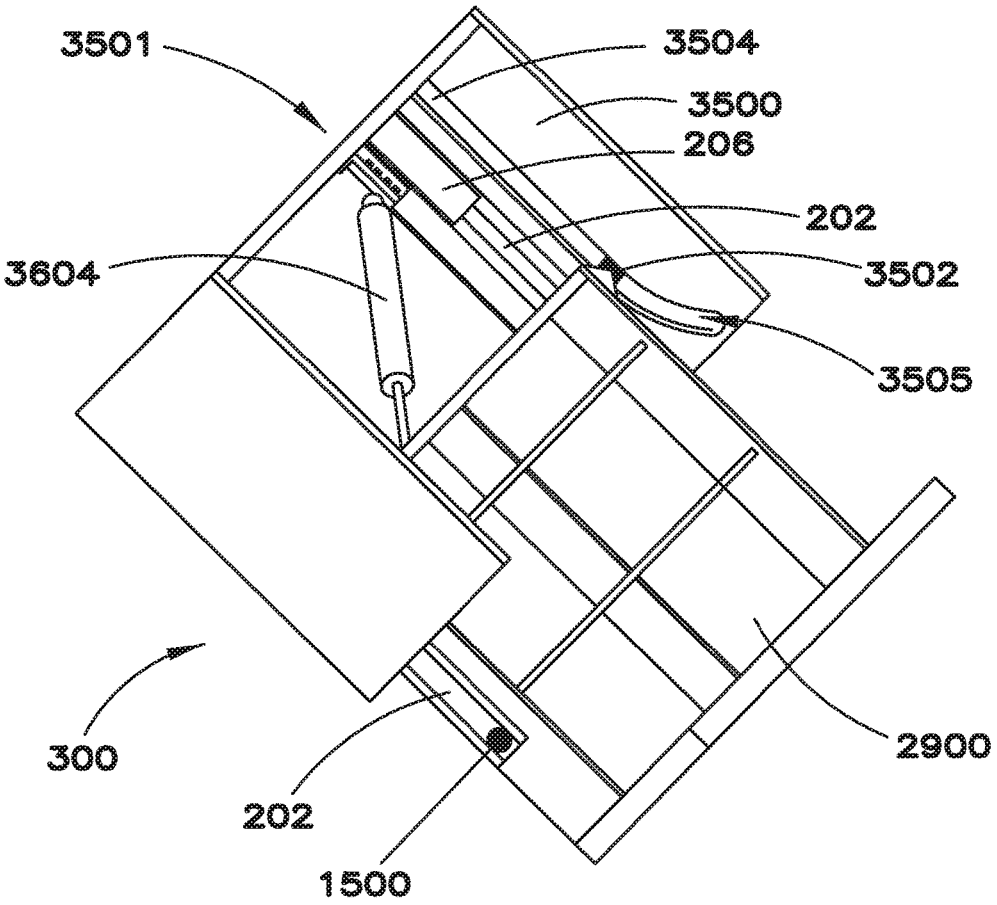
FIG. 36 shows an isometric view of a portion of a rack system, according to embodiments of the present disclosure.

FIG. 36 shows an isometric view of a portion of a rack system 300, according to embodiments of the present disclosure. As shown in FIG. 36, the guide channel 3504 may be angled upward along its length 3505 relative to the ground to enable the tilting motion described. In at least one embodiment, the rack system 300 may further include at least one tilt actuator 3604, which may be operably attached to a back edge of the second tray 2900 and the support box 3500 or the external structure 220 by any appropriate means, to further assist the tilting and return motions of tray 2900. Tilt actuator 3604 may be any means of enabling and assisting tilting of tray 102, including, but not limited to, gas springs or the like.

In operation according to one embodiment of the present disclosure, when the rack system 300 is opened, the cam mechanism 3502 moves within, along, or through the guide channel 3504. As the guide channel 3504 angles upward along its length 3505 relative to the ground, the relative front edge of the second tray 2900 tilts downward as the tray reaches the end of its travel, pivoting about the at least one rotation mechanism 1500. As the second tray 2900 pivots, the lift actuators 2904 raise the first tray 102 as described herein, thereby positioning the rack system 300 in an open access configuration and allowing access to the space within both the first tray 102 and the second tray 2900. Such embodiments may include one or more additional features of rack systems 100 of the present disclosure other than those shown herein.

Figure 37:
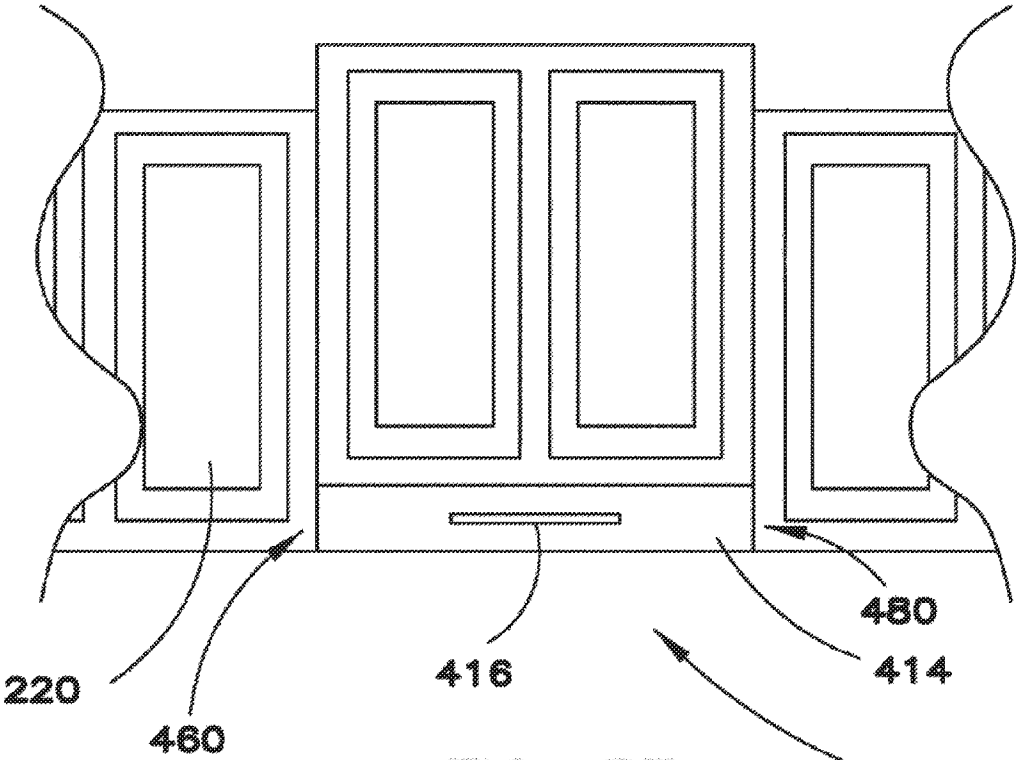
FIG. 37 shows a view of a rack system in a closed configuration, according to an embodiment of the present disclosure.
Figure 38:
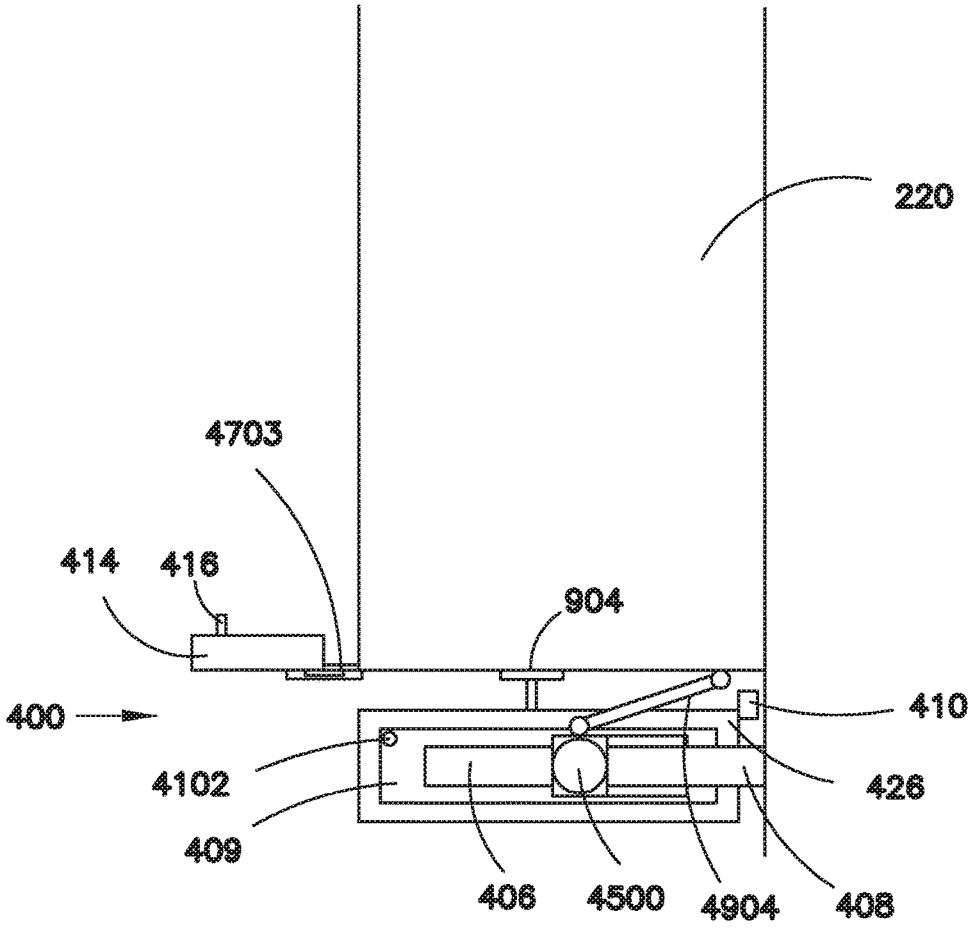
FIG. 38 shows a side view of a rack system in a first access configuration, according to an embodiment of the present disclosure.
Figure 39:
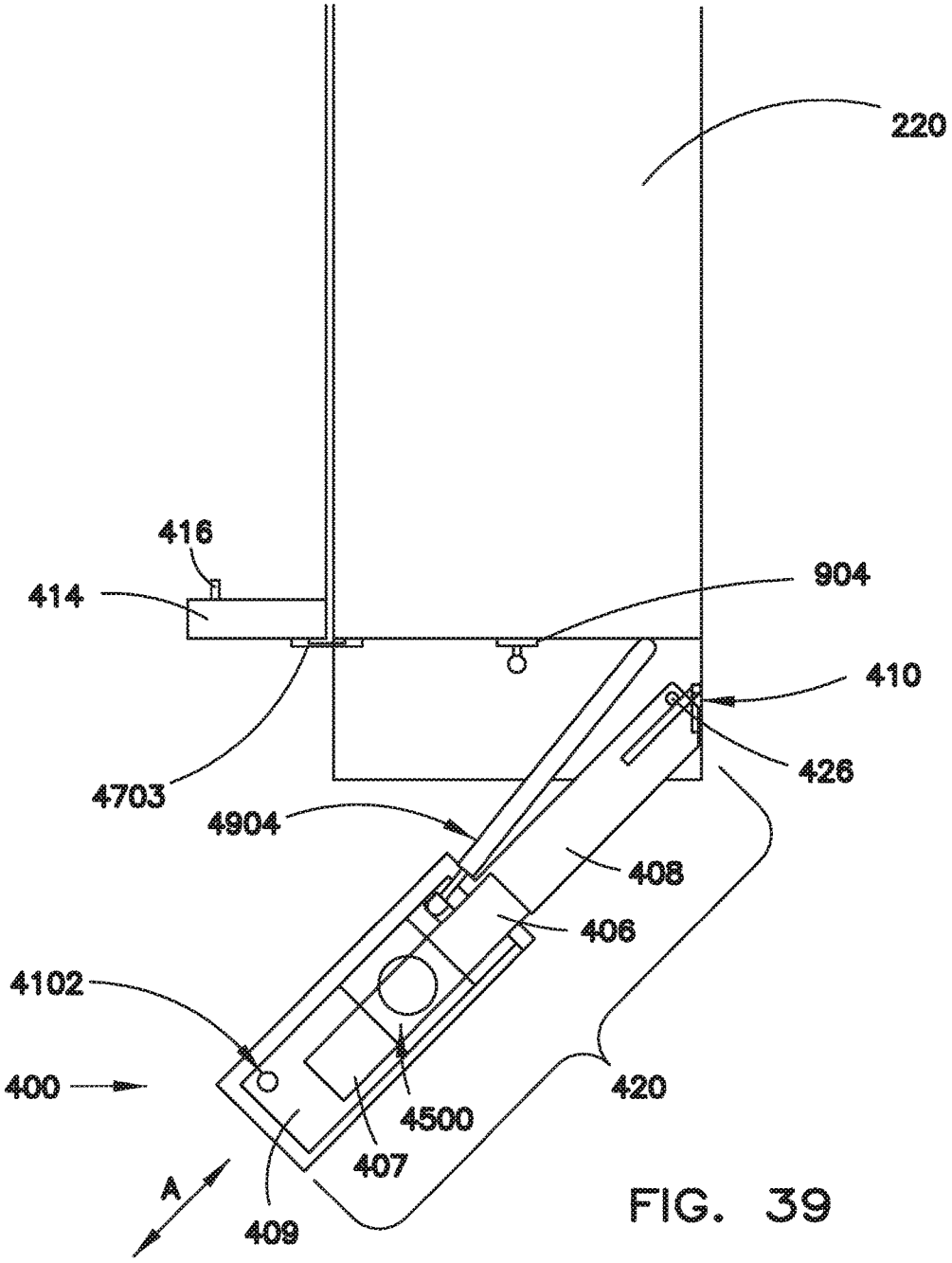
FIG. 39 shows a side view of a rack system in a second access configuration, according to an embodiment of the present disclosure.
Figure 42:
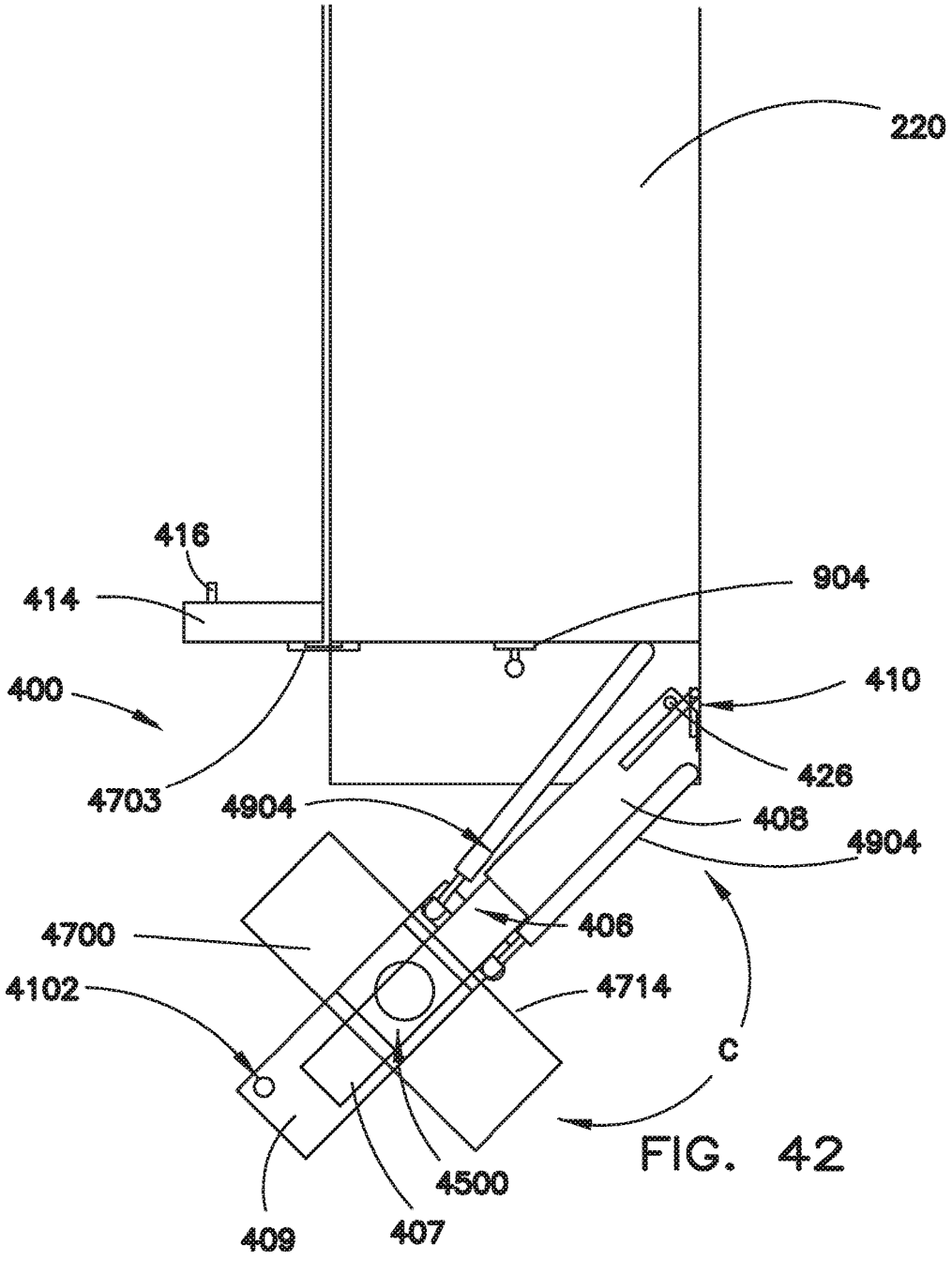
FIG. 42 shows a view of a rack system in a transition between a second access configuration and a third access configuration, according to an embodiment of the present disclosure.

FIG. 37 shows a view of a rack system 400 in a closed configuration, according to an embodiment of the present disclosure. In at least one embodiment, the rack system 400, having a first side 480 and an opposing second side 460, may be mounted underneath an upper cabinet 220 and hidden from view by cover plate 414 as shown in FIG. 37. As shown in FIG. 38, the rack system 400 includes a housing 404, a glider mechanism 420 operably coupled thereto, and a tray 402 (with a first side 480 shown in figure) having at least one rotation mechanism 4500 operably coupled thereto. The rotation mechanism 4500, in various embodiments, is capable of being coupled to tray 402 and one or more other components of rack system 400 (such as portions of the glider mechanism 420, for example, or a side wall bracket 409 as referenced in further detail herein), so that tray 402 is operable to rotate or capable of rotation about rotation mechanism 4500. As referenced herein, such an embodiment of a rack system 400 may comprise a "first rotation mechanism" and a "second rotation mechanism," each referring to a rotation mechanism 4500. Likewise, such an embodiment of a rack system 400 may comprise a "first glider mechanism" and a "second glider mechanism," each referring to a glider mechanism 420. As shown in FIGS. 38, 39 and 42, rotation mechanisms 4500 may be positioned at or near relative middles of first side 480 and second side 460, as applicable, to facilitate rotation of tray 402 as described in further detail herein. In the view of rack system 100 shown in FIG. 20, rotation mechanism 1500 is not visible because it is positioned beneath a glider spacer 2000.

FIG. 38 shows a side view of a rack system 400 in a first access configuration, with the cover plate 414 open and secured to cabinet structure 220 by cover hinge 4703. FIG. 39 shows a side view of a rack system in a second access configuration, according to an embodiment of the present disclosure. As shown in FIG. 39, the glider mechanism 420 may include a counterbalance hinge 410 coupled to a drop down arm 408 at pivot point 426 and attached to the housing 404. The drop down arm 408 may be slidingly engage a coupler bracket 406, which slidingly engages a drawer guide 407, which may be attached to a side wall bracket 409. In at least one embodiment, the drop down arm 408, coupler bracket 406, drawer guide 407 are configured to enable sliding motion relative to one another in a direction shown by the bi-directional arrow A in FIG. 39, thus enabling the tray 402 to extend away from pivot point 426 and into a second access configuration. Further, the counterbalance hinge 410 enables smooth and controlled rotation of the tray 402 and glide mechanism 420 as each concurrently pivots from the first to the second access configuration. Further, counterbalance hinge 410 at least partially counterbalances the weight of the rack system 400 such that less force is required to return the rack system 400 from the second to the first access configuration.

In at least one embodiment of the present disclosure, the glider mechanism 200 may further include a glider actuator 4904 attached at a first end to the housing 404 and at a second end to the drop down arm 408. In at least embodiment, the glider actuator 4904 may be attached to any component of glider mechanism 200 that enables the desired motion and function described herein. The glider actuator 4904 enables smooth and controlled motion as the glide mechanism 420 moves the tray 402 from the first to the second access configuration. Glider actuators 4904 may be any means of enabling the applicable automated movement of tray 102, including, but not limited to, stepper motors, servo motors, spring-loaded gas springs, or the like.

Figure 40:
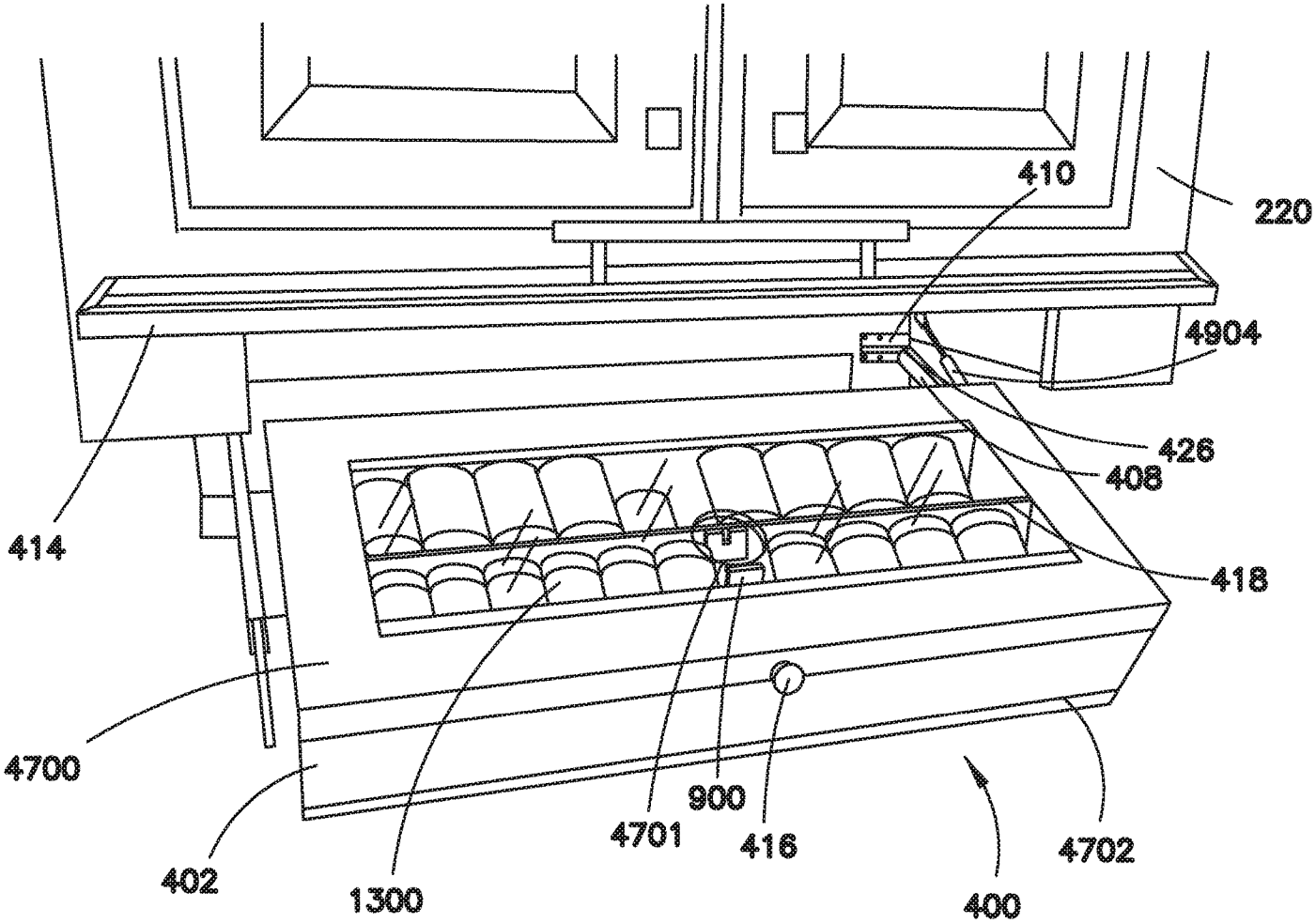
FIG. 40 shows a front perspective view of a rack system in a second access configuration with tray cover in a closed configuration, according to an embodiment of the present disclosure.

FIG. 40 shows a front perspective view of an exemplary embodiment of a rack system 400 in a second access configuration with tray cover in an closed configuration, according to the present disclosure. As shown in FIGS. 39 and 40, rack system 400 has a second access configuration, which corresponds to a native or a non-rotated configuration of tray 402. In operation, tray 402 could be engaged by a user and pressed so that a latch mechanism 900 disengages a latch member 904 (shown in FIG. 39), for example, so that tray 402 is allowed to pivot downward by way of a counterbalance hinge 410. Tray 402 then extends toward a user by way of a glider mechanism 200, resulting in a positioning of tray 102 as shown in FIG. 40. Such a procedure does not involve rotation of tray 102 about a rotation mechanism 1500, so such a positioning may be referred to herein as a second access configuration, whereby the relative top of tray 402 is revealed.

As shown in FIG. 40, an exemplary rack system 400 of the present disclosure may comprise a first tray cover 4700 coupled to tray 402. Tray cover 4700 may be made of Plexiglas, but in various other embodiments, tray cover 4700 may comprise a number of other materials, including, but not limited to, wood, metal, plastic, glass or a combination of these as shown in FIG. 40. Tray cover 4700 may be hingedly coupled to tray 402 by way of one or more cover hinges 4702. In other embodiments, tray cover 4700 may be coupled to (or otherwise engage) tray 402 by other means, including, but not limited to, various hooks, clasps, and/or pockets in various components of rack system 400. Tray cover 4700 may further include an opening 4701 formed to enable latch mechanism 900 to couple with the latch member 904 as described herein.

The exemplary latch mechanism 900 shown in FIG. 40 is but one exemplary latch mechanism 900 of the present disclosure, as any number of other latch mechanisms 900, utilizing magnets, snaps, and or other componentry sufficiently strong to hold a relatively heavy and filled tray 102 in place without tray 102 disengaging from structure 220 at or near latch mechanism 900, could be used with various embodiments of rack systems 100 of the present disclosure.

Figure 41:
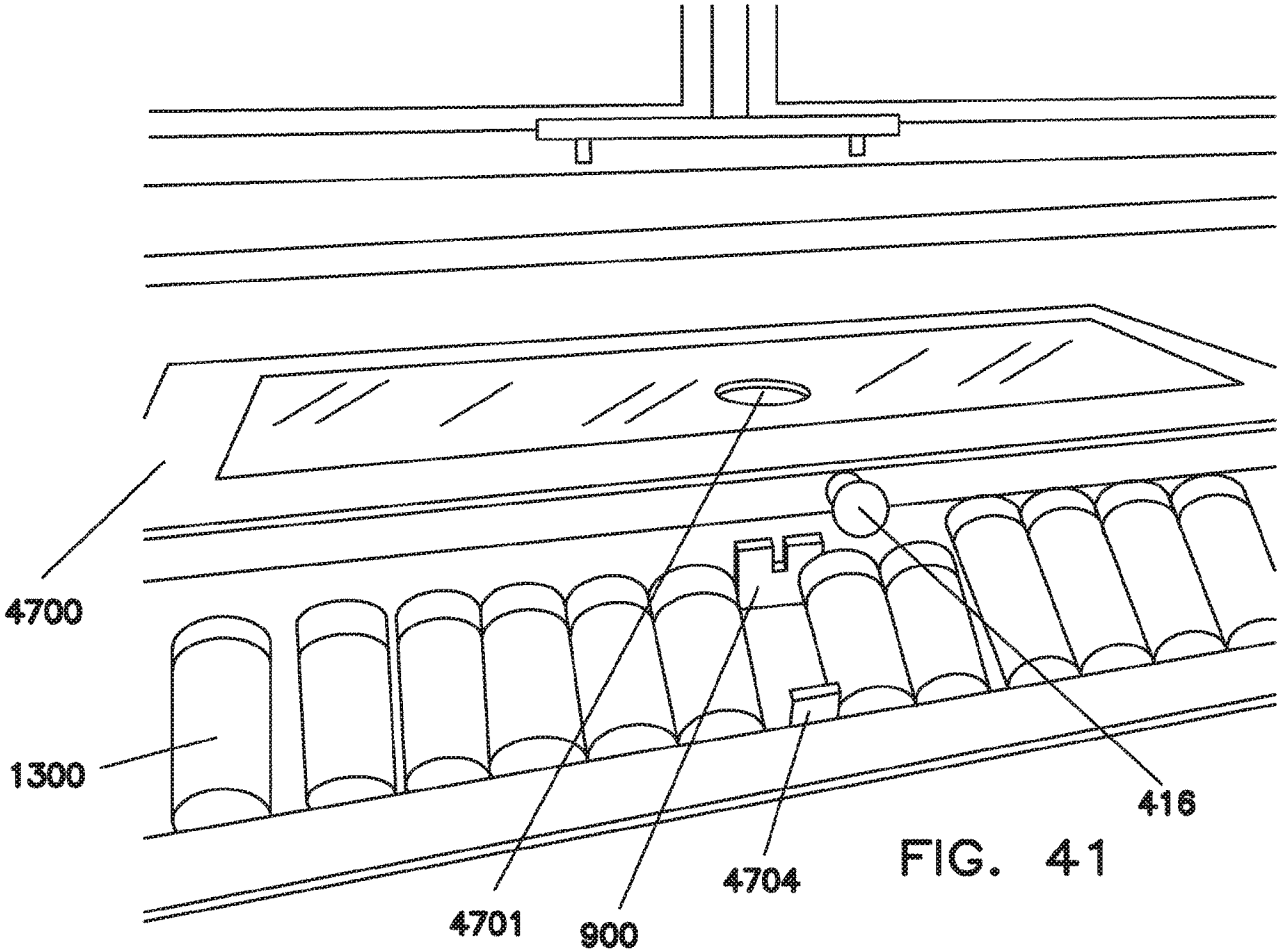
FIG. 41 shows a front perspective view of a rack system in a second access configuration with tray cover in an open configuration, according to an embodiment of the present disclosure.

FIG. 41 shows a front perspective view of an embodiment of a rack system 400 in a second access configuration with tray cover in an open configuration, according to an embodiment of the present disclosure. Tray cover 4700 may be held in a closed position about tray 402 by way of one or more closure mechanisms 4704, as shown in FIG. 41. As shown in FIG. 41, closure mechanism 4704 may include, but is not limited to, a strike plate formed with spring tension that engages a fastener (not shown) holding hardware 416 to the tray cover 4700. Closure mechanisms 4704 of the present disclosure are not intended to be limited only to strike plate formed with spring tension embodiments, as various other closure mechanisms 4704 capable of securing a cover (such as a tray cover 4700) to a receptacle (such as a tray 402) may be within the scope of closure mechanisms 4704 as referenced herein. As referenced above, hinges 4702 may facilitate the opening and closing of tray cover 4700, and closure mechanisms 4704 may be used to secure tray cover 4700 in a closed position.

FIG. 42 shows a view of an embodiment of a rack system 400 in a transition between a second access configuration and a third access configuration, according to an embodiment of the present disclosure. As shown in FIG. 42, rack system 400 has a third access configuration, which corresponds to a rotated configuration of tray 402. For example, and in various embodiments of rack systems 400 of the present disclosure, a tray 402 of a rack system 400 could be extended to a second access configuration (as shown in FIG. 39 and described herein), and then subsequently rotated 180 degrees by way of rotation mechanism(s) 4500 (in a direction shown by the bi-directional arrow C) to reveal the bottom cover 4710 of tray 402, effectively positioning rack system 400 in a third access configuration.

In at least one embodiment of a rack and drawer system 100 according to the present disclosure as shown in FIG. 42, rack system 400 may include a second glider actuator 4904 on both the first side 480 and the second side 480. The second glider actuator 4904 may further assist and control the motion of the glide mechanism 420 as the tray 402 moves from the first to the second access configuration. In at least one embodiment, the second glider actuator 4904 is configured to continue its articulating motion after the first glider actuator 4904 has reached the end of its travel or otherwise stopped its articulating motion.

Figure 43:
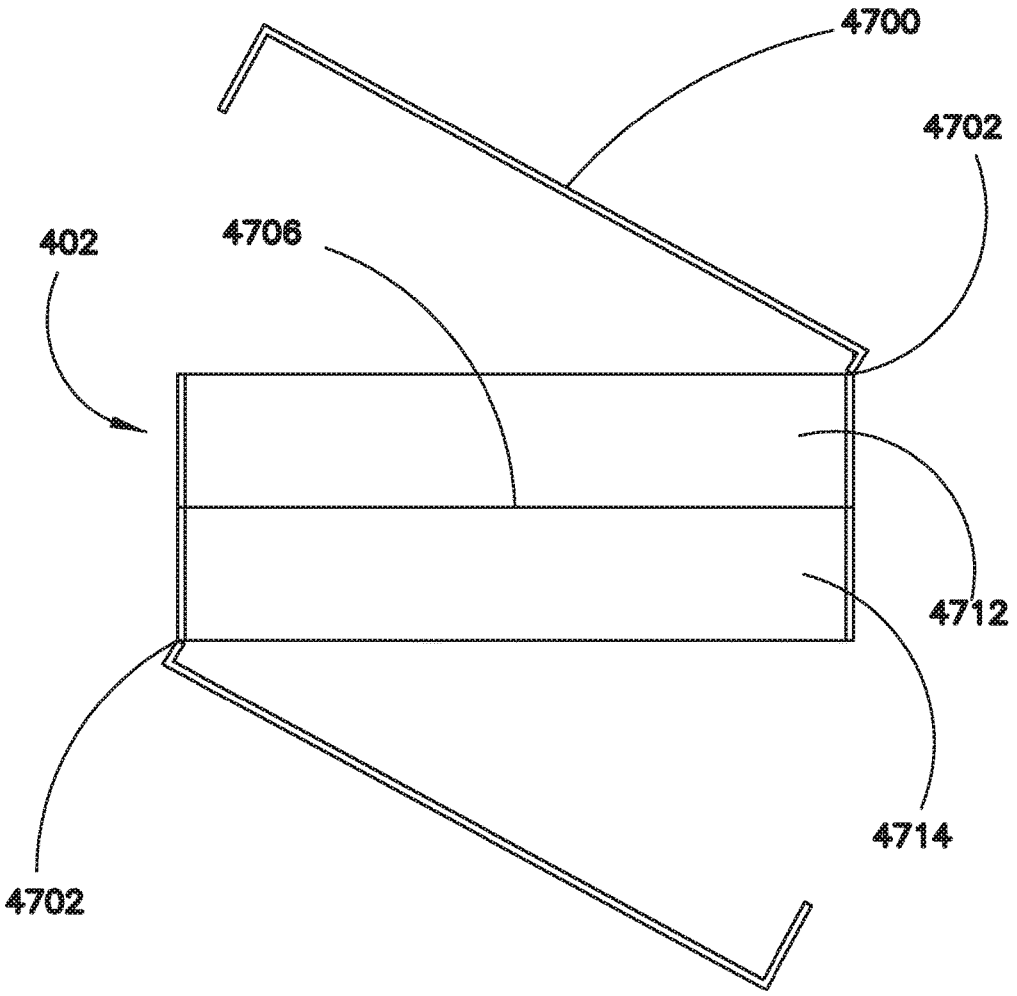
FIG. 43 shows a side view of a two-sided tray rack system, according to an embodiment of the present disclosure.

In at least one embodiment of a rack and drawer system 100 according to the present disclosure as shown in FIG. 43, rack system 400 may include a tray 402 with at least two compartments to receive one or more items: the first compartment 4712 defined by a base panel 4706 (somewhat analogous to a bottom 104 of a tray 102 as otherwise described herein), the tray cover 4700, the first side 480, and the opposing second side 460; the second compartment 4714 defined by the base panel 4706, the bottom cover 4710, the first side 480, and the opposing second side 460. Rotation of tray 402 into a third access configuration of rack system 400 enables easy access to the second compartment 4714, which may include additional storage for the items disclosed herein.

The bottom cover 4710, similar to tray cover 4700, may be coupled to tray 402 by way of hinges 4702 and a closure mechanism 4704, as shown in FIG. 43, and described herein with respect to other embodiments or views of rack systems 100 of the present disclosure. Closure mechanisms 4704, in various embodiments, are configured to either keep tray covers 4700 closed so that any contents of tray 402 (such as spice containers 1300 if used as a spice rack, documents if used for document storage, books if used to store books or provide a platform to hold one or more books, etc.) will not fall out when the tray 402 is rotated about rotation mechanism(s) 4500.

In at least one embodiment according to the present disclosure, rotation of tray 402, performed to move tray 402 from a second access configuration (as shown in FIG. 39) to a third access configuration (as shown in FIG. 43), may be performed by engaging various parts of rack system 400, including, but not limited to, hardware 416 present upon (or engaging) the tray cover 4700 of tray 402 (as shown in FIG. 40), hardware (not shown) present upon (or engaging) other areas of tray 402 (or other components of rack system 400), pockets/apertures formed in various portions of rack system 400, or by merely engaging, pushing, or pulling portions of rack system 400 in various directions. In addition to hardware 416, or as an alternative to hardware 416, rotation of tray may be facilitated by a rotation actuator 1408 coupled to tray 402, for example, as shown in FIG. 14. Rotation actuator 1408, in various embodiments, may be coupled to tray 402 or other components of rack system 400, and may facilitate automated rotation of tray 402 in addition to, or in lieu of, manual rotation.

According to at least one embodiment of the present disclosure as shown in FIG. 39, a rack system 400 may further comprise a lock mechanism 4102, such that tray 402 does not move when a user of rack system 400 does not desire tray 402 to rotate. Similar to the lock mechanism 2100 as shown in FIG. 21A, lock mechanism 4102 may include a spring-loaded pin attached to the side wall bracket 409 that interfaces with a mating aperture in first side 480 or second side 460 of tray 402. The lock mechanism 4102 may be further operable to lock or secure tray 402 in place upon rotation so that tray 102 does not return to its native position until the lock mechanism 4102 is disengaged by a user. The aforementioned embodiments of lock mechanism 4102 of the present disclosure are not intended to define the comprehensive scope of potential lock mechanisms 4102 useful in the present disclosure. For example, other embodiments of lock mechanisms, such as various protrusions, hardware components, etc., could be used of said embodiments are operable to or capable of temporarily locking tray 402 in place before or after rotation.

Various embodiments of rack systems 100 of the present disclosure, as referenced herein, may be coupled to a kitchen wall cabinet (an exemplary external structure 220). Various embodiments of kitchen wall cabinets have a recessed portion underneath, which could be, in various embodiments, 1¼" deep, 1½" deep, ¾" deep, less, or more. Various embodiments of rack systems 100 of the present disclosure could either be provided separately, as component parts, and/or as a system in connection with an external structure 220, such as a cabinet or a shelf, for example. In addition, at least one embodiment of a rack system 100 of the present disclosure would comprise a cushioning member, such as foam, at felt pad, rubber, etc., to provide cushion in the case of impact between one rack system 100 component and another, or a portion of a rack system 100 with an external structure 220 and/or a wall, for example.

Although various embodiments of rack systems 100 are described and shown herein, not all embodiments are labeled with each and every component. It is understood that a component or element of one embodiment of a rack system 100 may apply, and be part of, another embodiment of a rack system 100 of the present disclosure.

Figure 44:
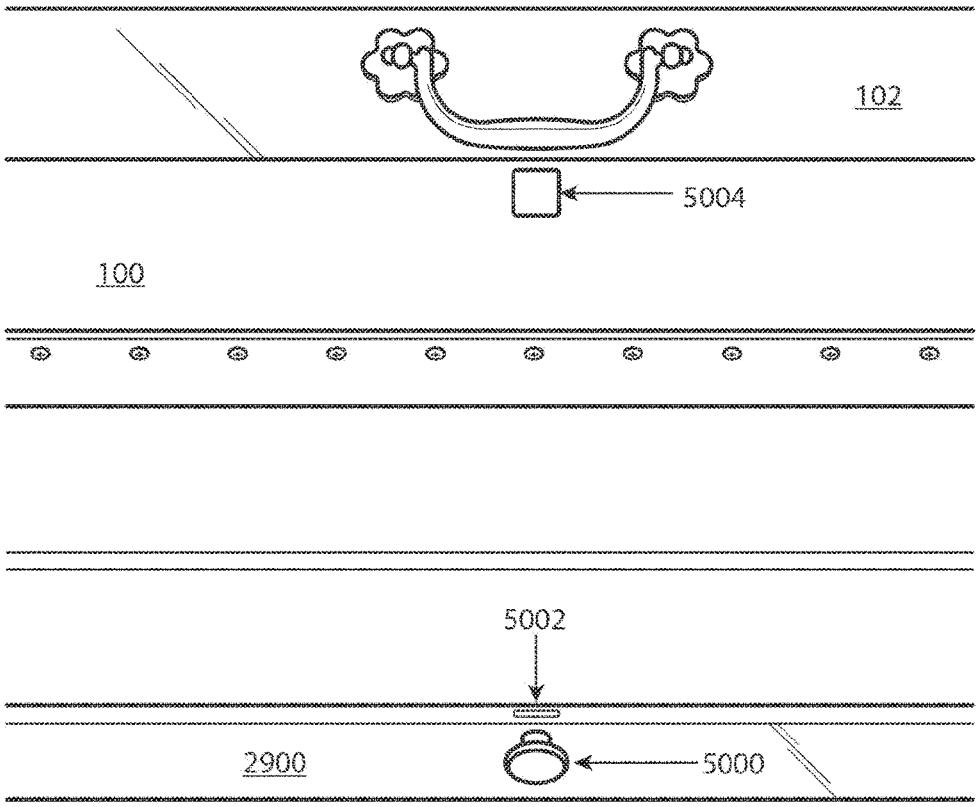
FIG. 44 shows a front open view of a system, according to an embodiment of the present disclosure.

FIG. 44 shows a portion of a two-tray system 100 (or 300, 400) of the present disclosure, such as or similar to those shown in FIGS. 29-33 and/or 35, having a key lock 5000 coupled thereto or incorporated therein. Key lock 5000, as shown in FIG. 44, is coupled to or incorporated into second tray 2900, whereby a key lock latch 5002 of key lock 5000 is configured to engage and disengage a key lock latch 5004 coupled to or incorporated in first tray 102. A key (not shown) can be used to lock and unlock key lock 5000, which can engage and disengage tray 102 from tray 2900. Conversely, key lock 5000 can be coupled to or incorporated into first tray 102, and key lock latch 5004 can be coupled to or incorporated into second tray 2900.

Figure 45:
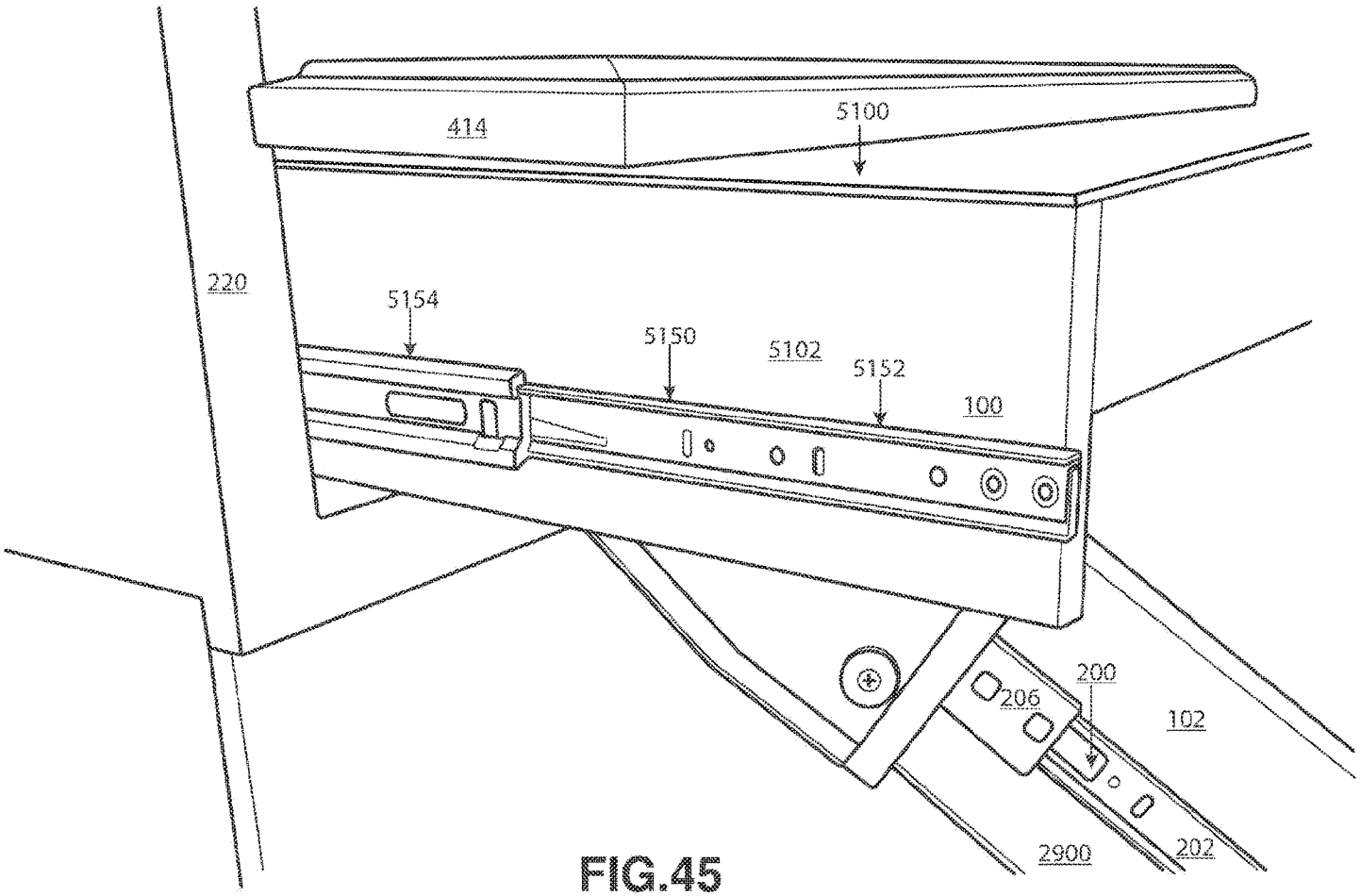
FIG. 45 shows a side perspective view of an open system, according to an embodiment of the present disclosure.

FIG. 45 shows a portion of an exemplary system 100 (or 300 or 400) of the present disclosure, whereby an extension housing 5100 is coupled to an external structure 220 (such as a cabinet) using an extension glider mechanism 5150.

Extension glider mechanism 5150, as shown in FIG. 45 and in at least one embodiment, comprises a extension side wall bracket 5152 and an extension coupler bracket 5154, noting, however, that other extension glider mechanisms 5150 known in the art (such as a glider mechanism 200 otherwise referenced herein) may be used that would allow extension housing 5100 to horizontally extend from external structure 220 in the plane defined by (or the horizontal axis of) external glider mechanism 5150. FIG. 45 shows one extension glider mechanism 5150 on a first side 5102 of extension housing 5100, and in various embodiments two extension glider mechanisms 5150 may be used, such as one on first side 5102 of extension housing 5100 and another on an opposite second side 5104 (shown in FIG. 46) of extension housing 5100. External glider mechanisms 5150, in such embodiments, would be coupled to external structure 220 at one location and further coupled to extension housing 5100 at another location.

Figure 46:
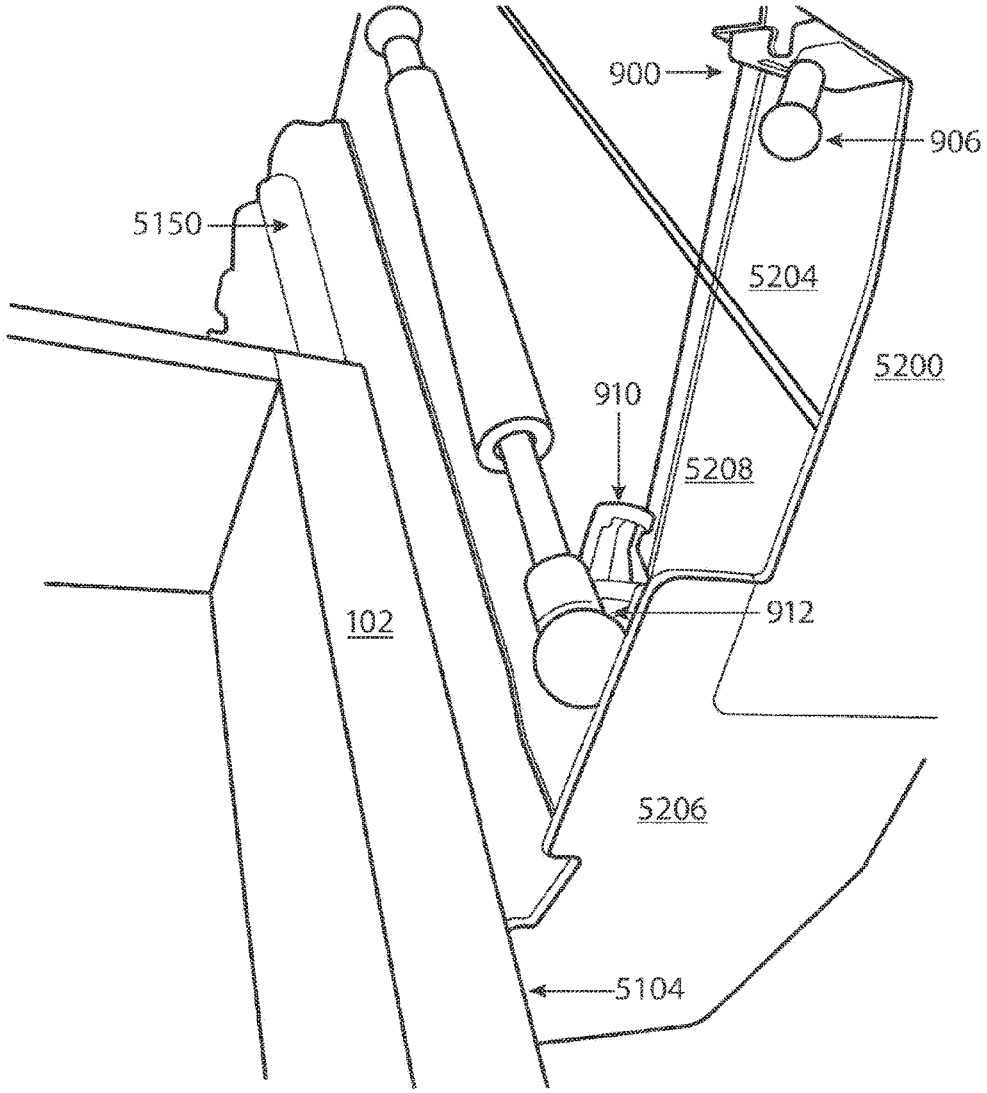
FIG. 46 shows a view of inside components of an exemplary system, according to an embodiment of the present disclosure.

Such a system 100, 300, 400 configuration (shown in FIG. 45) would allow for a user to horizontally extend extension housing 5100 outward from external structure 220, and subsequently allow the user to access the first tray 102 and optional second tray 2900 in a diagonal fashion (relatively downward and outward even further) as shown therein, by way of glider mechanism 200 (such as a glider mechanism 200 having a side wall bracket 202 and a coupler bracket 206). Procedurally, a user may access extension housing 5100 initially (or by way of opening cover plate 414, for example), by pulling extension housing 5100 out horizontally. First tray 102 and optional second tray 2900 may be accessed by either pulling one or both of trays 102, 2900 downward and/or outward, or, for example, by pushing one or both of trays 102, 2900 slightly upward so to disengage latch mechanism 900, as shown in FIG. 46. Latch mechanism 900, as shown therein, is positioned within extension housing 5100 and a first part of latch mechanism 900 (such as latch member 904) is coupled to extension housing 5100 or a component coupled thereto, and a second part of latch mechanism 900 (such as arms 910, 912) are coupled to one of trays 102 or 2900 or a component coupled thereto. In this fashion, trays 102, 2900 can be extended downward and toward the user after the latch mechanism is disengaged. When the user is finished accessing trays 102, 2900, the user can push one or both of trays 102, 2900 back and up (at an angle, for example), and then push one or both of trays 102, 2900 up so that latch mechanism 900 can engage and hold trays 102, 2900 in place within extension housing 5100.

FIG. 46 also shows a portion of glider mechanism 200 (such as coupler bracket 206) that is ultimately connected to extension housing 5100 as described in further detail herein. FIG. 46 also shows additional componentry of an exemplary system 100, 300, 400 of the present disclosure, including a glider actuator 4904 as generally referenced herein, as well as a finger guard 5200 which, as shown in FIG. 46, comprises a first guard shield 5202 coupled to a first guard portion 5204, and a second guard shield 5206 coupled to a second guard portion 5208. First guard shield 5202 and second guard shield 5206, as shown in FIG. 46, face the user and provide some general aesthetic covering of other components within system 100, 300, 400 and also help to protect the user against potentially pinching his or her fingers within system 100, 300, 400. First guard shield 5202 and second guard shield 5206, as shown in FIG. 46, can partially or fully overlap one another, so that as first tray 102 and second tray 2900 are extended from one another, first guard shield 5202 and second guard shield 5206 generally block the space behind said shields 5202, 5206 from the user. Similarly, first guard portion 5204 and second guard portion 5208, as shown in FIG. 46, can partially or fully overlap one another, so that as first tray 102 and second tray 2900 are extended from one another, first guard portion 5204 and second guard portion 5208 generally protect a user from pinching his or her fingers from the relative sides of system 100, 300, 400.

In at least one embodiment, first guard shield 5202 is coupled to first guard portion 5204, whereby either or both of first guard shield 5202 and/or first guard portion 5204 is/are coupled to first tray 102 or a component coupled thereto. Similarly, and in at least one embodiment, second guard shield 5206 is coupled to second guard portion 5208, whereby either or both of second guard shield 5206 and/or second guard portion 5208 is/are coupled to second tray 2900 or a component coupled thereto. In various embodiments, systems 100, 300, 400 may have finger guards 5200 on either side of system, such as at or near first side 106 and second side 108 of first tray 102.

Finger guard components 5200 can comprise metal, Plexiglas, wood, other plastics, or other materials suitable to guard and/or protect a user as described herein. For example, and as shown in the embodiment shown FIG. 46, first guard shield 5202 and second guard shield 5206 comprise metal, and first guard portion 5204 and second guard portion 5208 comprise Plexiglas.

Figure 47:
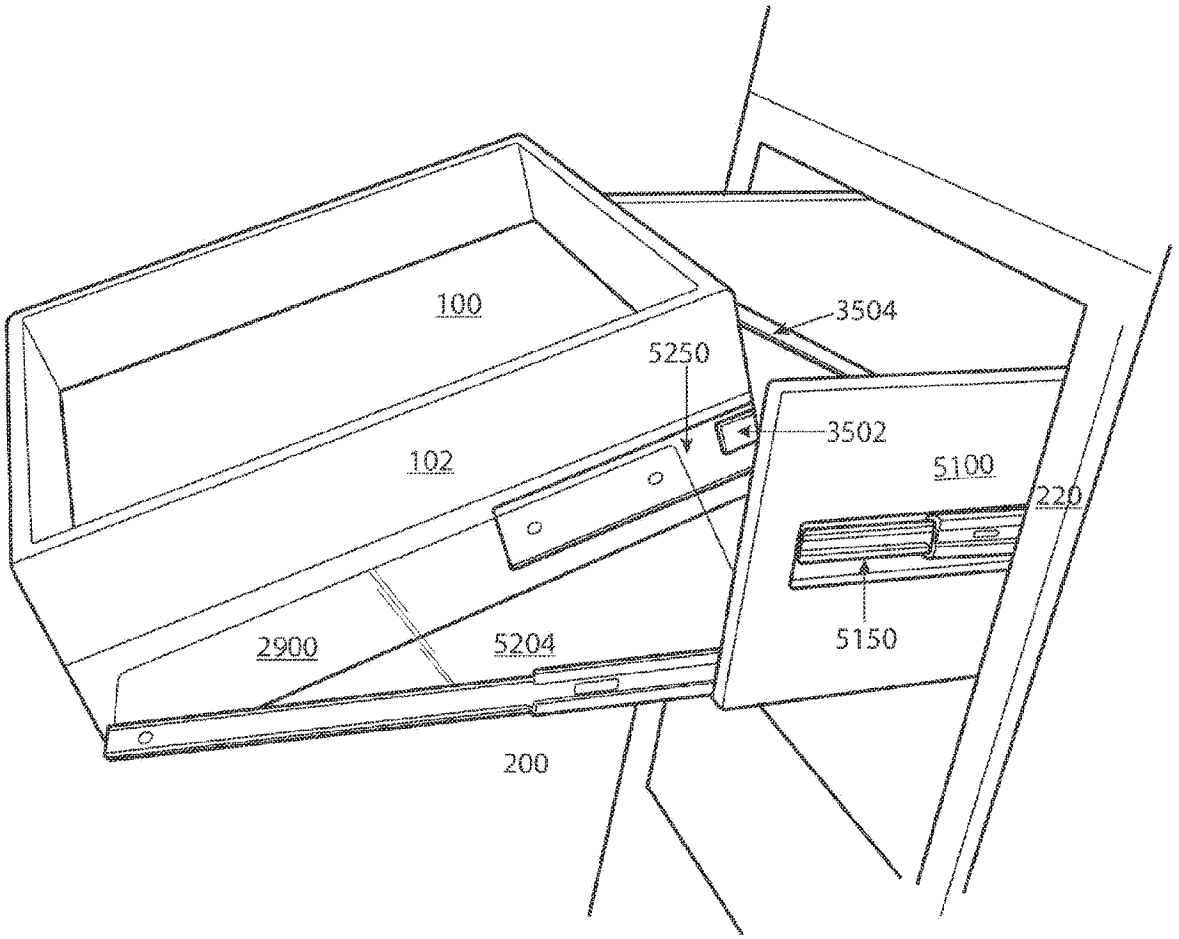
FIGS. 47 and 48 show side perspective views of open systems, according to embodiments of the present disclosure.
Figure 51:
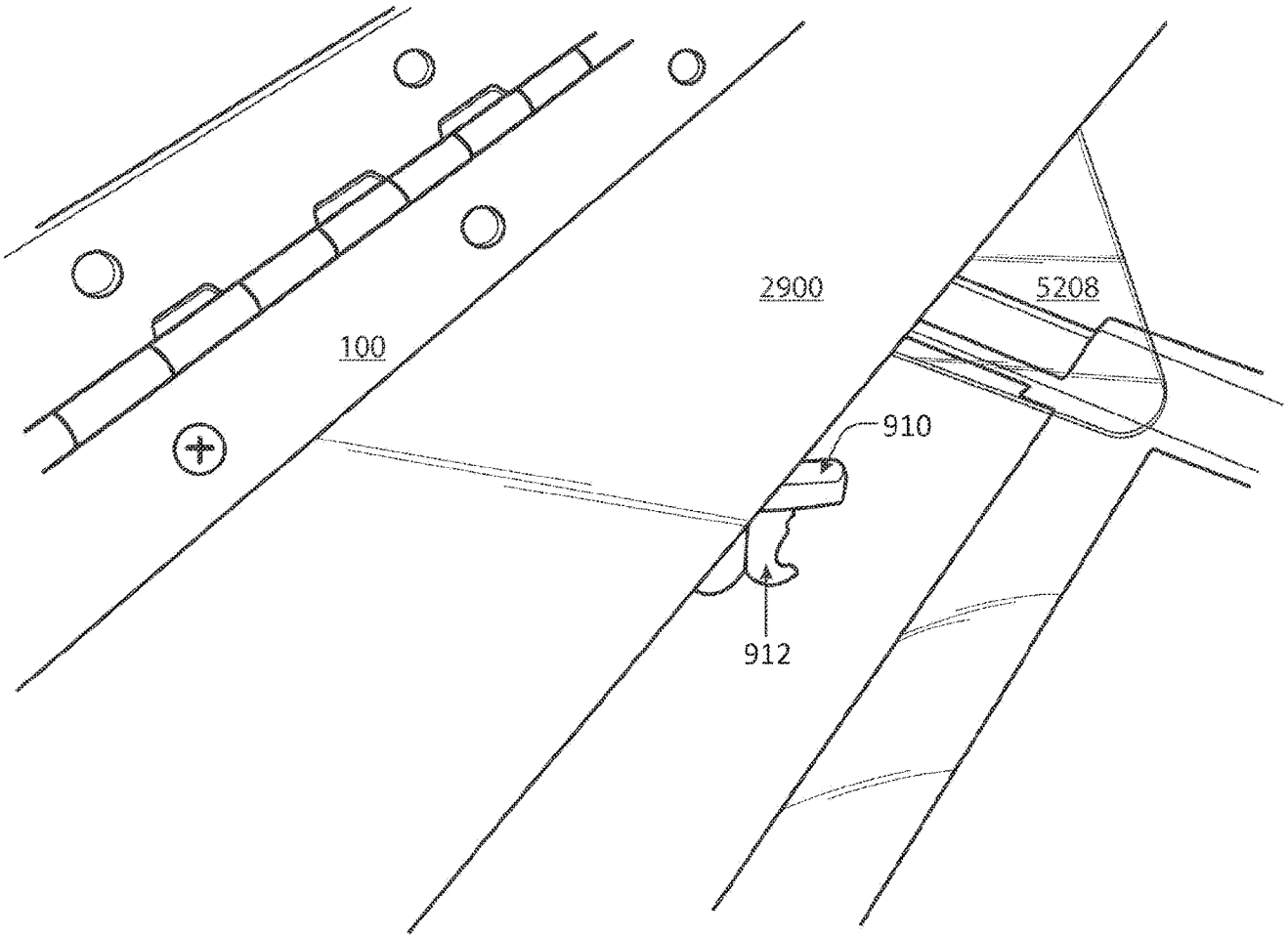

FIG. 47 shows a side perspective view of an exemplary system 100 (or 300, 400) of the present disclosure, comprising an extension housing 5100 having an extension glider mechanism 5150 on both relative sides of extension housing 5100 (with one glider mechanism 5150 shown in the figure) and a glider mechanism 200 on both relatives sides of second tray 2900 (with one glider mechanism 200 shown in the figure). Glider mechanisms 5150 would be coupled to extension housing 5100 and external structure 220 so to allow extension housing 5100 to move in and out horizontally relative to external structure 220. Glider mechanisms 200 would be coupled to extension housing 5100 and second tray 2900 to allow first tray 102 and second tray 2900 to extend in and out horizontally relative to extension housing, while allowing a back portion of trays 102, 2900 to also move upward as trays 102, 2900 are pulled toward the user from external structure 220. A first guard portion 5204, as shown in FIG. 47, may also be used in such an embodiment, so to generally protect a user's fingers from being pinched between second tray 2900 and glider mechanism 200, for example. Additional guard portion(s) 5204 (as shown in FIG. 47) and/or 5208 (as shown in FIG. 51) may be used on the same side as shown in FIG. 47 and/or the opposite side (as shown in FIG. 51).

As noted above, the relative back of trays 102, 2900 may move upward as trays 102, 2900 are pulled out horizontally, which in various embodiments is due to the movement of at least one cam mechanism 3502 within at least one cam channel 3504 (also referred to herein as a "guide channel"). For example, a cam mechanism 3502 (partially shown in FIG. 47 and also partially shown in FIG. 48), which can be directly coupled to second tray 2900 or coupled to an optional cam bracket 5250 as shown in FIG. 47 which itself is coupled to second tray 2900, and cam mechanism 3502 can rotate within cam channel 3504, as partially shown in FIGS. 47 and 49, so to accomplish the desired tray 102, 2900 movement.

Figure 48:
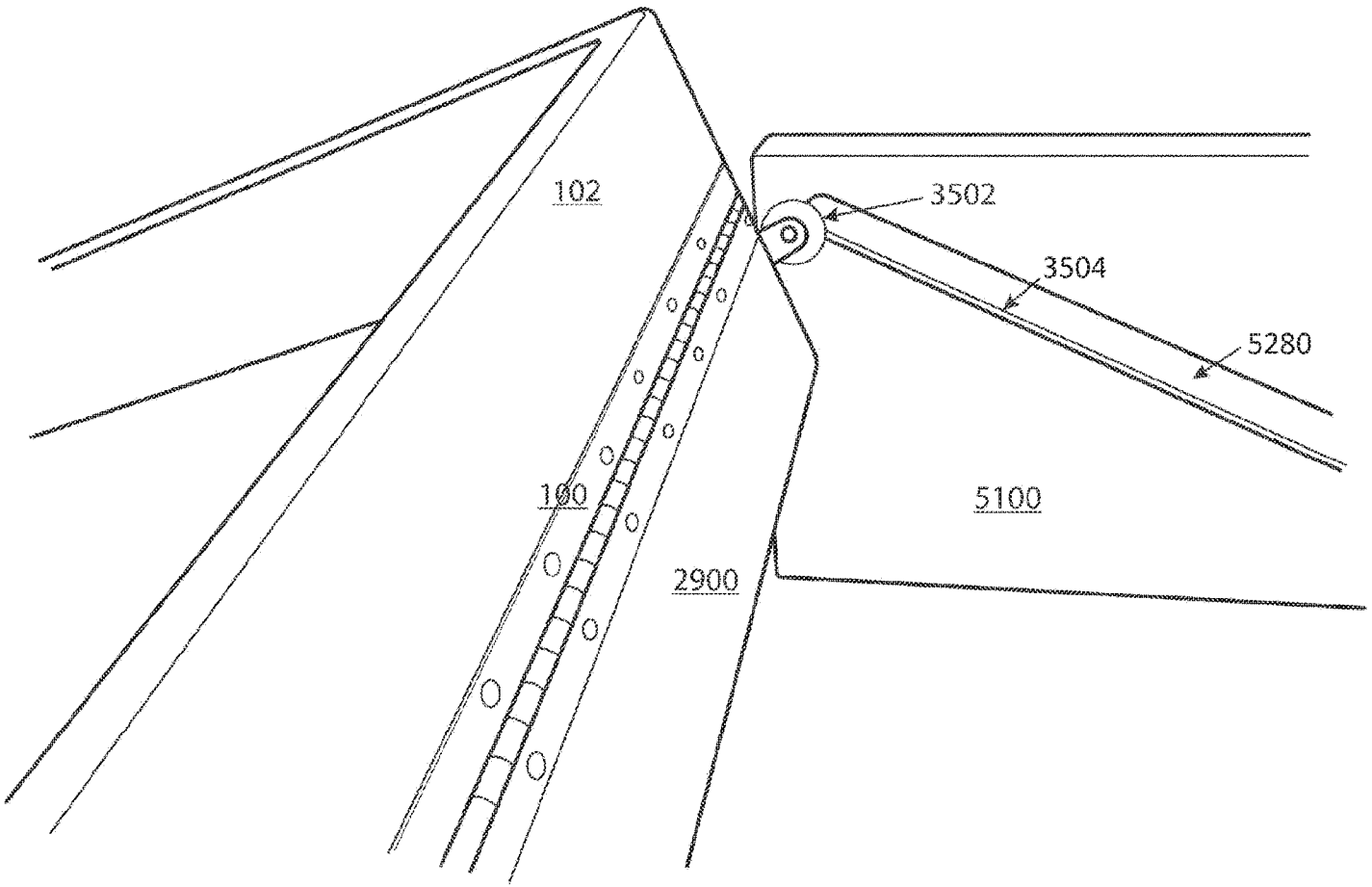
Figure 49:
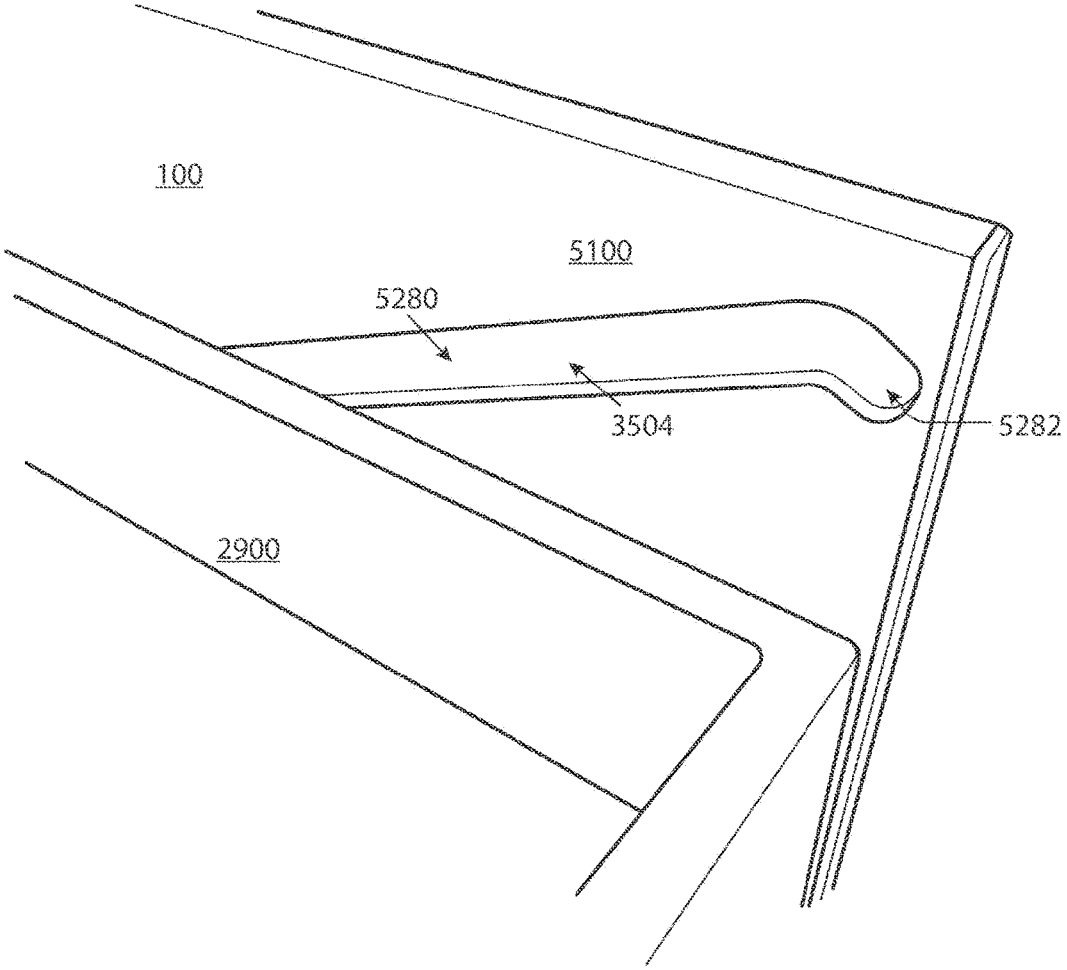
FIGS. 49, 50, and 51 show perspective views of parts of systems, according to embodiments of the present disclosure.

FIGS. 48 and 49 show portions of cam channels 3504 therein, with cam channels 3504 having a diagonal portion 5280 and a resting portion 5282 (shown in FIG. 49), so that when cam mechanism 3502 (shown in FIG. 48) moves from the rear lower portion of cam channel 3504 to an front upper portion of cam channel 3504, cam mechanism 3502 can rest within resting portion 5282 as shown in FIG. 48. Trays 102, 2900 can then remain in place until a user decides to push on said trays 102, 2900 to cause cam mechanism 3502 to move from resting portion 5282 of cam channel 3504 and down diagonal portion 5280 of cam channel 3504 as trays 102, 2900 are positioned back within extension housing 5100.

Figure 50:
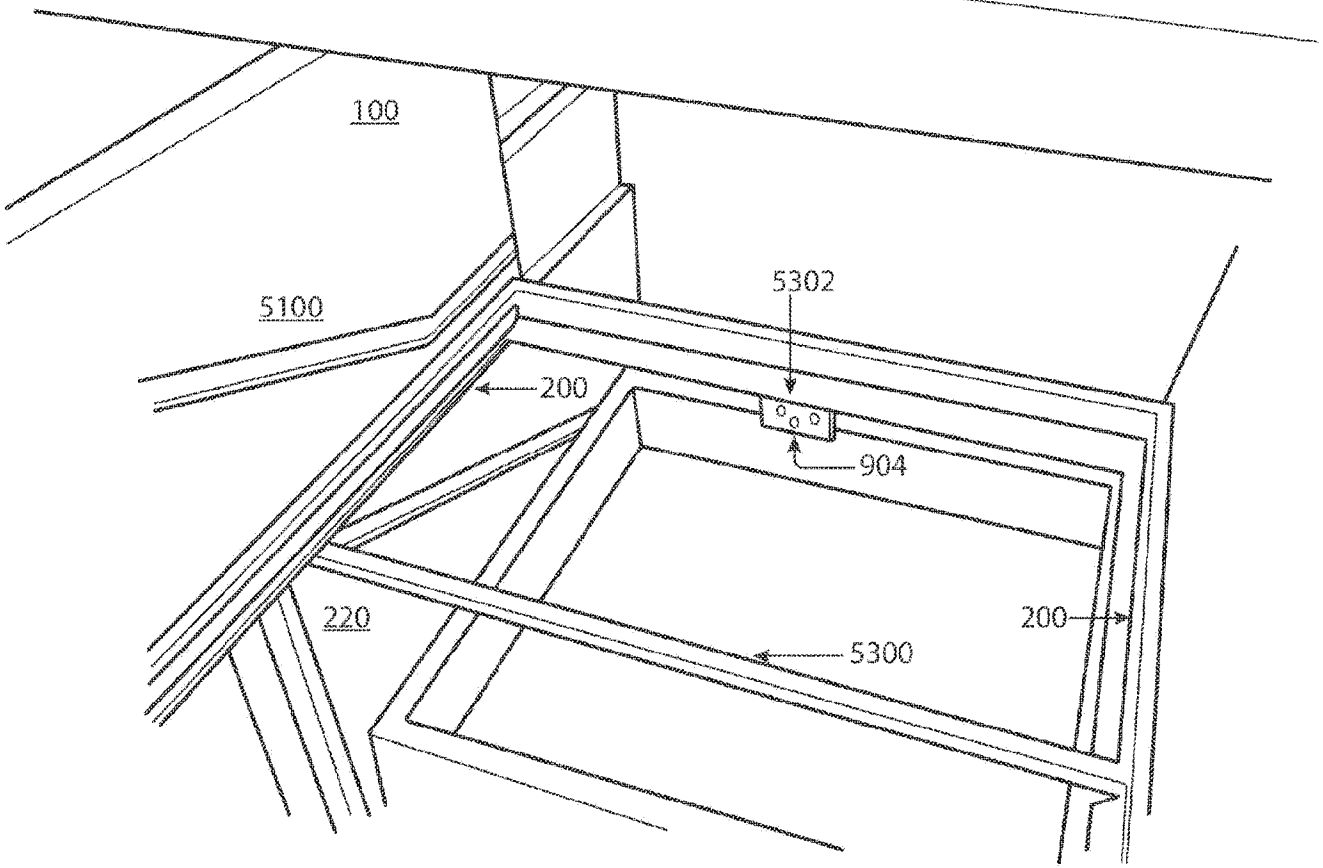

As shown in FIGS. 47-49 and generally referenced above, extension housing 5100 comprises two sides (such as first side 5102 and second side 5104 generally referenced herein), and may optionally include additional componentry coupled thereto or coupled to glider mechanisms 200, for example. For example, and as shown in FIG. 50, system 100 (or 300, 400) comprises two glider mechanisms 200, each coupled to a portion of extension housing 5100. As shown therein, one or more central braces 5300 may be coupled to extension housing 5100 and/or coupled to glider mechanism(s) 200, so to provide additional general support of system 100, 300, 400. Furthermore, an optional rear brace 5302 may also be coupled to extension housing 5100 and/or coupled to glider mechanism(s) 200, as shown in FIG. 50, so to provide additional general support of system 100, 300, 400.

In addition, and in at least certain embodiments, a latch mechanism 900 may be used to secure tray 2900, for example, to extension housing 5100. For example, and as shown in FIG. 50, a latch member 904 (part of an exemplary latch mechanism 900 as generally referenced herein) is coupled to a rear brace 5302, which itself is coupled to extension housing 5100. Latch member 904 can be engaged by another part of an exemplary latch mechanism 900, such as arms 910, 912, which are shown coupled to the bottom rear of tray 2900 in FIG. 51. Using such a latch mechanism 900, for example, a user can pull one or both of trays 102, 2900 horizontally outward, which would also cause extension housing 5100 to move horizontally outward with trays 102, 2900. After extension housing 5100 is fully extended outward, a user can push on one or both of trays 102, 2900, causing latch mechanism 900 to release, allowing the user to pull trays 102, 2900 outward from extension housing 5100. When the user is finished accessing trays 102, 2900, the user can push said trays 102, 2900 back in place, causing latch mechanism 900 to close (and to secure tray 2900 to rear brace 5302 by way of latch mechanism), and to then allow trays 102, 2900 and extension housing 5100 to be pushed back into external structure 220, for example.

Figure 52:
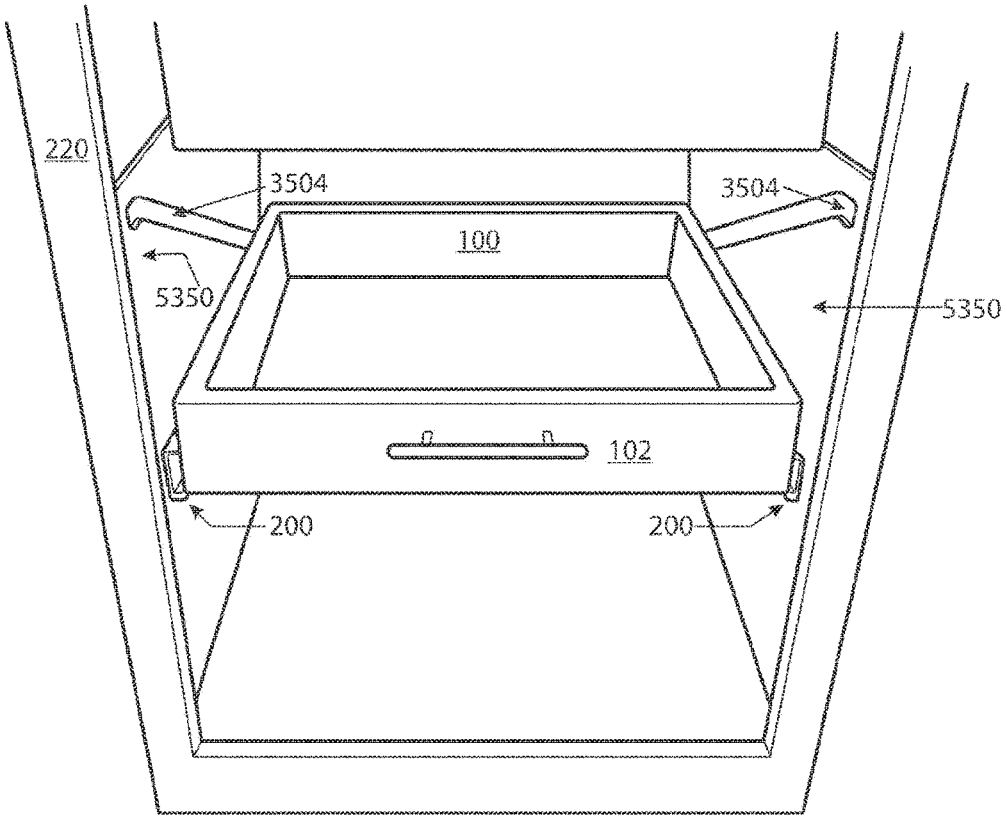
FIG. 52 shows a front perspective view of a closed system, according to an embodiment of the present disclosure.
Figure 53:
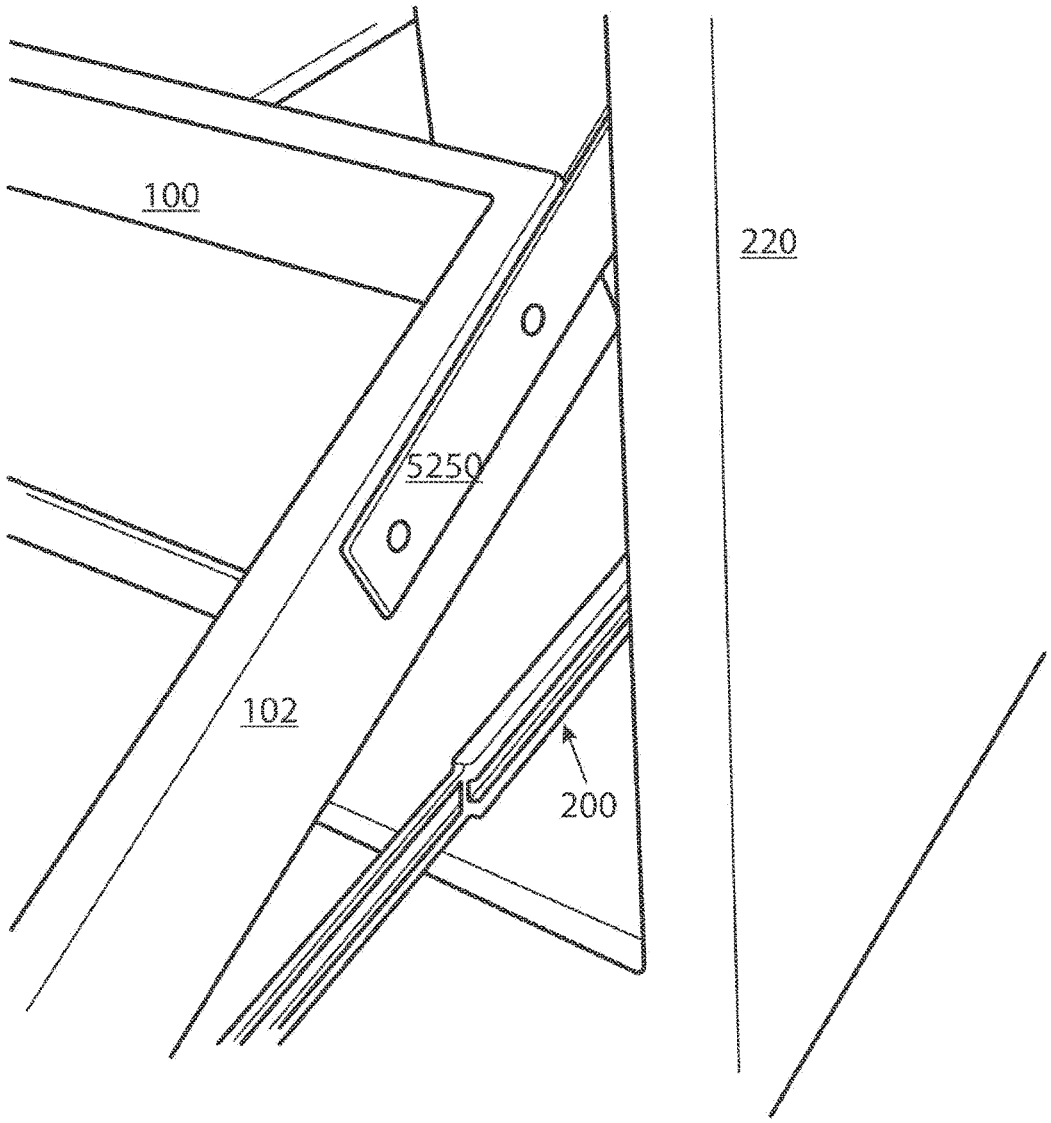
FIG. 53 shows a side perspective view of part of an open system, according to an embodiment of the present disclosure.

Yet another embodiment of a system 100 (or 300, 400) of the present disclosure is shown in FIGS. 52 and 53. As shown therein, system 100 comprises at least one tray (such as tray 102), which is configured to extend outward from external structure 220 as desired so to provide the user with access to tray 102, for example, as desired. FIG. 52 shows tray 102 as being recessed within external structure 220, while FIG. 53 shows tray 102 extended from external structure 220. As shown in FIG. 52, an exemplary embodiment of system 100 comprises two glider mechanisms 200 that are coupled to tray 102 and to external structure 220 (or to backer plates 5350 shown therein and discussed in further detail herein), so to provide the horizontal movement in and out of external structure 220. Guide channels 3504, as shown therein, can be defined within external structure 220 (as referenced in various embodiments herein, or can be defined within a backer plates 5350 coupled to external structure 220), as shown in FIG. 52. Embodiments using backer plates 5350, for example, allow exemplary systems 100, 300, 400 to be installed within existing cabinetry (external structures 220) without requiring said cabinetry to be replaced. Other embodiments of systems 100, 300, 400 of the present disclosure may also fit below existing cabinetry and not require backer plates 5350, for example.

As shown in FIG. 53, an embodiment of system 100 is configured to allow tray 102 (along with an optional second tray 2900, not shown FIG. 52 but otherwise referenced herein), to extend from external structure 220 so that the tray 102 extends outward from external structure 220 and so that the relative back of the tray 102 goes upward as it extends, providing the user with easy access to contents of said tray 102 as tray 102 would then be angled conveniently for the user. As generally discussed herein, said out and up motion is due to the combination of glider mechanisms 200 and cam mechanisms 3502. For the embodiment of system 100 (or 300, 400) shown in FIG. 52, each glider mechanism 200 is coupled to tray 102 and to external structure 220 (or backer plate 5350 coupled thereto, as shown in FIG. 52), and each cam mechanism 3502 is coupled to tray 102 (or to a cam bracket 5250, as shown in FIG. 53) and configured to fit within guide channel 3504 defined within external structure 220 (or backer plate 5350 coupled thereto, as shown in FIG. 52. Such a configuration allows the tray 102 to move in and up (providing access) and back and down (to store the same within external structure 220).

Figure 54A:
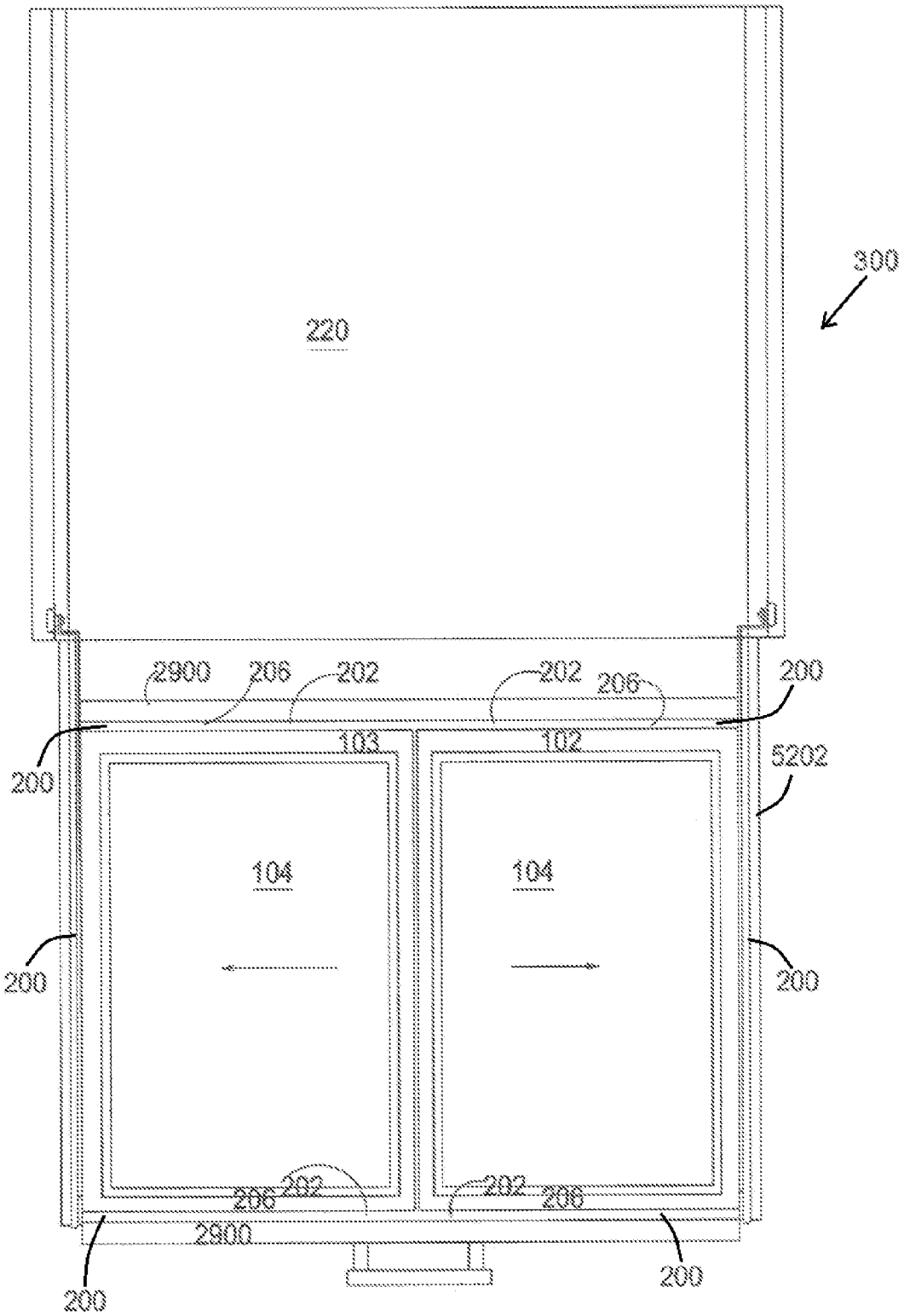
FIG. 54A shows a top view of a partially open system.
Figure 54B:
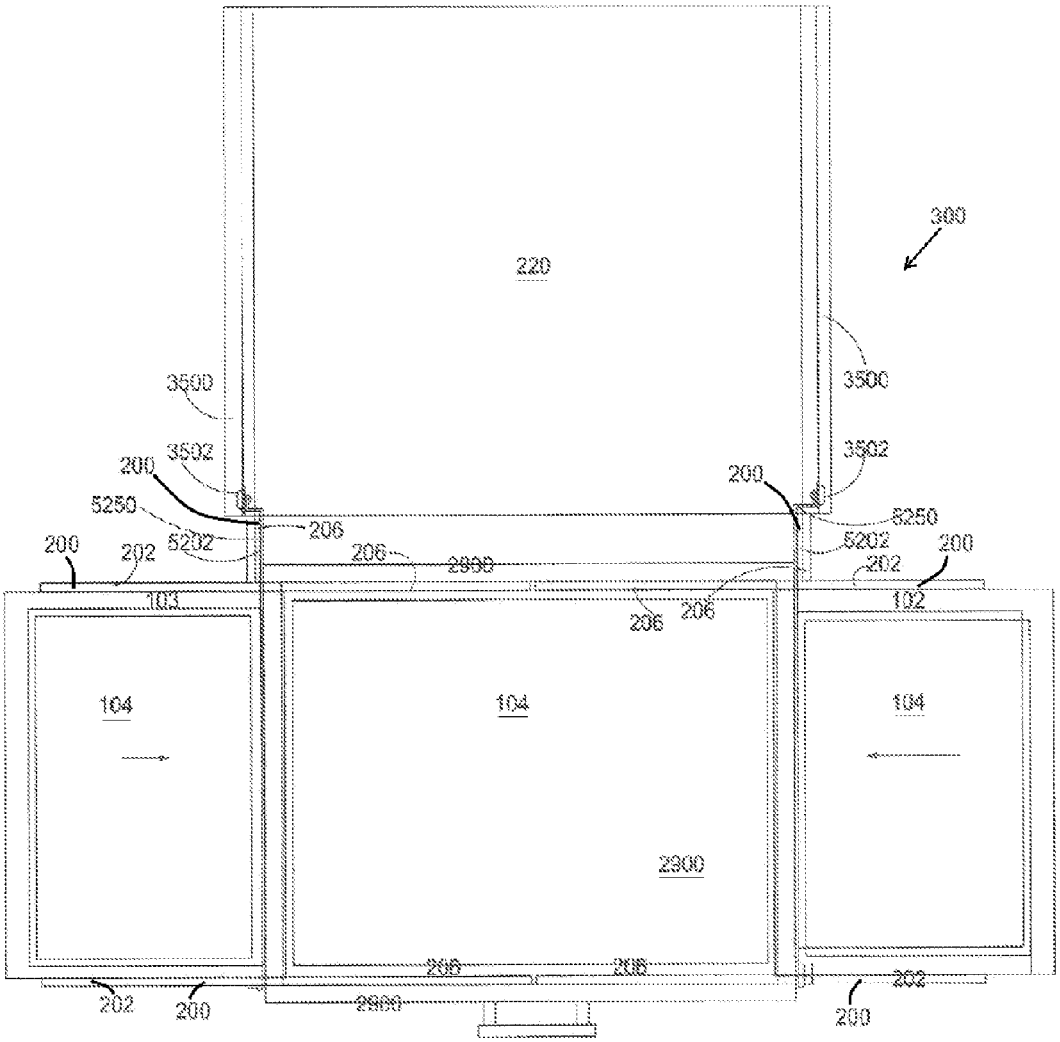
FIG. 54B shows a top view of a fully open system, according to an embodiment of the present disclosure.
Figure 54C:
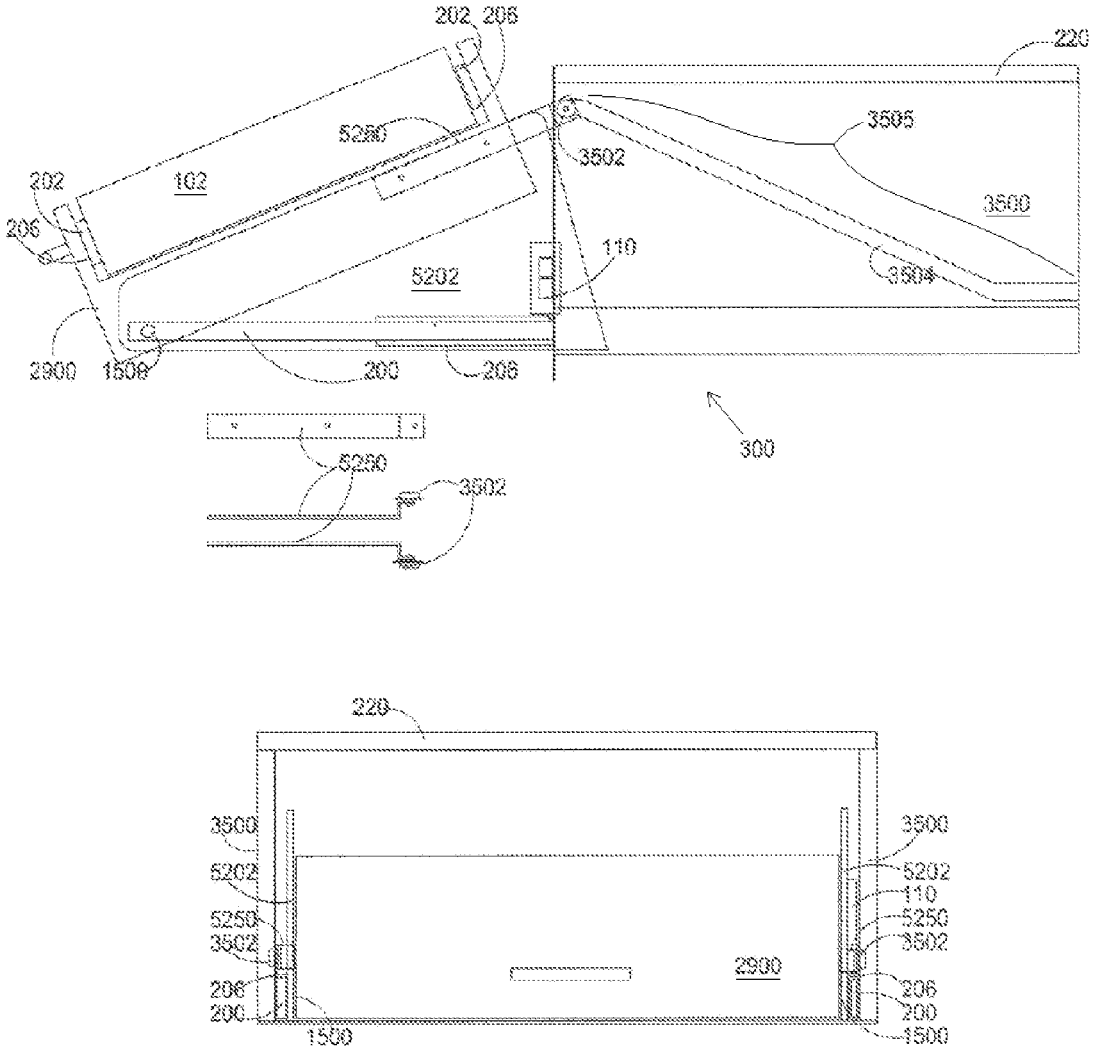
FIG. 54C shows a side view (upper portion of figure) and a front view (lower portion of figure) of a system, according to an embodiment of the present disclosure.

In various embodiments, and as shown in one or more of FIGS. 54A, 54B, and/or 54C, rack system 300 may further comprise at least one cam mechanism 3502, at least one guide channel 3504, and a support box 3500, each such as shown in FIG. 54C, and optionally at least one tilt actuator 3604, such as previously referenced herein. The cam mechanism 3502 may be positioned at the relative back of the second tray 2900 and positioned such that cam mechanism 3502 moves within, along, or through the guide channel 3504. The guide channel 3504 may be formed in the side wall of the support box 3500 or the external structure 220, either of which may support the glide mechanism hardware for the second tray 2900, including the side wall bracket 202, the coupler bracket 206, and the tilt actuator 3604. Moreover, the guide channel 3504 may be formed to engage the cam mechanism 3502 and enable the rack system 300. Furthermore, the guide channel 3504 may be formed to enable the rack system 300 to move parallel to the ground initially but to tilt the relative front edge of the first tray 2900 downward as the first tray 2900 reaches the end of its travel/movement, thereby positioning the rack system 300 in an approximate 35 degree angle (or greater or lesser of an angle) at its extended point of travel. Guard shield 5202 is a guard panel that that moves along with first tray 2900 and tray 102 thus protecting against pinching.

The terms extension housing 5100 and support box 3500 are used interchangeably herein, and can refer to the same portion of an exemplary system 100, 300, 400 of the present disclosure.

FIGS. 54A and 54B show top views of a portion of a rack system 300, according to embodiments of the present disclosure, the upper portion of FIG. 54C shows a side view, and the lower portion FIG. 54C shows a front view. As shown in FIG. 54B, the guide channel 3504 may be angled upward along its length 3505 relative to the ground to enable the tilting motion described.

In operation, according to one embodiment of the present disclosure, when the rack system 300 is at it full point of travel, the mechanism 3502 angles upward relative to the ground, the relative front edge of the second tray 2900 tilts downward as the tray 2900 reaches the end of its travel, pivoting about the at least one rotation mechanism 1500. First tray 102 has been split, creating tray 103 as shown in FIG. 54B. Trays 102 and 103 are attached to coupler bracket 202 and 206. Trays 102 and 103 are positioned relative to second tray 2900. Trays 102 and 103 can be coupled to opposing brackets 206 enable trays 102 and 103 to move in opposite sideways directions relative to tray 2900, such as indicated by the sideways arrows in FIG. 54B. Access to second tray 2900 is allowed in the space below trays 102 and 103. Inside second tray 2900 and first tray 102 and 103 is a removable tray 104, as well as a finger guard shield 5202 which is shown in FIG. 54C. Guard shield 5202 moves in conjunction with coupler mechanism 202 and 206 on left side of the tray. Finger guard shield 5202 moves in conjunction with coupler mechanism 202 and 206 on the right side (and/or on the left side) in at least one embodiment. A locking mechanism 110 can mounted on finger guard shield 5202. When rack system 300 is at its full point of travel, locking mechanism 110 can lock to coupler 206. Such embodiments may include one or more additional features of the rack systems 100, 300, 400 of the present disclosure other than those shown herein.

Figure 55A:
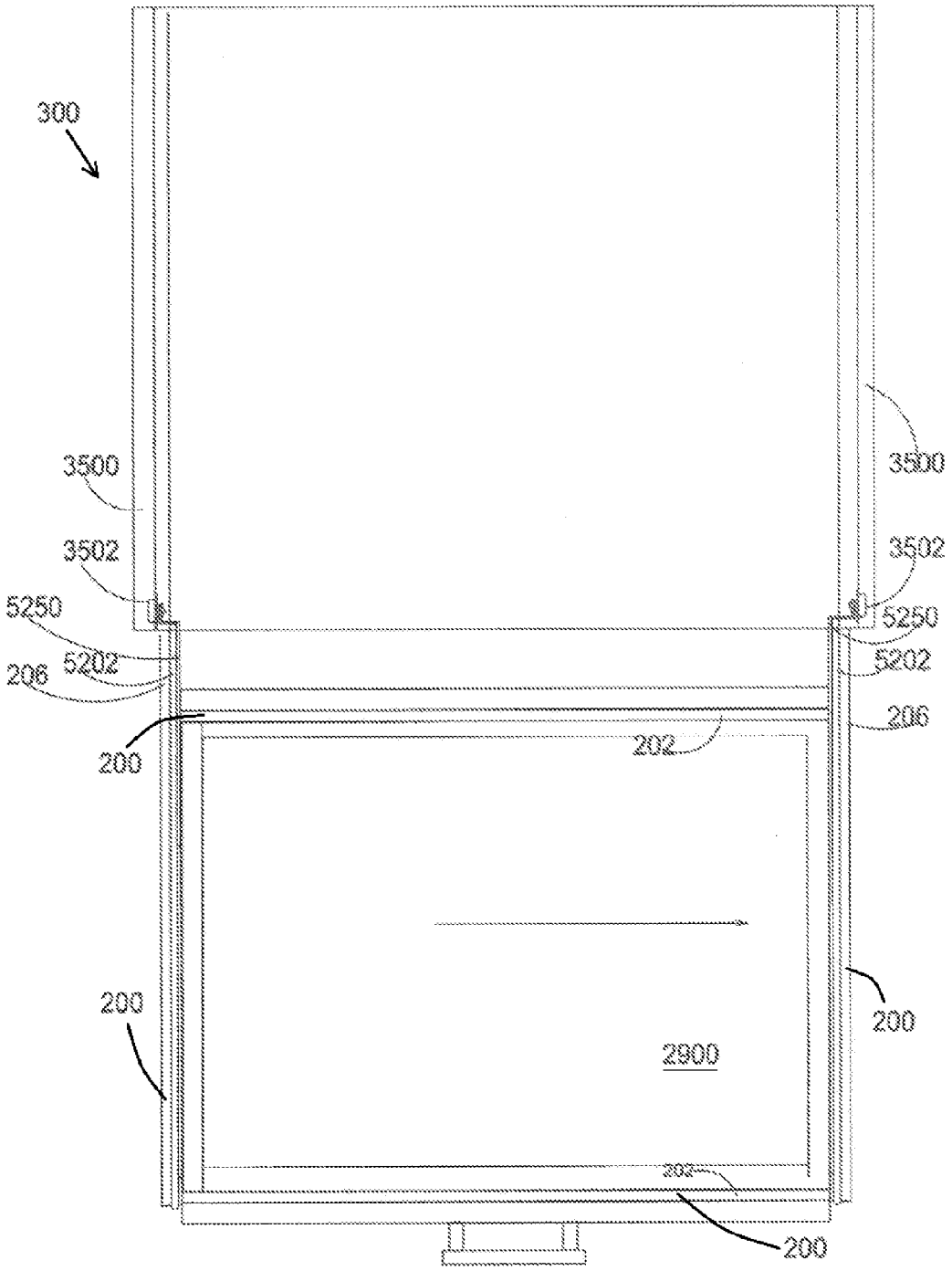
FIG. 55A shows a top view of a partially open system.
Figure 55B:
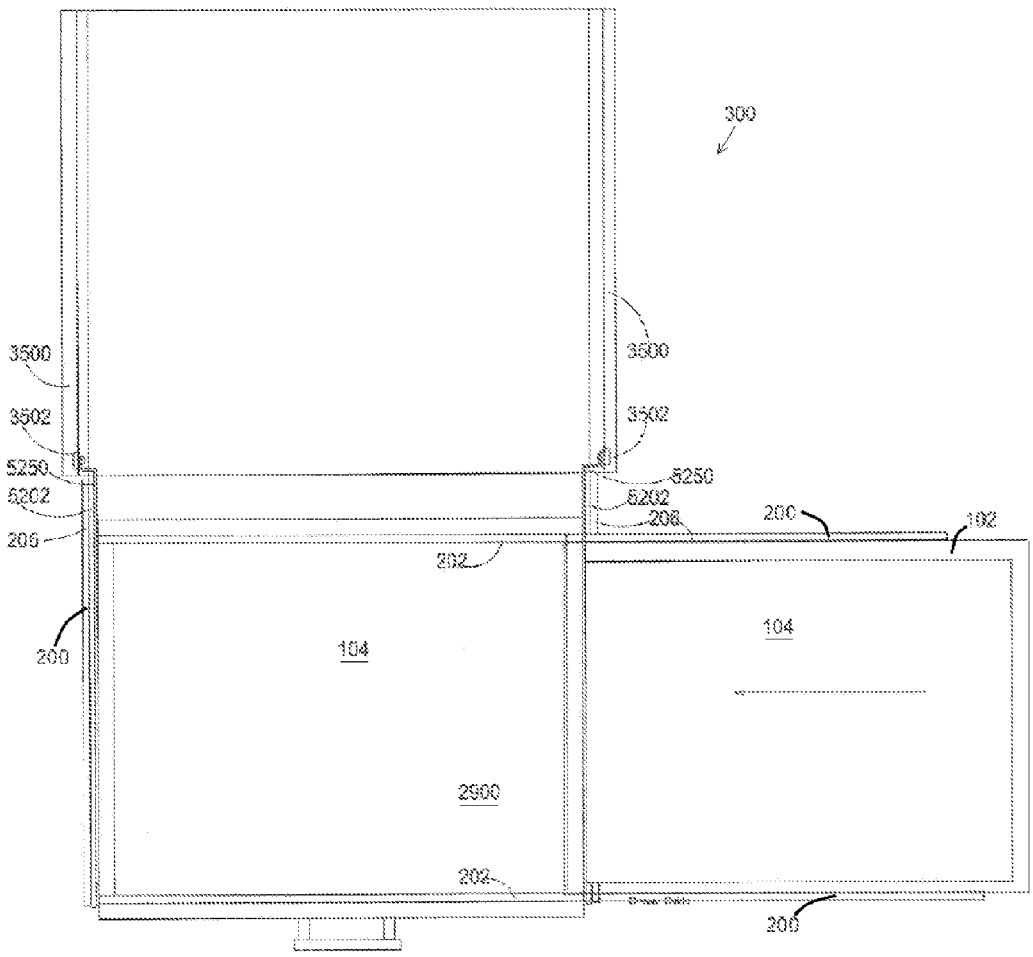
FIG. 55B shows a top view of a fully open system, according to an embodiment of the present disclosure.
Figure 55C:
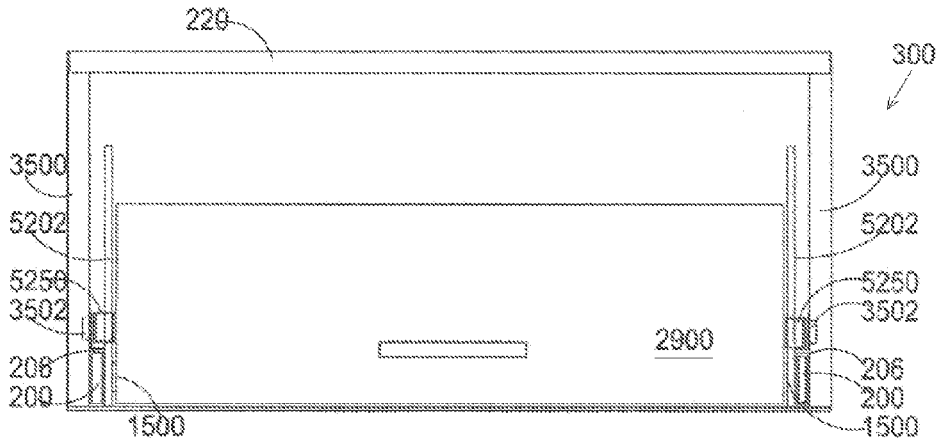
FIG. 55C shows a front view.

In various embodiments, and as shown in one or more of FIGS. 55A, 55B, 55C, and/or 55D, rack system 300 may further comprise at least one cam mechanism 3502, at least one guide channel 3504, and a support box 3500, such as shown in FIG. 55C, and optionally at least one tilt actuator 3604, such as previously referenced herein. The cam mechanism 3502 may be positioned at the relative back of the second tray 2900 and positioned such that cam mechanism 3502 moves within, along, or through the guide channel 3504. The guide channel 3504 may be formed in the side wall of the support box 3500 or the external structure 220, either of which may support the glide mechanism hardware for the second tray 2900, including the side wall bracket 202, the coupler bracket 206, and the tilt actuator 3604. Moreover, the guide channel 3504 may be formed to engage the cam mechanism 3502 and enable the rack system 300 to move parallel to the ground initially but to tilt the relative front edge of the first tray 2900 downward as the first tray 2900 reaches the end of its travel, thereby positioning the rack system 300 in an approximate 35 degree angle (or greater or lesser of an angle) at its extend point of travel.

Figure 55D:
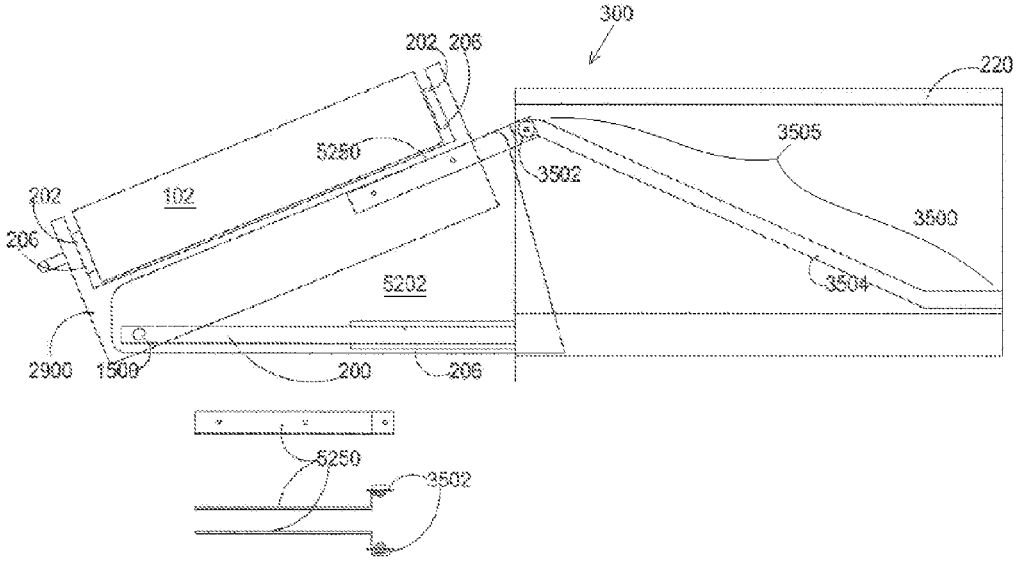
FIG. 55D shows a side view of a system, according to embodiments of the present disclosure.

FIGS. 55A and 55B show top views of a portion of a rack system 300, according to embodiments of the present disclosure, FIG. 55C shows a front view, and FIG. 55D shows a side view. As shown in FIG. 54C, the guide channel 3504 may be angled upward along its length 3505 relative to the ground to enable the tilting motion described.

As shown in FIG. 55C, in operation according to one embodiment of the present disclosure, when the rack system 300 is at it full point of travel, the mechanism 3502 angles upward relative to the ground, the relative front edge of the second tray 2900 tilts downward as the tray 2900 reaches the end of its travel, pivoting about the at least one rotation mechanism 1500. Tray 102 is attached to coupler bracket 206. Tray 102 is positioned relative to second tray 2900. Tray 102, being coupled to brackets 206, enables tray 102 to move in either sideways direction relative to tray 2900 (versus front and back), allowing access to second tray 2900 space below tray 102. Inside second tray 2900 and first tray 102 can be a removable tray 104. A finger guard shield 5202, which is shown in FIG. 55C, may also be used. Guard shield 5202 moves in conjunction with coupler mechanism 202 and 206 on left or right side of tray. A finger guard shield 5202 moves in conjunction with coupler mechanism 202 and 206 on the right side in at least one embodiment. Locking mechanism 110 can be mounted on finger guard shield 52024. When rack system 300 is at its full point of travel, locking mechanism can lock to coupler 206. Such embodiments may include one or more additional features of the rack systems 100, 300, 400 of the present disclosure other than those shown herein.

As shown in FIGS. 54A, 54B, and 54C, exemplary system 300 embodiments of the present disclosure can comprise a tray 2900, having trays 102, 103 positioned relative thereto, configured to be pulled outward from an external structure 220, for example, whereby "outward" is referred to, for example, pulling tray 2900 toward a user pulling tray 2900 toward the user from external structure 220, such as shown in FIG. 54A. Once tray 2900 is pulled out, such as shown in FIG. 54B and the upper portion of FIG. 54C, a first tray 102 can be pulled out in a first sideways direction, and a second tray 103 can be pulled out in a second sideways direction opposite the first sideways direction, such as shown in FIG. 54B. Trays 102, 103 can also be pushed back in toward tray 2900 to rest relatively above tray 2900, and tray 2900, along with trays 102 and 103, can be pushed back into, for example, external structure 220.

In other embodiments, such as shown in FIGS. 55A, 55B, 55C, and 55D, exemplary system 300 embodiments of the present disclosure can comprise a tray 2900, having a tray 102 positioned relative thereto, configured to be pulled outward from an external structure 220, for example, whereby "outward" is referred to, for example, pulling tray 2900 toward a user pulling tray 2900 toward the user from external structure 220, such as shown in FIG. 55A. Once tray 2900 is pulled out, such as shown in FIG. 55B and FIG. 55C, a tray 102 can be pulled out in a sideways direction (such as left or right), such as shown in FIG. 55B. Tray 102 can also be pushed back in toward tray 2900 to rest relatively above tray 2900, and tray 2900, along with tray 102, can be pushed back into, for example, external structure 220.

As referenced in FIGS. 54A-55D, tray 2900 can extend outward from external structure 220 (or support box 3500, etc.) by way of a glider mechanism 200 having a coupler bracket 206, whereby glider mechanism 200 is coupled to tray 2900 and pivoting relative thereto by way of at least one rotation mechanism 1500, and whereby coupler bracket 206 is coupled to external structure 220 (or support box 3500, etc.). In such embodiments, glider mechanism 200 can extend relatively outward and in a horizontal direction to provide support to tray 2900, and the at least one rotation mechanism 1500 can allow tray 2900 to extend relatively outward in a relatively horizontal fashion and while allowing a rear portion of tray 2900 to move upward, such as by way of at least one cam mechanism 3502 moving along a guide channel 3504 defined within external structure 220 (or support box 3500, etc.), whereby guide channel 3504 is relatively diagonal relative to a side of external structure 220 (or support box 3500, etc.), to allow a rear portion of tray 2900 to move relatively upward while tray 2900 extends outward from external structure 220 (or support box 3500, etc.). Once tray 2900 is extended therefrom, such as shown in the upper portion of FIG. 54C and in FIG. 55C, one or both of trays 102, 103 (depending on embodiment) can move relatively sideways relative to the extension of tray 2900 from external structure 220 (or support box 3500, etc.), such as shown in FIGS. 54B and 55C, by way of glider mechanisms 200 (with portions of said mechanisms 200, such as side wall bracket 202 and coupler bracket 206, shown in the figures).

Figure 56A:
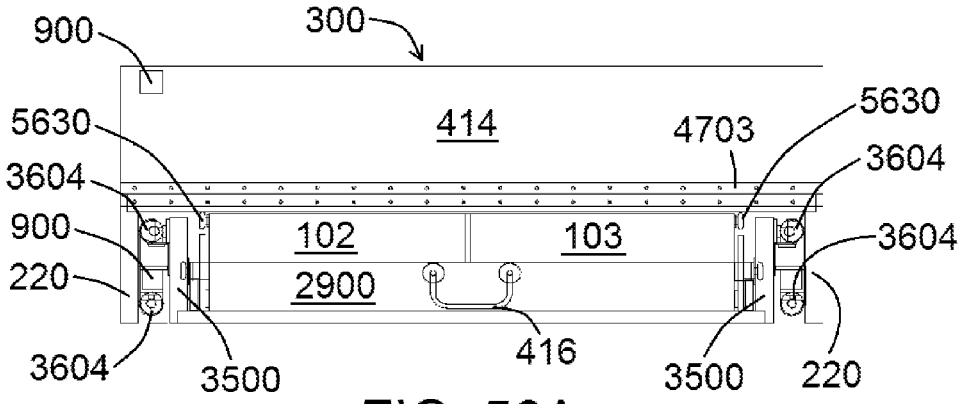
FIG. 56A shows a front view of a system, according to an embodiment of the present disclosure.
Figure 56B:
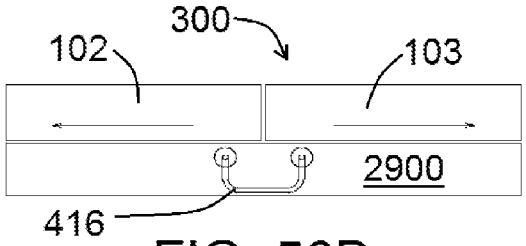
FIG. 56B shows a front view of trays of a system, according to an embodiment of the present disclosure.
Figure 56C:
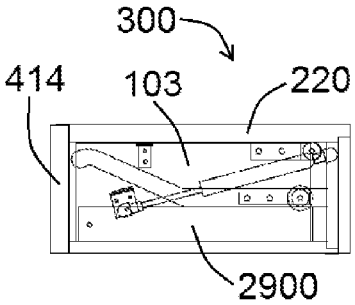
FIGS. 56C and 56D show side views of a system, according to embodiments of the present disclosure.
Figure 56D:
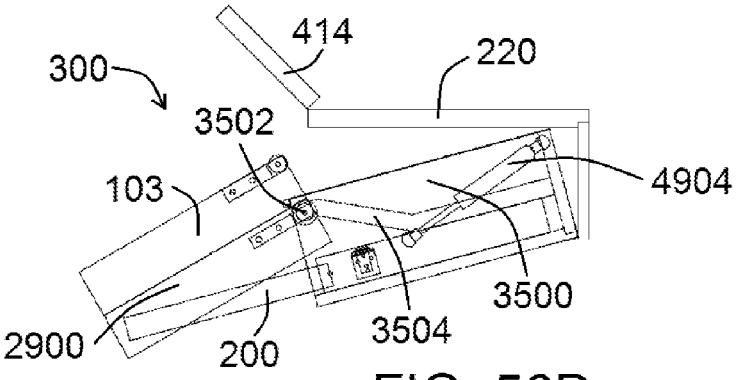

FIG. 56A and FIG. 56B shows front views, and FIG. 56C and FIG. 56D shows a side view, of exemplary systems 300 (or portions thereof) of the present disclosure. As shown in FIG. 56A, for example, system 300 comprises trays 102, 103, 2900, whereby tray 2900 is relatively below trays 102 and 103, and whereby trays 102 and 103 are relatively next to one another above tray 2900. Trays 102, 103, 2900 can be positioned relatively within a support box 3500, such as shown in FIG. 56A, within an external structure 220, as previously referenced herein, or the like, so that trays 102, 103, 2900 are relatively enclosed as may be desired. A cover plate 414, such as shown in FIG. 56A, can be hingedly coupled to support box 3500, external structure 220, etc., via cover hinge 4703 coupled to cover plate 414 and support box 3500, external structure 220, etc., to allow cover plate 414 to cover a relative front of said trays 102, 103, 2900 and a handle 416 coupled to tray 2900, for example. FIG. 56B shows trays 102, 103, 2900 positioned relative to one another, as referenced above, with arrows shown in the figure to indicate relative outward lateral movement of trays 102, 103. FIG. 56C shows a side view of a system 300, with cover plate 414, support box 3500, and trays 103, 2900 readily shown therein. FIG. 56C shows a side view of a relatively "closed" system 300, and FIG. 56D shows a side view of a relatively "open" system 300. As shown in FIG. 56D, support box 3500 is relatively tilted downward from external structure 220, and trays 103, 2900 are extended downward and outward (diagonally outward) from support box 2900, in part by way of glider mechanism 200 as referenced herein.

Figure 56E:
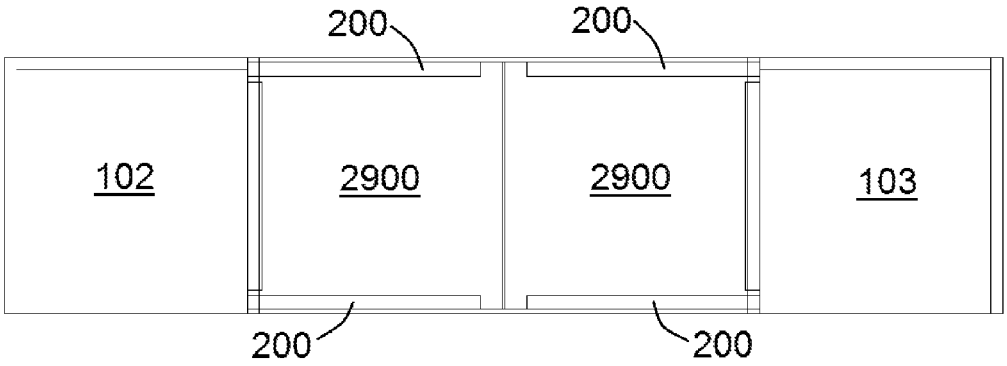
FIG. 56E shows a top view.
Figure 56F:
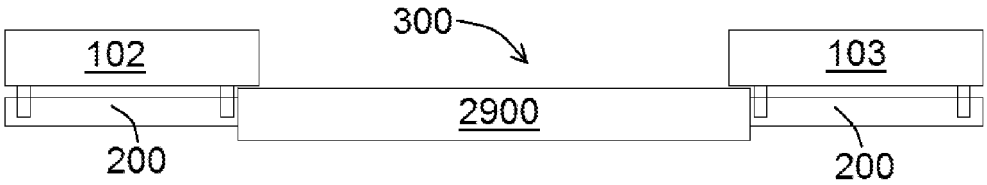
FIG. 56F shows a front view, of trays of a system in an open configuration, according to embodiments of the present disclosure.
Figure 56G:
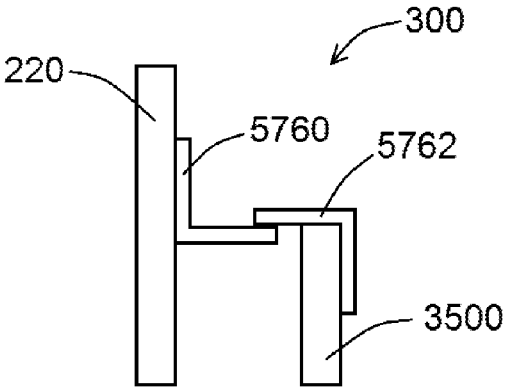
FIG. 56G shows a side view of portions of a system having brackets, according to an embodiment of the present disclosure.

FIG. 56E shows a top view, and FIG. 56F shows a front view, of portions of an exemplary system 300 in a relatively open configuration. As shown therein, tray 2900 is positioned relatively below trays 102, 103, and trays 102, 103 are configured for sideways lateral movement relative to tray 2900. As shown therein, portions of glider mechanisms 200 can be coupled to tray 2900 and one or both of trays 102, 103, so that trays 102, 103 can move relative to tray 2900, guided by glider mechanisms. When fully open, such as shown in FIGS. 56E and 56F, the interiors of trays 102, 103, and 2900 can be readily accessed.

As referenced in FIG. 56D, tray 2900 can extend outward from external structure 220 (and/or support box 3500, etc.) by way of a glider mechanism 200, whereby glider mechanism 200 is coupled to tray 2900. In such embodiments, glider mechanism 200 can extend relatively outward and in a horizontal direction, such as shown in FIG. 56D. A rear portion of tray 2900 can move relatively upward while tray 2900 extends outward, such as by way of at least one cam mechanism 3502 moving along a guide channel 3504 defined within external structure 220 (or support box 3500, etc.), whereby guide channel 3504 is relatively diagonal relative to a side of external structure 220 (or support box 3500, etc.), to allow a rear portion of tray 2900 to move relatively upward while tray 2900 extends outward from external structure 220 (or support box 3500, etc.). Once tray 2900 is extended therefrom, such as shown in FIG. 54D, one or both of trays 102, 103 (depending on embodiment) can move relatively sideways relative to the extension of tray 2900 from external structure 220 (or support box 3500, etc.), such as shown in FIGS. 56E and 56F, by way of glider mechanisms 200 (with portions of said mechanisms 200, such as side wall bracket 202 and coupler bracket 206, shown in the figures). Optional glider actuators 4904 (or other shocks referenced herein, such as tilt actuators 3604) can be part of various system 300 embodiments, such as shown in FIGS. 56C and 56D, coupled to support box 3500 (and/or extension housing 220, for example), so to dampen the speed of extension of support box 3500 from extension housing, for example, to provide for a more smooth and speed-controlled movement.

Figure 58A:
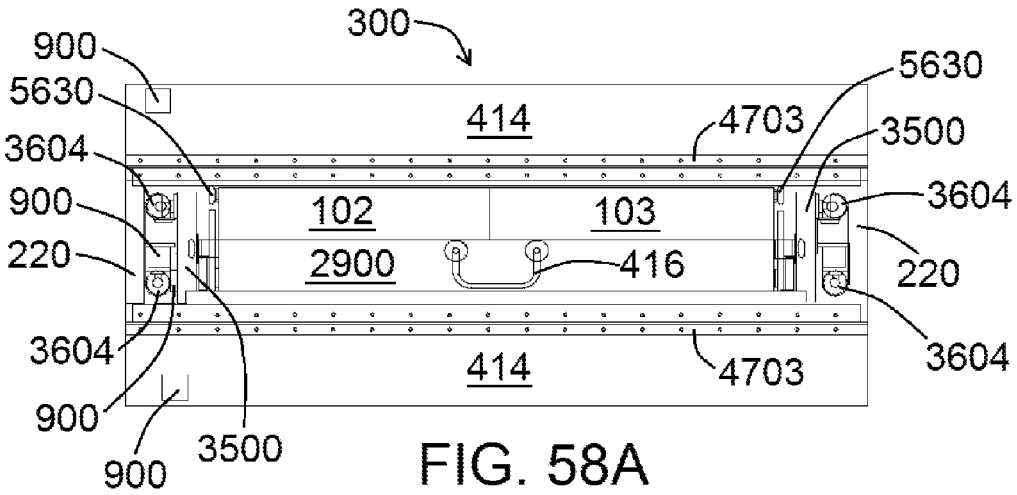

FIGS. 56A and 58A also shows other components of an exemplary systems 300 of the present disclosure. As shown therein, exemplary systems 300 may further comprise one or more tilt actuators 3604 (or other shocks referenced herein, such as glider actuators 4904), coupled to portions of tray 2900 and support box 3500, so to facilitate smooth movement of tray 2900 relative to support box 3500. Other tilt actuators 3604 (or other shocks referenced herein, such as glider actuators 4904) can be coupled to support box 3500 or external structure 220 and a cover plate 414 to facilitate smooth movement of cover plate 414 (smooth opening and closing) relative to support box 3500 or external structure 220. One or more latch mechanisms 900, such as those referenced in FIG. 10A and described herein, can also be used, whereby one portion of latch mechanism 900 (such as that portion comprising latch member 904) can be coupled to cover plate 414, and whereby another portion of latch mechanism 900 (such as that portion comprising button 908 and arms 910, 912, for example) can be coupled to support box 3500 or external structure 220, as may be desired, so to allow one or more cover plates 414 (with one cover plate 414 shown in FIG. 56A and two cover plates shown in FIG. 58A) to be readily opened and closed (and to remain closed until opened). Furthermore, one or more upper gliders 5630, configured as wheels or other components coupled to trays 102 and/or 103 and configured to facilitate smooth movement of trays 102 and/or 103 relative to an inner upper wall 3590 (the ceiling) of support box 3500 as tray 2900, and therefore trays 102, 103, are moved outward and downward relative to support box 3500, such as shown in FIG. 56D. Upper gliders 5630 then help force trays 102 and/or 103 downward and help reduce sound while trays 102, 103, 2900 are moved down and out.

Figure 57A:
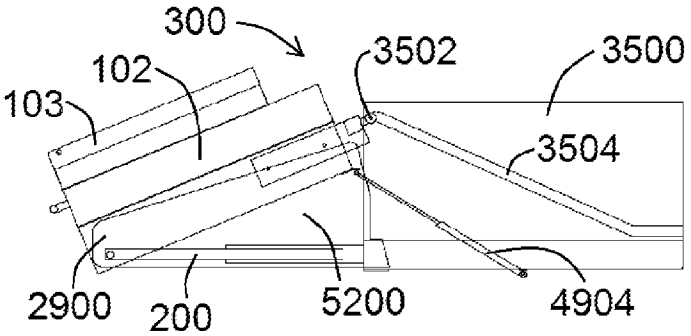
FIGS. 57A, 57B, 57C, and 57D show side views of systems with one or more trays extended and/or opened, according to embodiments of the present disclosure.
Figure 57B:
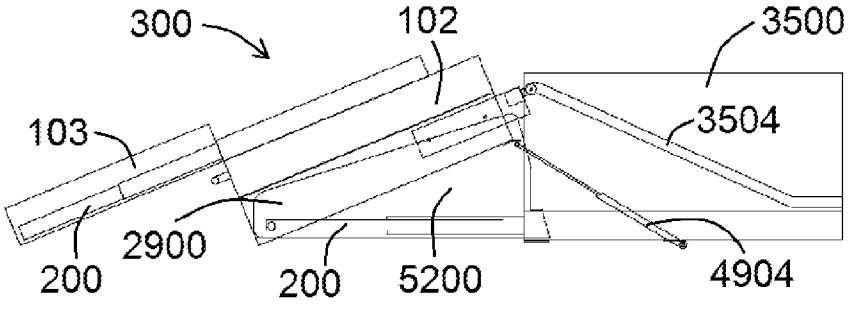
Figure 57C:
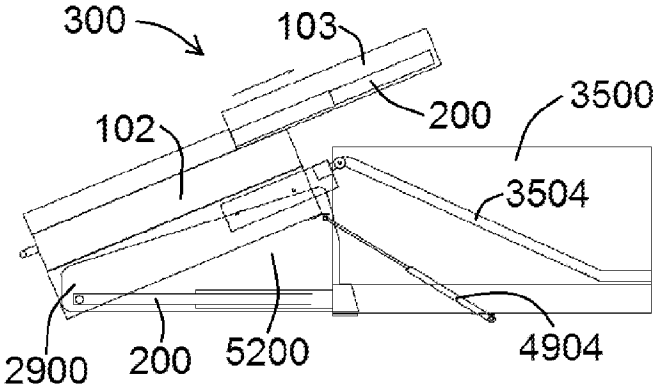
Figure 57D:
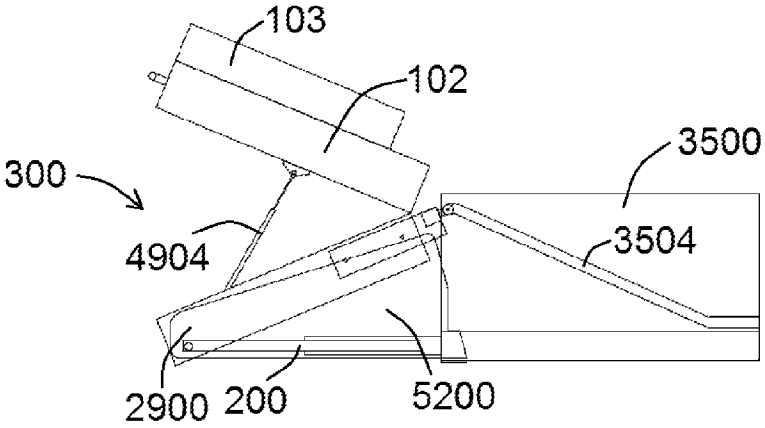
Figure 57F:
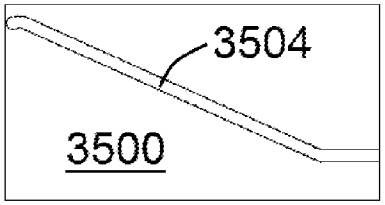
FIGS. 57F and 57G show side walls of a support box, according to embodiments of the present disclosure.
Figure 57H:
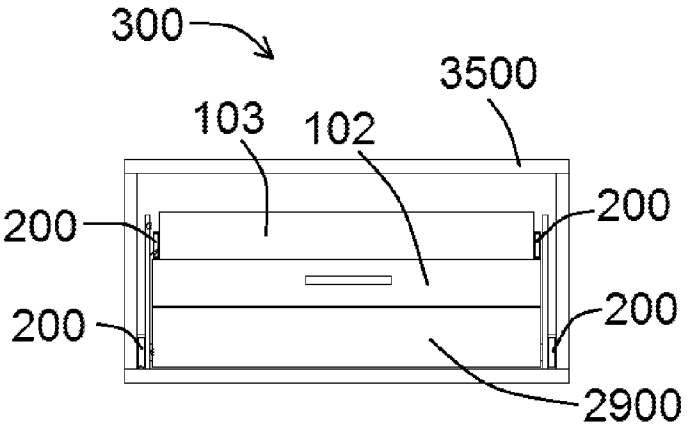
FIGS. 57H and 58A show front views of systems, according to embodiments of the present disclosure.
Figure 57E:
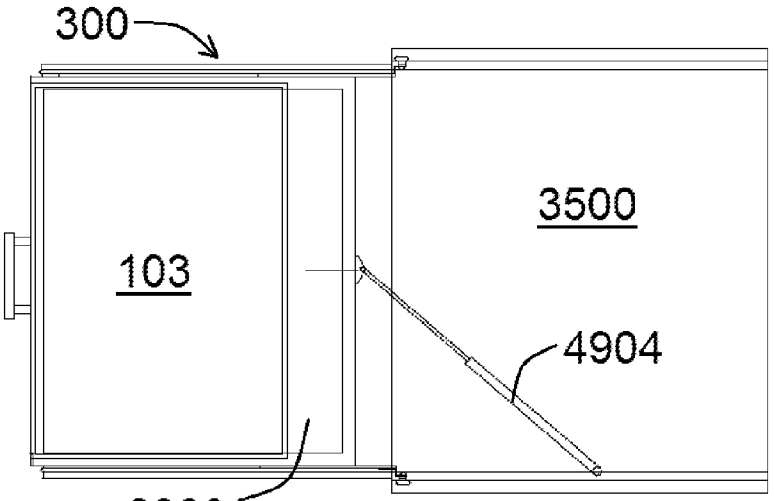
FIG. 57E shows a top view of a system with an open tray, according to an embodiment of the present disclosure.
Figure 57G:
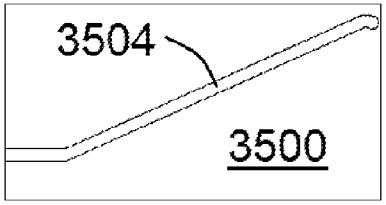

FIG. 57G shows a side cut-away view of a portion of an exemplary system 300, whereby a sidewall of an external structure 220 is shown adjacent to a sidewall of a support box. As shown therein, a first bracket 5760 is coupled to external structure 220, and a second bracket 5762 is coupled to a sideway of support box 3500, so that when support box 3500 is tilted downward and forward relative to external structure 220, such as shown in FIG. 56D, first bracket 5760 engages second bracket 5762 so to limit relative downward movement of support box 3500 (so to maintain a desired angle of support box, such as shown in FIG. 56D. The overall weight of support box 3500, along with any trays such as tray 2900 is/are then supported by way of engagement of first bracket 5760 with second bracket 5762. Brackets 5760, 5762 can be coupled to other portions of system 300, such as to tray 2900, for example.

FIGS. 57A, 57B, 57C, and 57D show side views of exemplary system 300 embodiments of the present disclosure. As shown in one or more of FIGS. 57A, 57B, 57C, and 57D, exemplary systems 300 can comprise trays 2900, 102, 103, whereby tray 2900 (along with trays 102, 103) is configured to extend from support box 3500 (and/or extension housing 220, for example), such as by way of one or more glider mechanisms 200 coupled to tray 2900 and support box 3500 (and/or extension housing 220) and by way of at least one cam mechanism 3502 moving along a guide channel 3504 defined within external structure 220 (or support box 3500, etc.), whereby guide channel 3504 is relatively diagonal relative to a side of external structure 220 (or support box 3500, etc.), to allow a rear portion of tray 2900 to move relatively upward while tray 2900 extends outward from external structure 220 (or support box 3500, etc.). After tray 2900 is extended relatively outward, tray 103, positioned relatively above tray 102 (which is positioned relatively above tray 2900), can further extend outward and downward (diagonally), as shown in FIG. 57B, and/or can be retracted inward and upward (diagonally), as shown in FIG. 57C, relative to tray 102. To achieve such a movement, one or more glider mechanisms 200 can be coupled to tray 103 and to tray 102, so that tray 103 can move relative to tray 102 by extending or retracting glider mechanisms. In various embodiments, such as shown in FIG. 57D, a glider actuator 4904 (or other actuator/shock as referenced herein, such as a tilt actuator 3604) can be coupled to tray 2900 and to tray 102 so to allow tray 102 to pivot upward relative to tray 2900, allowing access to an interior of tray 2900. Finger guards 5200 may be coupled to tray 2900 and/or other portions of system 300 as referenced herein and ah shown in FIGS. 57A-57D.

FIG. 57E shows a top view, and FIG. 57H shows a front view, of an exemplary system 300 of the present disclosure, such as one or more of systems 300 shown in FIGS. 57A-57D. As shown in FIG. 57E, a glider actuator 4904 (or other actuator/shock as referenced herein, such as a tilt actuator 3604) can be coupled to tray 2900 and to glider mechanism 200 or support box 3500 to assist smooth movement of tray 2900 relative to support box 3500. FIG. 57F shows a side view of a portion of a right side of support box 3500, and FIG. 57G shows a side view of a portion of a left side of support box 3500, showing the angled (diagonal) cam channel 3504 defined therein.

FIG. 58A shows a front view of an exemplary system 300 of the present disclosure. As shown therein, system 300 comprises two cover plates 414, such as shown in FIG. 56A, which can be hingedly coupled to support box 3500, external structure 220, etc., via cover hinges 4703 coupled to cover plates 414 and support box 3500, external structure 220, etc., to allow cover plates 414 to cover a relative front of said trays 102, 103, 2900 and a handle 416 coupled to tray 2900, for example. One cover plate 414 can be hingedly coupled at a relative top, and another cover plate 414 can be hingedly coupled to a relative bottom, such as shown in FIG. 58A.

Figure 58B:
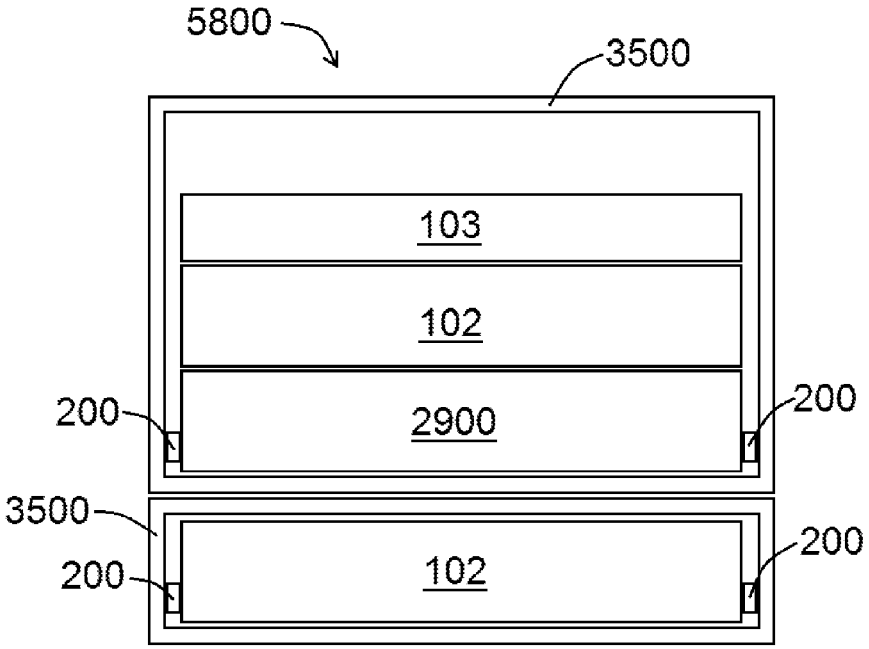
FIG. 58B shows a front view of a modular system, according to an embodiment of the present disclosure.

FIG. 58B shows an exemplary embodiment of a modular system 5800 of the present disclosure. As shown there, an exemplary modular system 5800 comprises one or more support boxes 3500, wherein each support box contains/comprises at least one tray (at least one of trays 102, 103, 2900, for example). Said modular system 5800 can comprise one, two, three, four, or more modules (support boxes 3500 plus at least one tray 102, 103, 2900), and positioned relative to (next to, adjacent to, etc.) one another, or away from one another, as may be desired.

System 300 embodiments shown in FIGS. 54A-55B other figures herein, are configured to be positioned relatively below an existing cabinet, such as an upper kitchen (wall-mounted) cabinet, for example.

As referenced herein, systems 100, 300, and 400 refer to the same general "system" of the present disclosure, and the various features and/or components of one exemplary system 100, 300, and/or 400 may be present within another system 100, 300, or 400. For example, any number of systems 100, 300, and/or 400 can incorporate one or more removable trays 104 therein, wherein said removable trays 104 are configured to fit within one or more of trays 102, 103, 2900.

While various embodiments of rack and drawer systems and methods of using and producing the same have been described in considerable detail herein, the embodiments are merely offered as non-limiting examples of the disclosure described herein. It will, therefore, be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A system, comprising:

a first tray;

a second tray positioned relatively above the first tray;

a support box positioned around at least part of the first tray and the second tray;

a first glider mechanism coupled to the first tray on a first side of the first tray and further coupled to the support box;

a second glider mechanism coupled to the first tray on a second side of the first tray opposite the first side and further coupled to the support box;

a third glider mechanism coupled to the first tray and the second tray;

an external structure at least partially surrounding the support box; and a first cover plate hingedly coupled to an external structure at or near a relative top of the external structure;

wherein the system is configured so that the first tray and the second tray can be extended outward from the support box in a first direction by extending the first glider mechanism and the second glider mechanism;

wherein the system is further configured so that the second tray can be moved sideways perpendicular to the first direction by extending the third glider mechanism; and wherein the support box is configured to tilt downward at an angle relative to the external structure, and wherein the first tray is configured to extend outward from the support box while the support box is tilted downward at the angle relative to the external structure.

2. The system of claim 1, further comprising:

a fourth glider mechanism coupled to the first tray and a third tray.

3. The system of claim 1, further comprising:

a first cam mechanism coupled to the first tray on a first side of the first tray, the first cam mechanism configured to fit within a first guide channel defined within the support box.

4. The system of claim 3, wherein the first guide channel is configured to allow a rear portion of the first tray to move upwards simultaneously as a front portion of the first tray is extended from the support box in a horizontal direction by the first glider mechanism and the second glider mechanism, such that the first tray is configured to have a gradually increasing tilt relative to the first glider mechanism and the second glider mechanism as the first tray is extended from the support box.

5. The system of claim 1, further comprising:

a third tray positioned relatively above the first tray and positioned next to the second tray; and an additional glider mechanism coupled to the first tray and the third tray.

6. The system of claim 5, wherein the third tray is configured to move in the first direction.

7. The system of claim 5, wherein the system is further configured so that the third tray can be moved sideways perpendicular to the first direction by extending the additional glider mechanism.

8. The system of claim 1, further comprising:

a first finger guard coupled to the first tray on a first side of the first tray.

9. The system of claim 7, further comprising:

a second finger guard coupled to the first tray on a second side of the first tray.

10. The system of claim 1, further comprising:

a first tilt actuator coupled to the first tray and the support box.

11. The system of claim 1, further comprising:

a second cover plate hingedly coupled to the external structure at or near a relative bottom of the external structure.

12. The system of claim 1, further comprising:

a first bracket coupled to the external structure; and a second bracket coupled to the support box;

wherein the first bracket is configured to contact the second bracket when the support box is tilted downward relative to the external structure.

13. The system of claim 1, further comprising:

a tilt mechanism coupled to the first tray and the second tray, the tilt mechanism configured to allow the second tray to pivot upward relative to the first tray.

14. A system, comprising:

a first tray;

a second tray positioned relatively above the first tray;

a third tray positioned relatively above the first tray and next to the second tray;

a support box positioned around at least part of the first tray, the second tray, and the third tray;

a first glider mechanism coupled to the first tray on a first side of the first tray and further coupled to the support box;

a second glider mechanism coupled to the first tray on a second side of the first tray opposite the first side and further coupled to the support box;

a third glider mechanism coupled to the first tray and the second tray;

an additional glider mechanism coupled to the first tray and the third tray;

an external structure at least partially surrounding the support box; and a first cover plate hingedly coupled to the external structure at or near a relative top of the external structure;

wherein the system is configured so that the first tray, the second tray, and the third tray can be extended outward from the support box in a first direction by extending the first glider mechanism and the second glider mechanism;

wherein the system is further configured so that the second tray can be moved sideways perpendicular to the first direction by extending the third glider mechanism;

wherein the system is further configured so that the third tray can be moved sideways perpendicular to the first direction by extending the additional glider mechanism;

wherein the support box is configured to tilt downward at an angle relative to the external structure, and wherein the first tray is configured to extend outward from the support box while the support box is tilted downward at the angle relative to the external structure.

15. The system of claim 14, further comprising:

a first cam mechanism coupled to the first tray on a first side of the first tray, the first cam mechanism configured to fit within a first guide channel defined within the support box.

16. The system of claim 14, further comprising:

a first finger guard coupled to the first tray on a first side of the first tray; and a second finger guard coupled to the first tray on a second side of the first tray.

17. A system, comprising:

a support box at least partially surrounding a first tray positioned below a second tray;

a first glider mechanism and a second glider mechanism each coupled to the first tray and the support box and configured to allow the first tray to be extended outward from the support box in a first direction;

a third glider mechanism coupled to the first tray and the second tray and configured to allow the second tray to be extended sideways perpendicular to the first direction;

an external structure at least partially surrounding the support box; and a first cover plate hingedly coupled to the external structure at or near a relative top of the external structure;

wherein the support box is configured to tilt downward at an angle relative to the external structure, and wherein the first tray is configured to extend outward from the support box while the support box is tilted downward at the angle relative to the external structure.

18. The system of claim 17, further comprising:

a third tray positioned next to the second tray; and an additional glider mechanism coupled to the first tray and the third tray and configured to allow the third tray to be extended sideways perpendicular to the first direction.

* * * * *